US012628874B2

(12) United States Patent
Illidge et al.

(10) Patent No.: US 12,628,874 B2
(45) Date of Patent: May 19, 2026

(54) SMOKING SUBSTITUTE APPARATUS

(71) Applicant: Imperial Tobacco Limited, Bristol (GB)

(72) Inventors: Benjamin Illidge, Liverpool (GB); Benjamin Astbury, Liverpool (GB); Nikhil Aggarwal, Liverpool (GB)

(73) Assignee: Imperial Tobacco Limited, Bristol (GB)

( * ) Notice: Subject to any disclaimer, the term of this patent is extended or adjusted under 35 U.S.C. 154(b) by 362 days.

(21) Appl. No.: 17/695,283

(22) Filed: Mar. 15, 2022

(65) Prior Publication Data

US 2022/0202097 A1 Jun. 30, 2022

Related U.S. Application Data

(63) Continuation of application No. PCT/EP2020/076256, filed on Sep. 21, 2020.

(30) Foreign Application Priority Data

Sep. 20, 2019 (EP) ..... 19198592
Sep. 20, 2019 (EP) ..... 19198616
(Continued)

(51) Int. Cl.
*A24F 40/10* (2020.01)
*A24F 40/485* (2020.01)

(52) U.S. Cl.
CPC ..... *A24F 40/485* (2020.01); *A24F 40/10* (2020.01)

(58) Field of Classification Search
None
See application file for complete search history.

(56) References Cited

U.S. PATENT DOCUMENTS 1,908,878 A * 5/1933 Abrams ..... A24F 1/00 131/201
2009/0095311 A1 4/2009 Han
(Continued)

FOREIGN PATENT DOCUMENTS

CN 110 089 779 A 8/2019
EP 0 295 122 A2 12/1988
(Continued)

OTHER PUBLICATIONS

International Search Report (19198592.8-1004), dated Mar. 27, 2020, 10 pages.
(Continued)

*Primary Examiner* — Philip Y Louie
*Assistant Examiner* — Nicole A Szumigalski
(74) *Attorney, Agent, or Firm* — DUNLAP CODDING, P.C.

(57) ABSTRACT

A smoking substitute apparatus for generating an aerosol, comprising: an air inlet and an outlet; a passage extending between the air inlet and the outlet, air flowing in use along the passage for inhalation by a user drawing on the apparatus; and an aerosol generation chamber containing an aerosol generator being operable to generate an aerosol from an aerosol precursor; wherein the aerosol generation chamber comprises at least one chamber outlet in fluid communication with the passage at a junction, the at least one chamber outlet permitting, in use, aerosol generated by the aerosol generator to be entrained into an air flow along the passage; and wherein the passage has a constriction configured to induce, in use, a localized reduced pressure in the air flow at the junction for drawing out the aerosol from the aerosol generation chamber.

16 Claims, 29 Drawing Sheets

(30) Foreign Application Priority Data

Sep. 20, 2019 (EP) ..... 19198620
Sep. 20, 2019 (EP) ..... 19198636

(56) References Cited

U.S. PATENT DOCUMENTS

| | | | | |
|---|---|---|---|---|
| 2011/0094523 | A1 | 4/2011 | Thorens et al. | |
| 2013/0284192 | A1 | 10/2013 | Peleg et al. | |
| 2014/0190496 | A1* | 7/2014 | Wensley | A61M 11/042 131/273 |
| 2014/0202472 | A1 | 7/2014 | Levitz et al. | |
| 2014/0334802 | A1 | 11/2014 | Dubief | |
| 2015/0114409 | A1 | 4/2015 | Brammer et al. | |
| 2015/0117841 | A1* | 4/2015 | Brammer | H05B 3/02 |
| 2015/0201675 | A1 | 7/2015 | Lord | |
| 2016/0353799 | A1 | 12/2016 | Otto | |
| 2017/0280768 | A1 | 10/2017 | Lipowicz | |
| 2017/0325505 | A1 | 11/2017 | Force et al. | |
| 2017/0360093 | A1 | 12/2017 | Fernando | |
| 2018/0042306 | A1 | 2/2018 | Atkins et al. | |
| 2018/0160736 | A1 | 6/2018 | Qiu | |
| 2018/0199627 | A1 | 7/2018 | Bowen et al. | |
| 2018/0289066 | A1 | 10/2018 | Mo et al. | |
| 2018/0360116 | A1 | 12/2018 | Schmidt et al. | |
| 2019/0090538 | A1 | 3/2019 | Li et al. | |

FOREIGN PATENT DOCUMENTS

| | | | |
|---|---|---|---|
| EP | 2 925 395 | A1 | 10/2015 |
| EP | 3 135 136 | A1 | 3/2017 |
| WO | WO 2013/083635 | A1 | 6/2013 |
| WO | WO 2016/040575 | A1 | 3/2016 |
| WO | WO 2017/153270 | A1 | 9/2017 |
| WO | WO 2018/037206 | A1 | 3/2018 |
| WO | WO 2018/041450 | A1 | 3/2018 |
| WO | WO 2018/099999 | A1 | 6/2018 |
| WO | WO 2018/115109 | A1 | 6/2018 |
| WO | WO 2018/224677 | A2 | 12/2018 |
| WO | WO 2019/171417 | A1 | 9/2019 |

OTHER PUBLICATIONS

International Search Report (19198616.5-1004), dated Apr. 6, 2020, 9 pages.

International Search Report (19198620.7-1004), dated Apr. 6, 2020, 9 pages.

International Search Report (19198636.3-1004), dated Mar. 25, 2020, 9 pages.

International Search Report and Written Opinion (PCT/EP2020/076256), dated Jan. 20, 2021, 15 pages.

* cited by examiner $I = 0.55\ \%$ $I = 0.55\ \%$ $I = 0.55\ \%$ $I = 1.06\ \%$ $I = 1.06\ \%$ $I = 1.06\ \%$

SMOKING SUBSTITUTE APPARATUS

CROSS-REFERENCE TO RELATED APPLICATIONS/INCORPORATION BY REFERENCE STATEMENT

This application is a non-provisional application claiming benefit to the international application no. PCT/EP2020/076256, filed on Sep. 21, 2020, which claims priority to EP 19198616.5 filed on Sep. 20, 2019, EP 19198636.3 filed on Sep. 20, 2019, EP 19198620.7 filed on Sep. 20, 2019, and EP 19198592.8 filed on Sep. 20, 2019. The entire contents of each of the above-referenced applications are hereby incorporated herein by reference in their entirety.

FIELD OF THE DISCLOSURE

The present disclosure relates to a smoking substitute apparatus and, in particular, a smoking substitute apparatus that is able to deliver nicotine to a user in an effective manner.

BACKGROUND

The smoking of tobacco is generally considered to expose a smoker to potentially harmful substances. It is thought that a significant amount of the potentially harmful substances are generated through the burning and/or combustion of the tobacco and the constituents of the burnt tobacco in the tobacco smoke itself.

Low temperature combustion of organic material such as tobacco is known to produce tar and other potentially harmful by-products. There have been proposed various smoking substitute systems in which the conventional smoking of tobacco is avoided.

Such smoking substitute systems can form part of nicotine replacement therapies aimed at people who wish to stop smoking and overcome a dependence on nicotine.

Known smoking substitute systems include electronic systems that permit a user to simulate the act of smoking by producing an aerosol (also referred to as a "vapor") that is drawn into the lungs through the mouth (inhaled) and then exhaled. The inhaled aerosol typically bears nicotine and/or a flavorant without, or with fewer of, the health risks associated with conventional smoking.

In general, smoking substitute systems are intended to provide a substitute for the rituals of smoking, whilst providing the user with a similar, or improved, experience and satisfaction to those experienced with conventional smoking and with combustible tobacco products.

The popularity and use of smoking substitute systems has grown rapidly in the past few years. Although originally marketed as an aid to assist habitual smokers wishing to quit tobacco smoking, consumers are increasingly viewing smoking substitute systems as desirable lifestyle accessories. There are a number of different categories of smoking substitute systems, each utilizing a different smoking substitute approach. Some smoking substitute systems are designed to resemble a conventional cigarette and are cylindrical in form with a mouthpiece at one end. Other smoking substitute devices do not generally resemble a cigarette (for example, the smoking substitute device may have a generally box-like form, in whole or in part).

One approach is the so-called "vaping" approach, in which a vaporizable liquid, or an aerosol former or aerosol precursor, sometimes typically referred to herein as "e-liquid", is heated by a heating device (sometimes referred to herein as an electronic cigarette or "e-cigarette" device) to produce an aerosol vapor which is inhaled by a user. The e-liquid typically includes a base liquid, nicotine and may include a flavorant. The resulting vapor therefore also typically contains nicotine and/or a flavorant. The base liquid may include propylene glycol and/or vegetable glycerin.

A typical e-cigarette device includes a mouthpiece, a power source (typically a battery), a tank for containing e-liquid and a heating device. In use, electrical energy is supplied from the power source to the heating device, which heats the e-liquid to produce an aerosol (or "vapor") which is inhaled by a user through the mouthpiece.

E-cigarettes can be configured in a variety of ways. For example, there are "closed system" vaping smoking substitute systems, which typically have a sealed tank and heating element. The tank is pre-filled with e-liquid and is not intended to be refilled by an end user. One subset of closed system vaping smoking substitute systems include a main body which includes the power source, wherein the main body is configured to be physically and electrically couplable to a consumable including the tank and the heating element. In this way, when the tank of a consumable has been emptied of e-liquid, that consumable is removed from the main body and disposed of. The main body can then be reused by connecting it to a new, replacement, consumable. Another subset of closed system vaping smoking substitute systems are completely disposable, and intended for one-use only.

There are also "open system" vaping smoking substitute systems which typically have a tank that is configured to be refilled by a user. In this way the entire device can be used multiple times.

An example vaping smoking substitute system is the Myblu™ e-cigarette. The Myblu™ e-cigarette is a closed system which includes a main body and a consumable. The main body and consumable are physically and electrically coupled together by pushing the consumable into the main body. The main body includes a rechargeable battery. The consumable includes a mouthpiece and a sealed tank which contains e-liquid. The consumable has an air inlet which is fluidly connected to an outlet at the mouthpiece by an air flow channel. The consumable further includes a heater, which for this device is a heating filament coiled around a portion of a wick positioned across the width of the air flow passage. The wick is partially immersed in the e-liquid, and conveys e-liquid from the tank to the heating filament. The system is controlled by a microprocessor on board the main body. The system includes a sensor for detecting when a user is inhaling through the mouthpiece, the microprocessor then activating the device in response. When the system is activated, electrical energy is supplied from the power source to the heating device, which heats e-liquid from the tank to produce a vapor, which promptly condenses to form an aerosol as it is cooled by an air flow passing through the air flow passage. A user may therefore inhale the generated aerosol through the mouthpiece.

SUMMARY OF THE DISCLOSURE

For a smoking substitute system, it is desirable to deliver nicotine into the user's lungs, where it can be absorbed into the bloodstream. However, the present disclosure is based in part on a realization that in some prior art smoking substitute systems, such delivery of nicotine is not efficient. In some prior art systems, the aerosol droplets have a size distribution that is not suitable for delivering nicotine to the lungs. Aerosol droplets of a large particle size tend to be deposited in the mouth and/or upper respiratory tract. Aerosol particles of a small (e.g., sub-micron) particle size can be inhaled into the lungs but may be exhaled without delivering nicotine to the lungs. As a result, the user would require drawing a longer puff, more puffs, or vaporizing e-liquid with a higher nicotine concentration in order to achieve the desired experience.

Furthermore, in such prior art smoking substitute systems the air inlet is often positioned at the base of the vaporizing chamber. In use, coalesced aerosol droplets that are too large to be suspended in the airflow, as well as excess aerosol precursor that is wicked from the sealed tank, may undesirably leak through the air inlet by gravity.

Accordingly, there is a need for improvement in the delivery of nicotine to a user, as well as reduction in liquid leakage, in the context of a smoking substitute system.

Development A

The present disclosure (Development A) has been devised in the light of the above considerations.

In a general aspect of Development A, the present disclosure utilizes flow-induced localized pressure reduction in order to draw out an aerosol from an aerosol generation chamber.

According to a first preferred aspect of Development A there is provided a smoking substitute apparatus for generating an aerosol, comprising:

an air inlet and an outlet;

a passage extending between the air inlet and the outlet, air flowing in use along the passage for inhalation by a user drawing air through the apparatus; and an aerosol generating chamber containing an aerosol generator being operable to generate an aerosol from an aerosol precursor;

wherein the aerosol generation chamber comprises at least one chamber outlet in fluid communication with the passage at a junction, the at least one chamber outlet permitting, in use, aerosol generated by the aerosol generator to be entrained into an air flow along the passage; and wherein the passage has a constriction configured to induce, in use, a localized reduced pressure in the air flow at the junction for drawing out the aerosol from the aerosol generation chamber.

The smoking substitute apparatus, or consumable, may comprise a housing containing the aerosol generation chamber. The air inlet may open at a first end of the housing, which may be a base of the smoking substitute apparatus. The first end of the housing may be engageable with a main body of a smoking substitute system. The outlet may open at a second end of the housing having a mouthpiece which the user may puff onto in order to draw an air flow through the passage. Alternatively, or in addition, the air inlet may open at a sidewall of the housing, wherein the passage may extend directly towards the outlet at the second end of the housing, or it may extend towards the first end of the housing before routing back towards the outlet at the second end of the housing.

In contrast to prior art smoking substitute systems, which generate an aerosol by directly passing an air flow over the heater, the passage according to the present disclosure may be arranged to allow all, or substantially all, of the air flow entering the apparatus through the air inlet to bypass the aerosol generation chamber. In other words, the passage may extend externally to the aerosol generation chamber. More specifically, the air flow may not directly pass over the aerosol generator, but may only come into contact with the aerosol once the aerosol has been discharged from the aerosol generation chamber.

The aerosol precursor may comprise a liquid aerosol precursor, and wherein the aerosol generator may comprise a heater configured to generate the aerosol by vaporizing the liquid aerosol precursor. The liquid aerosol precursor may be an e-liquid and may comprise nicotine and a base liquid such as propylene glycol and/or vegetable glycerin and may include a flavorant. The aerosol generator may be a heater such as a heater coil wounded around a wick.

In use, the aerosol generator may vaporize an aerosol precursor to form a vapor. A portion of the vapor may cool and condense to from an aerosol in the aerosol generation chamber and subsequently be discharged to the passage through the chamber outlet. The remaining portion of vapor may emerge through the chamber outlet into the passage, and may form further aerosol upon contacting the air flow in the passage. The aerosol generation chamber is arranged to reduce ingress of air flow from the passage, and thereby reduces the turbulence around the aerosol generator in the aerosol generation chamber.

For example, the aerosol generation chamber may be substantially sealed against air flow except for the at least one chamber outlet. More specifically, the at least one chamber outlet may form the only aperture, or apertures in the case where there is a plurality of chamber outlets, of the aerosol generation chamber that provides a substantial gas flow passage for a gas, e.g., a gas containing an aerosol, through the sealed aerosol generation chamber. In other words, the aerosol generator is located in a stagnant cavity of the aerosol generation chamber, wherein said stagnant cavity is substantially free of the air flow entering the housing through the air inlet. Because the air flow does not pass through the internal volume of the aerosol generation chamber, said internal volume may form the stagnant cavity during a user puff. "Stagnant" may not necessarily mean a complete lack of convection, e.g., a degree of convention may result from vapor and/or aerosol generated during aerosol formation. Advantageously, because the air flow substantially does not pass over the aerosol generator, such arrangement may reduce the amount of turbulence in the vicinity of the aerosol generator. Accordingly, an aerosol with enlarged droplet sizes may be formed.

It is contemplated that the aerosol generation chamber may have a vent to permit minor ingress of air into the chamber, in particular to aid pressure equalization in the aerosol generation chamber. However, it is considered that such a vent (or vents) would not contribute significantly to air flow through the chamber in a manner to affect the air flow delivered to the user. In alternative embodiments, there may be no such vent.

The aerosol generation chamber may be configured to discharge aerosol to the passage based on the pressure difference between the aerosol generation chamber and the passage. For example, the aerosol may be drawn into the passage due to a reduced pressure downstream, or it may be expelled from the aerosol generation chamber due to an elevated pressure resulting from aerosol generation.

The chamber outlet may be defined as an opening at the aerosol generation chamber which directly opens to the passage at the junction, e.g., the passage is adjacent to the aerosol generation chamber. Alternatively, the chamber outlet may be spaced from the passage and is in fluid communication with the junction of the passage through an aerosol channel. The aerosol channel may be configured such that pressure drop in the aerosol across the aerosol channel is negligible.

The constriction may be positioned at, or adjacent to, the junction. That is, the cross sectional area or hydraulic diameter of the passage at or adjacent to said junction may be smaller than the portion of passage immediately upstream of the junction in the direction of air flow. Such arrangement may cause the air flow to accelerate through the constriction. According to Bernoulli's principle, as the air flow increases in speed through the constriction, the pressure of the air flow therein may reduce accordingly. This may result in a localized reduced pressure, or pressure drop, at the junction and therefore as it passes through the junction, the air flow may draw the vapor and/or aerosol out of the aerosol generation chamber. Advantageously, this may allow the aerosol to be discharged from the aerosol generation chamber more effectively.

Furthermore, as the aerosol is formed in the aerosol generation chamber, the vaporized aerosol precursor, or the vapor, may expand in the aerosol generation chamber and thereby it may increase the internal pressure at the aerosol generation chamber. Such elevated internal pressure may advantageously help forcing the aerosol through the chamber opening into the passage, even when the user is not puffing on the mouthpiece.

For example, the aerosol generation chamber may have a specified volume of air at atmospheric pressure prior to the vaporization of aerosol precursor. As the user puffs on the mouthpiece, the pressure inside the passage decreases which may cause an activation of the aerosol generator and thus the vaporization process. At the same time, the localized reduced pressure downstream of the aerosol generation chamber may draw out the higher-pressure aerosol or air out of the aerosol generation chamber to equalize the pressure therein. This may result in an equalized pressure across the aerosol generation chamber and the outlet.

During aerosol generation, aerosol precursor may be vaporized at the heater and expand into the surrounding stagnant air. The vaporized aerosol precursor may immediately begin to cool and some of the condensed vapor may form aerosol droplets suspended in the air. Due to vaporization two mechanisms of pressure increase may occur in the aerosol generation chamber:

The vapor has a defined volume at a particular temperature. Adding this volume of gaseous vapor to the defined volume of air inside the aerosol generation chamber may increase the pressure therein.

The aerosol droplets has a specified volume. These liquid droplets may displace the same volume of air.

Both effects may increase the pressure in the aerosol generation chamber with respect to the reduced pressure downstream caused by the venturi effect. This may aid the expulsion of vapor and/or aerosol from the aerosol generation chamber during vaporization.

By reducing or limiting the volume of the aerosol generation chamber, the expulsion of the aerosol from the chamber may be made more efficient. That is, a smaller aerosol generation chamber volume may result in greater pressure rise in the aerosol generation chamber for a given vapor generation rate. More specifically, increasing the internal volume of the aerosol generation chamber may reduce the amount of vapor and/or aerosol that is able to be ejected from the aerosol generation chamber during a puff, with the aerosol generated with an increase average droplet size. On the other hand, reducing the internal volume of the aerosol generation chamber increases the amount of vapor and/or aerosol during a puff with a reduction in the average aerosol droplet size. Optionally, the aerosol generation chamber is configured to have an internal volume ranging between 68 $mm^3$ to 680 $mm^3$. Optionally, the length of the aerosol generation chamber ranges between 2 mm to 20 mm. Such arrangements may advantageously allow the aerosol to be expulsed from the aerosol generation chamber at a rate greater than 0.1 mg/second during a puff.

The aerosol generation chamber may resemble an open ended container or a cup. The chamber outlet may open towards the second end of the housing, or the mouthpiece. More specifically, when the apparatus is oriented upright in use, the chamber outlet may be directed towards an upward direction during use. Advantageously, this may help to contain any excess aerosol precursor and/or coalesced aerosol droplets in the aerosol generation chamber, any thereby preventing liquid leakage out of the chamber outlet. Alternatively, or in addition, the chamber outlet opens on a sidewall of the aerosol generation chamber, e.g., the aerosol generated in the aerosol generation chamber may be entrained into the passage from a direction orthogonal to the air flow.

The aerosol generation chamber may comprise a base, wherein the base may be sealed to prevent fluid leakage through the first end of the housing. More specifically, the base of the aerosol generation chamber may be completely closed or it may comprise sealed apertures for allowing electrical contact to extending therethrough. Advantageously, such arrangement may prevent excess aerosol precursor and coalesced aerosol droplets in the aerosol generation chamber to leak through the base of the apparatus.

Optionally, the constriction comprises one or more of a venturi tube, an orifice plate and a narrowed section along the passage. For example, in the case of a venturi tube, the constriction may comprise, in the direction of air flow, a flow converging portion followed by a narrowed passage, wherein the hydraulic diameter of the narrowed passage is smaller than the flow converging portion. More specifically, the chamber outlet is configured to be in fluid communication with the narrowed passage where a localized pressure drop is created by the air flow. Advantageously, such arrangement allows the aerosol in the aerosol generation chamber to be drawn into the narrowed passage more effectively by the lowered pressure.

Optionally, the passage comprises an expanded portion immediately upstream of the constriction in the passage. More specifically, the expanded portion may have a larger hydraulic diameter than the constriction. Furthermore, the expanded portion may have a larger hydraulic diameter than the passage immediate upstream thereto. Advantageously, such expanded portion may allow an air flow to slow down before it accelerates through the constriction. As a result, it may allow a larger pressure drop across the constriction, and therefore it may lead to a more effective extraction of aerosol from the aerosol generation chamber.

Optionally, a portion of the flow passage extends alongside the aerosol generation chamber. Optionally, a portion of the flow passage coaxially extends alongside the aerosol generation chamber. For example, the passage may take the form of an annulus surrounding the aerosol generation chamber. Advantageously, the passage may form an effective insulation for reducing heat transfer to the external surface of the housing.

Optionally, the junction is configured to be in fluid communication with the chamber outlet through a junction inlet, and wherein said junction inlet opens towards a direction orthogonal to the air flow at the junction. That is, the aerosol may be drawn into the junction from the side of the passage. Advantageously, this may allow the aerosol to mix with the air flow in a more effective manner, and thereby allowing aerosol to form more uniformly.

Alternatively, the chamber outlet is positioned adjacent to the passage and opens in the direction of air flow. For example, the chamber outlet may open directly to the passage. Such arrangement may allow the aerosol and air flow to flow concurrently, and therefore advantageously, such arrangement may reduce the turbulence when the two are mixed at the junction.

Optionally, the chamber outlet is closed by a one way valve, such as a check valve or a duck bill value, which may advantageously prevent the air flow from entering the aerosol generation chamber through the chamber outlet.

Optionally, the volumetric flowrate of aerosol in the aerosol generation chamber is arranged to be less than 0.1 litre per minute. More specifically, the arrangement according to the present disclosure may reduce or eliminate the amount of air flow entering the aerosol generation chamber. Advantageously, this may reduce the turbulence in the vicinity of the heater, and thereby increasing the median aerosol droplet size, $d_{50}$, in the aerosol at the outlet. Here, the flowrate of aerosol is considered to be the flowrate of air with the entrained aerosol droplets.

Optionally, the smoking substitute apparatus further comprises a tank for storing a reservoir of liquid aerosol precursor. The tank may be spaced from the aerosol generation chamber. The tank may be arranged to be in fluid communication with a wick of the heater through a liquid conduit. The tank may be provided at a location between the aerosol generation chamber and the outlet, and therefore the wick may not extend directly from the aerosol generation chamber into the tank. Advantageously, this may allow the tank to be positioned flexibly at various positions within the housing, and thereby such arrangement may free up the space required for the constriction.

The liquid conduit may be sized to control the feed rate of the aerosol precursor from the tank to the wick. Optionally, the liquid conduit has a hydraulic diameter ranging from 0.01 mm to 10 mm for controlling the flow rate of the aerosol precursor from the tank towards the wick. Optionally, the liquid conduit has a hydraulic diameter ranging from 0.01 mm to 5 mm. Optionally, the liquid conduit has a hydraulic diameter ranging from 0.1 mm to 1 mm. Advantageously, such arrangements may limit the flow of aerosol precursor towards the wick under gravity, and thereby may reduce the leakage of excess aerosol precursor into the aerosol generation chamber.

Furthermore, the inclusion of a liquid conduit may solve the problem of insufficient supply of aerosol precursor at the wick. For example, by adapting a stagnant aerosol generation chamber there is a substantial lack of air flow in the aerosol generation chamber, therefore the associated driving force, e.g., the pressure drop in the aerosol generation chamber, for drawing out aerosol precursor from the tank may reduce accordingly. By relocating the tank to a position between the aerosol generation chamber and the outlet, e.g., by locating the tank above the aerosol generation chamber when the apparatus is in an upright orientation during use, the aerosol precursor may flow from the tank towards the wick under additional hydraulic head and thereby mitigate such problem. Advantageously, by providing a liquid conduit that is configured to allow sufficient flow of aerosol precursor, the wick may be prevented from drying out during vaporization.

In addition, different consumables having liquid conduits with different hydraulic diameters may be used to accommodate different types of users. For example, consumables having liquid conduits with broader hydraulic diameter may cater for heavy users taking longer puffs, where an increased flow of aerosol precursor may reduce the likelihood of drying out at the wick. Consumables having liquid conduits with narrower hydraulic diameter may cater for light users who take shorter puffs, where a reduced flow of aerosol precursor may reduce the amount of excess aerosol precursor at the wick.

Optionally, the aerosol generator is located at a position immediately upstream of the chamber outlet. More specifically, the aerosol generator may be positioned in the aerosol generation chamber by the chamber outlet. Advantageously, this may shorten the path of travel for the aerosol and thereby allows the aerosol to be drawn into the passage more effectively.

Alternatively, the aerosol generator may be spaced from the chamber outlet. Advantageously, such arrangement may reduce the likelihood of air flow entering into the aerosol generation chamber, and thereby limiting the turbulence in the vicinity of the aerosol generator. Further, this may increase the residence time of the vapor in the aerosol generation chamber and thus it may allow some aerosol droplets to form and even coalesce before being entrained in the air flow. Optionally, the aerosol generator is separated from the chamber outlet by a distance of at least 10 mm. Optionally, the aerosol generator is separated from the chamber outlet by a distance ranged from 10 mm to 50 mm.

Optionally, the passage comprises a flow converging portion downstream to the aerosol generation chamber, the flow converging portion is configured to converge the aerosol with the air flow in the passage. Optionally, the flow converging portion comprises a funnel or a tapered section for gradually merging the aerosol with the air flow. Advantageously, this may reduce the turbulence that may prohibit the formation of larger aerosol droplets. Alternatively, or in addition, the flow converging portion comprises a length of passage having a constant cross sectional profile along its length. Advantageously, this reduces the change in flow direction of the aerosol and the air flow as they flow towards the outlet. Optionally, the flow converging portion having a length of at least 10 mm. Optionally, the flow converging portion having a length between 10 mm and 50 mm.

Optionally, the aerosol generation chamber is configured to have a uniform cross sectional profile along its length. Optionally, the chamber outlet is configured to have the same cross sectional profile as the aerosol generation chamber. For example, the aerosol flow path along the length of the aerosol generation chamber may have the same cross-sectional area. Advantageously, this may reduce turbulence, as well as fluctuation in pressure in the aerosol flow path and thereby such arrangement may lead to an increase in the size of aerosol droplets.

Optionally, the smoking substitute apparatus is configured to generate an aerosol having a median droplet size, d50, of at least 1 μm. Optionally, the smoking substitute apparatus is configured to generate an aerosol having a median droplet size, d50, ranged between 1 μm to 4 μm. Optionally, the smoking substitute apparatus is configured to generate an aerosol having a median droplet size, d50, ranged between 2 μm to 3 μm. Advantageously, aerosol having droplets in such size ranges may improve delivery of nicotine into the user's lung, by reducing the likelihood of nicotine deposition in the mouth and/or upper respiratory tract, e.g., in the case of oversized aerosol droplets, or not being absorbed at all, e.g., in the case of undersized aerosol droplets.

According to a second aspect of Development A there is provided a smoking substitute system for generating an aerosol, comprising:

i) the smoking substitute apparatus of the first aspect of Development A; and ii) a main body configured to engage with the smoking substitute apparatus; wherein the main body comprises a controller and a power source configured to energize the aerosol generator.

According to a third aspect of Development A there is provided a method of using the smoking substitute apparatus of the first aspect of Development A, comprising:

i) generating the aerosol with the aerosol generator;

ii) drawing on the apparatus to induce a localized pressure drop in the air flow at the junction, so as to draw out the generated aerosol from the aerosol generation chamber.

There now follows a disclosure of various optional features. These are intended to be applicable to Development A, disclosed above, and may also be applied in any combination (unless the context demands otherwise) to any aspect, embodiment or optional feature set out with respect to Development B, Development C and/or Development D.

The smoking substitute apparatus may be in the form of a consumable. The consumable may be configured for engagement with a main body. When the consumable is engaged with the main body, the combination of the consumable and the main body may form a smoking substitute system such as a closed smoking substitute system. For example, the consumable may comprise components of the system that are disposable, and the main body may comprise non-disposable or non-consumable components (e.g., power supply, controller, sensor, etc.) that facilitate the generation and/or delivery of aerosol by the consumable. In such an embodiment, the aerosol precursor (e.g., e-liquid) may be replenished by replacing a used consumable with an unused consumable.

Alternatively, the smoking substitute apparatus may be a non-consumable apparatus (e.g., that is in the form of an open smoking substitute system). In such embodiments an aerosol precursor (e.g., e-liquid) of the system may be replenished by re-filling, e.g., a reservoir of the smoking substitute apparatus, with the aerosol precursor (rather than replacing a consumable component of the apparatus).

In light of this, it should be appreciated that some of the features described herein as being part of the smoking substitute apparatus may alternatively form part of a main body for engagement with the smoking substitute apparatus. This may be the case in particular when the smoking substitute apparatus is in the form of a consumable.

Where the smoking substitute apparatus is in the form of a consumable, the main body and the consumable may be configured to be physically coupled together. For example, the consumable may be at least partially received in a recess of the main body, such that there is an interference fit between the main body and the consumable. Alternatively, the main body and the consumable may be physically coupled together by screwing one onto the other, or through a bayonet fitting, or the like.

Thus, the smoking substitute apparatus may comprise one or more engagement portions for engaging with a main body. In this way, one end of the smoking substitute apparatus may be coupled with the main body, whilst an opposing end of the smoking substitute apparatus may define a mouthpiece of the smoking substitute system.

The smoking substitute apparatus may comprise a reservoir configured to store an aerosol precursor, such as an e-liquid. The e-liquid may, for example, comprise a base liquid. The e-liquid may further comprise nicotine. The base liquid may include propylene glycol and/or vegetable glycerin. The e-liquid may be substantially flavorless. That is, the e-liquid may not contain any deliberately added additional flavorant and may consist solely of a base liquid of propylene glycol and/or vegetable glycerin and nicotine.

The reservoir may be in the form of a tank. At least a portion of the tank may be light-transmissive. For example, the tank may comprise a window to allow a user to visually assess the quantity of e-liquid in the tank. A housing of the smoking substitute apparatus may comprise a corresponding aperture (or slot) or window that may be aligned with a light-transmissive portion (e.g., window) of the tank. The reservoir may be referred to as a "clearomizer" if it includes a window, or a "cartomizer" if it does not.

The outlet may be at a mouthpiece of the smoking substitute apparatus. In this respect, a user may draw fluid (e.g., air) into and through the passage by inhaling at the outlet (i.e., using the mouthpiece). The passage may be at least partially defined by the tank.

The smoking substitute apparatus may comprise an aerosol generator. The aerosol generator may comprise a wick. The aerosol generator may further comprise a heater. The wick may comprise a porous material, capable of wicking the aerosol precursor. A portion of the wick may be exposed in the aerosol generation chamber. The wick may also comprise one or more portions in contact with liquid stored in the reservoir, e.g., via the liquid conduit. For example, opposing ends of the wick may protrude into the reservoir, or liquid conduit in fluid communication with the reservoir, and an intermediate portion (between the ends) may extend across the aerosol generation chamber. Thus, liquid may be drawn (e.g., by capillary action) along the wick, from the reservoir to the portion of the wick extending across the aerosol generation chamber.

The heater may comprise a heating element, which may be in the form of a filament wound about the wick (e.g., the filament may extend helically about the wick in a coil configuration). The heating element may be wound about the intermediate portion of the wick that extends across the aerosol generation chamber. The heating element may be electrically connected (or connectable) to a power source. Thus, in operation, the power source may apply a voltage across the heating element so as to heat the heating element by resistive heating. This may cause liquid stored in the wick (i.e., drawn from the tank) to be heated so as to form a vapor in the aerosol generation chamber. This vapor may subsequently cool to form an aerosol in the aerosol generation chamber, typically downstream from the heating element.

In use, the user may puff on a mouthpiece of the smoking substitute apparatus, i.e., draw on the smoking substitute apparatus by inhaling, to draw in an air stream therethrough. The air stream (also referred to as a "dilution air flow" or "bypass air flow)) may bypass the aerosol generation chamber and be directed to mix with the generated aerosol downstream from the aerosol generation chamber. That is, the dilution air flow may be an air stream at an ambient temperature and may not be directly heated at all by the aerosol generator. Alternatively, the dilution air flow may be directly inhaled by the user without passing though the passage of the smoking substitute apparatus.

As a user puffs on the mouthpiece, vaporized e-liquid or aerosol may entrained in the air flow along the passage may be drawn towards the outlet of passage. For example, the vapor may cool, and thereby nucleate and/or condense to form a plurality of aerosol droplets, e.g., nicotine-containing aerosol droplets. A portion of these aerosol droplets may be delivered to and be absorbed at a target delivery site, e.g., a user's lung, whilst a portion of the aerosol droplets may instead adhere onto other parts of the user's respiratory tract, e.g., the user's oral cavity and/or throat. Typically, in some known smoking substitute apparatuses, the aerosol droplets as measured at the outlet of the passage, e.g., at the mouthpiece, may have a median droplet size, d50, of less than 1 μm.

The median particle droplet size, d50, of an aerosol may be measured by a laser diffraction technique. For example, the stream of aerosol output from the outlet of the passage may be drawn through a Malvern Spraytec laser diffraction system, where the intensity and pattern of scattered laser light are analyzed to calculate the size and size distribution of aerosol droplets. As will be readily understood, the particle size distribution may be expressed in terms of d10, d50 and d90, for example. Considering a cumulative plot of the volume of the particles measured by the laser diffraction technique, the d10 particle size is the particle size below which 10% by volume of the sample lies. The d50 particle size is the particle size below which 50% by volume of the sample lies. The d90 particle size is the particle size below which 90% by volume of the sample lies. Unless otherwise indicated herein, the particle size measurements are volume-based particle size measurements, rather than number-based or mass-based particle size measurements.

The smoking substitute apparatus (or main body engaged with the smoking substitute apparatus) may comprise a power source. The power source may be electrically connected (or connectable) to a heater of the smoking substitute apparatus (e.g., when the smoking substitute apparatus is engaged with the main body). The power source may be a battery (e.g., a rechargeable battery). A connector in the form of e.g., a USB port may be provided for recharging this battery.

When the smoking substitute apparatus is in the form of a consumable, the smoking substitute apparatus may comprise an electrical interface for interfacing with a corresponding electrical interface of the main body. One or both of the electrical interfaces may include one or more electrical contacts. Thus, when the main body is engaged with the consumable, the electrical interface of the main body may be configured to transfer electrical power from the power source to a heater of the consumable via the electrical interface of the consumable.

The electrical interface of the smoking substitute apparatus may also be used to identify the smoking substitute apparatus (in the form of a consumable) from a list of known types. For example, the consumable may have a certain concentration of nicotine and the electrical interface may be used to identify this. The electrical interface may additionally or alternatively be used to identify when a consumable is connected to the main body.

Again, where the smoking substitute apparatus is in the form of a consumable, the main body may comprise an identification means, which may, for example, be in the form of an RFID reader, a barcode or QR code reader. This identification means may be able to identify a characteristic (e.g., a type) of a consumable engaged with the main body. In this respect, the consumable may include any one or more of an RFID chip, a barcode or QR code, or memory within which is an identifier and which can be interrogated via the identification means.

The smoking substitute apparatus or main body may comprise a controller, which may include a microprocessor. The controller may be configured to control the supply of power from the power source to the heater of the smoking substitute apparatus (e.g., via the electrical contacts). A memory may be provided and may be operatively connected to the controller. The memory may include non-volatile memory. The memory may include instructions which, when implemented, cause the controller to perform certain tasks or steps of a method.

The main body or smoking substitute apparatus may comprise a wireless interface, which may be configured to communicate wirelessly with another device, for example a mobile device, e.g., via Bluetooth®. To this end, the wireless interface could include a Bluetooth® antenna. Other wireless communication interfaces, e.g., WIFI®, are also possible. The wireless interface may also be configured to communicate wirelessly with a remote server.

A puff sensor may be provided that is configured to detect a puff (i.e., inhalation from a user). The puff sensor may be operatively connected to the controller so as to be able to provide a signal to the controller that is indicative of a puff state (i.e., puffing or not puffing). The puff sensor may, for example, be in the form of a pressure sensor or an acoustic sensor. That is, the controller may control power supply to the heater of the consumable in response to a puff detection by the sensor. The control may be in the form of activation of the heater in response to a detected puff. That is, the smoking substitute apparatus may be configured to be activated when a puff is detected by the puff sensor. When the smoking substitute apparatus is in the form of a consumable, the puff sensor may be provided in the consumable or alternatively may be provided in the main body.

The term "flavorant" is used to describe a compound or combination of compounds that provide flavor and/or aroma. For example, the flavorant may be configured to interact with a sensory receptor of a user (such as an olfactory or taste receptor). The flavorant may include one or more volatile substances.

The flavorant may be provided in solid or liquid form. The flavorant may be natural or synthetic. For example, the flavorant may include menthol, licorice, chocolate, fruit flavor (including e.g., citrus, cherry etc.), vanilla, spice (e.g., ginger, cinnamon) and tobacco flavor. The flavorant may be evenly dispersed or may be provided in isolated locations and/or varying concentrations.

The present inventors consider that a flow rate of 1.3 L $min^{-1}$ is towards the lower end of a typical user expectation of flow rate through a conventional cigarette and therefore through a user-acceptable smoking substitute apparatus. The present inventors further consider that a flow rate of 2.0 L $min^{-1}$ is towards the higher end of a typical user expectation of flow rate through a conventional cigarette and therefore through a user-acceptable smoking substitute apparatus. Embodiments of the present disclosure therefore provide an aerosol with advantageous particle size characteristics across a range of flow rates of air through the apparatus.

The aerosol may have a Dv50 of at least 1.1 μm, at least 1.2 μm, at least 1.3 μm, at least 1.4 μm, at least 1.5 μm, at least 1.6 μm, at least 1.7 μm, at least 1.8 μm, at least 1.9 μm or at least 2.0 μm.

The aerosol may have a Dv50 of not more than 4.9 μm, not more than 4.8 μm, not more than 4.7 μm, not more than 4.6 μm, not more than 4.5 μm, not more than 4.4 μm, not more than 4.3 μm, not more than 4.2 μm, not more than 4.1 μm, not more than 4.0 μm, not more than 3.9 μm, not more than 3.8 μm, not more than 3.7 μm, not more than 3.6 μm, not more than 3.5 μm, not more than 3.4 μm, not more than 3.3 μm, not more than 3.2 μm, not more than 3.1 μm or not more than 3.0 μm.

A particularly preferred range for Dv50 of the aerosol is in the range 2-3 μm.

When the air flow rate inhaled by the user through the apparatus is 1.3 L $min^{-1}$, the average magnitude of velocity of air in the vaporization chamber may be not more than 0.001 $ms^{-1}$, or not more than 0.005 $ms^{-1}$, or not more than 0.01 $ms^{-1}$, or not more than 0.05 $ms^{-1}$.

The aerosol generator may comprise a vaporizer element loaded with aerosol precursor, the vaporizer element being heatable by a heater and presenting a vaporizer element surface to air in the vaporization chamber. A vaporizer element region may be defined as a volume extending outwardly from the vaporizer element surface to a distance of 1 mm from the vaporizer element surface.

The air inlet, flow passage, outlet and the vaporization chamber may be configured so that, when the air flow rate inhaled by the user through the apparatus is 1.3 L $min^{-1}$, the average magnitude of velocity of air in the vaporizer element region is in the range 0-1.2 $ms^{-1}$. The average magnitude of velocity of air in the vaporizer element region may be calculated using computational fluid dynamics.

When the air flow rate inhaled by the user through the apparatus is 1.3 L $min^{-1}$, the average magnitude of velocity of air in the vaporizer element region may be not more than 0.001 $ms^{-1}$, or not more than 0.005 $ms^{-1}$, or not more than 0.01 $ms^{-1}$, or not more than 0.05 $ms^{-1}$.

When the average magnitude of velocity of air in the vaporizer element region is in the ranges specified, it is considered that the resultant aerosol particle size is advantageously controlled to be in a desirable range. It is further considered that the velocity of air in the vaporizer element region is more relevant to the resultant particle size characteristics than consideration of the velocity in the vaporization chamber as a whole. This is in view of the significant effect of the velocity of air in the vaporizer element region on the cooling of the vapor emitted from the vaporizer element surface.

Additionally, or alternatively is it relevant to consider the maximum magnitude of velocity of air in the vaporizer element region.

Therefore, the air inlet, flow passage, outlet and the vaporization chamber may be configured so that, when the air flow rate inhaled by the user through the apparatus is 1.3 L $min^{-1}$, the maximum magnitude of velocity of air in the vaporizer element region is in the range 0-2.0 $ms^{-1}$.

When the air flow rate inhaled by the user through the apparatus is 1.3 L $min^{-1}$, the maximum magnitude of velocity of air in the vaporizer element region may be not more than 0.001 $ms^{-1}$, or not more than 0.005 $ms^{-1}$, or not more than 0.01 $ms^{-1}$, or not more than 0.05 $ms^{-1}$.

It is considered that configuring the apparatus in a manner to permit such control of velocity of the airflow at the vaporizer permits the generation of aerosols with particularly advantageous particle size characteristics, including Dv50 values.

Additionally, or alternatively is it relevant to consider the turbulence intensity in the vaporizer chamber in view of the effect of turbulence on the particle size of the generated aerosol. For example, the air inlet, flow passage, outlet and the vaporization chamber may be configured so that, when the air flow rate inhaled by the user through the apparatus is 1.3 L $min^{-1}$, the turbulence intensity in the vaporizer element region is not more than 1%.

When the air flow rate inhaled by the user through the apparatus is 1.3 L $min^{-1}$, the turbulence intensity in the vaporizer element region may be not more than 0.95%, not more than 0.9%, not more than 0.85%, not more than 0.8%, not more than 0.75%, not more than 0.7%, not more than 0.65% or not more than 0.6%.

It is considered that configuring the apparatus in a manner to permit such control of the turbulence intensity in the vaporizer element region permits the generation of aerosols with particularly advantageous particle size characteristics, including Dv50 values.

Following detailed investigations, the inventors consider, without wishing to be bound by theory, that the particle size characteristics of the generated aerosol may be determined by the cooling rate experienced by the vapor after emission from the vaporizer element (e.g., wick). In particular, it appears that imposing a relatively slow cooling rate on the vapor has the effect of generating aerosols with a relatively large particle size. The parameters discussed above (velocity and turbulence intensity) are considered to be mechanisms for implementing a particular cooling dynamic to the vapor.

More generally, it is considered that the air inlet, flow passage, outlet and the vaporization chamber may be configured so that a desired cooling rate is imposed on the vapor. The particular cooling rate to be used depends of course on the nature of the aerosol precursor and other conditions. However, for a particular aerosol precursor it is possible to define a set of testing conditions in order to define the cooling rate, and by extension this imposes limitations on the configuration of the apparatus to permit such cooling rates as are shown to result in advantageous aerosols. Accordingly, the air inlet, flow passage, outlet and the vaporization chamber may be configured so that the cooling rate of the vapor is such that the time taken to cool to 50° C. is not less than 16 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 1.3 L $min^{-1}$.

Additionally, or alternatively, the air inlet, flow passage, outlet and the vaporization chamber may be configured so that the cooling rate of the vapor is such that the time taken to cool to 50° C. is not less than 16 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 2.0 L $min^{-1}$.

Cooling of the vapor such that the time taken to cool to 50° C. is not less than 16 ms corresponds to an equivalent linear cooling rate of not more than 10° C./ms.

The equivalent linear cooling rate of the vapor to 50° C. may be not more than 9° C./ms, not more than 8° C./ms, not more than 7° C./ms, not more than 6° C./ms or not more than 5° C./ms.

Cooling of the vapor such that the time taken to cool to 50° C. is not less than 32 ms corresponds to an equivalent linear cooling rate of not more than 5° C./ms.

The testing protocol set out above considers the cooling of the vapor (and subsequent aerosol) to a temperature of 50° C. This is a temperature which can be considered to be suitable for an aerosol to exit the apparatus for inhalation by a user without causing significant discomfort. It is also possible to consider cooling of the vapor (and subsequent aerosol) to a temperature of 75° C. Although this temperature is possibly too high for comfortable inhalation, it is considered that the particle size characteristics of the aerosol are substantially settled by the time the aerosol cools to this temperature (and they may be settled at still higher temperature).

Accordingly, the air inlet, flow passage, outlet and the vaporization chamber may be configured so that the cooling rate of the vapor is such that the time taken to cool to 75° C. is not less than 4.5 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 1.3 L $min^{-1}$.

Additionally, or alternatively, the air inlet, flow passage, outlet and the vaporization chamber may be configured so that the cooling rate of the vapor is such that the time taken to cool to 75° C. is not less than 4.5 ms, when tested according to the following protocol. The aerosol precursor is an e-liquid consisting of 1.6% freebase nicotine and the remainder a 65:35 propylene glycol and vegetable glycerin mixture, the e-liquid having a boiling point of 209° C. Air is drawn into the air inlet at a temperature of 25° C. The vaporizer is operated to release a vapor of total particulate mass 5 mg over a 3 second duration from the vaporizer element surface in an air flow rate between the air inlet and outlet of 2.0 L $min^{-1}$.

Cooling of the vapor such that the time taken to cool to 75° C. is not less than 4.5 ms corresponds to an equivalent linear cooling rate of not more than 30° C./ms.

The equivalent linear cooling rate of the vapor to 75° C. may be not more than 29° C./ms, not more than 28° C./ms, not more than 27° C./ms, not more than 26° C./ms, not more than 25° C./ms, not more than 24° C./ms, not more than 23° C./ms, not more than 22° C./ms, not more than 21° C./ms, not more than 20° C./ms, not more than 19° C./ms, not more than 18° C./ms, not more than 17° C./ms, not more than 16° C./ms, not more than 15° C./ms, not more than 14° C./ms, not more than 13° C./ms, not more than 12° C./ms, not more than 11° C./ms or not more than 10° C./ms.

Cooling of the vapor such that the time taken to cool to 75° C. is not less than 13 ms corresponds to an equivalent linear cooling rate of not more than 10° C./ms.

It is considered that configuring the apparatus in a manner to permit such control of the cooling rate of the vapor permits the generation of aerosols with particularly advantageous particle size characteristics, including Dv50 values.

Development B

For a smoking substitute system, it is desirable to deliver nicotine into the user's lungs, where it can be absorbed into the bloodstream. However, the present disclosure is based in part on a realization that some prior art smoking substitute systems, such delivery of nicotine is not efficient. In some prior art systems, the aerosol droplets have a size distribution that is not suitable for delivering nicotine to the lungs. Aerosol droplets of a large particle size tend to be deposited in the mouth and/or upper respiratory tract. Aerosol particles of a small (e.g., sub-micron) particle size can be inhaled into the lungs but may be exhaled without delivering nicotine to the lungs. As a result, the user would require drawing a longer puff, more puffs, or vaporizing e-liquid with a higher nicotine concentration in order to achieve the desired experience.

Accordingly, there is a need for improvement in the delivery of nicotine to a user in the context of a smoking substitute system.

The present disclosure (Development B) has been devised in the light of the above considerations.

In a general aspect of Development B, the present disclosure relates to a smoking substitute apparatus having an aerosol generation chamber with a bleed aperture for allowing a minority air flow to ingress into the aerosol generation chamber.

According to a first preferred aspect of Development B there is provided a smoking substitute apparatus for generating an aerosol, comprising:

a housing;

an air inlet and an outlet formed at the housing;

a passage extending between the air inlet and the outlet, in use an air flow entering into the housing to flow along the passage to the outlet for inhalation by a user drawing on the apparatus; and an aerosol generation chamber containing an aerosol generator being operable to generate an aerosol from an aerosol precursor; the aerosol generation chamber comprises at least one chamber outlet in fluid communication with the passage, the at least one chamber outlet permitting, in use, aerosol generated by the aerosol generator to be entrained into the air flow along the passage; and a bleed aperture opening into the aerosol generation chamber and configured to allow air to enter the aerosol generation chamber in an amount that contributes not more than 35% of the air flow at the outlet for inhalation by a user drawing on the apparatus.

For the avoidance of doubt, we note here that a user may draw on the apparatus with or without making physical contact with the apparatus. For example, a mouthpiece or other intervening structure may be provided, separate from and/or separable from the housing of the smoking substitute apparatus, and the user's lips may make contact with this mouthpiece or other intervening structure when drawing on the apparatus.

The aerosol generation chamber may be provided at or towards a first end of the housing. For example, the base of the aerosol generation chamber may form the base of the housing. Said first end of the housing may be engageable with a main body of a smoking substitute system. For convenience, the first end of the housing may be considered to be directed towards a downward direction. The outlet may open at a second end of the housing having a mouthpiece which the user may puff onto in order to draw an air flow through the passage. The air inlet may open at a sidewall of the housing, wherein the passage may extend directly towards the outlet at the second end of the housing, or it may extend towards the first end of the housing before routing back towards the outlet at the second end of the housing.

The aerosol precursor may comprise a liquid aerosol precursor, and wherein the aerosol generator may comprise a heater configured to generate the aerosol by vaporizing the liquid aerosol precursor. The liquid aerosol precursor may be an e-liquid and may comprise nicotine and a base liquid such as propylene glycol and/or vegetable glycerin and may include a flavorant. The aerosol generator may be a heater such as a heater coil wounded around a wick.

In use, the aerosol generator may vaporize an aerosol precursor to form a vapor. The vapor may expand or flow from the aerosol generator to merge or entrain into the air flow in the passage. Said vapor may cool and condense to from an aerosol in the aerosol generation chamber and subsequently be discharged towards the outlet. More specifically, the chamber outlet may be positioned downstream of aerosol generator along the direction of aerosol flow, and therefore the aerosol in the aerosol generation chamber may discharge towards the outlet through the chamber outlet.

In contrast to prior art smoking substitute systems, which generate an aerosol by passing over the heater an entire amount of air flow that is drawn through the outlet, the passage according to the present disclosure may be routed to allow a significant amount of air flow, e.g., a larger portion of air flow entering the housing, to bypass the aerosol generation chamber and thus the aerosol generator. In other words, the passage may extend externally to the aerosol generation chamber and configured to be in fluid communication with the chamber outlet. More specifically, the passage may be configured to allow the majority of air flow (i.e., a first air flow) in an amount that contributes at least 65% of the air flow to bypass the aerosol generator and only come into contact with the aerosol once the aerosol has been discharged from the aerosol generation chamber. For example, the passage may extend along the external sidewalls of the aerosol generation chamber such that the majority of air flow may flow externally and parallel to the aerosol generation chamber, wherein the aerosol generated in the aerosol generation chamber may be drawn into the first air flow along the passage through the chamber outlet. Furthermore, as the aerosol precursor is being vaporized in the aerosol generation chamber, the vapor may expand in the aerosol generation chamber and thereby it may increase the internal pressure at the aerosol generation chamber. Such elevated internal pressure may advantageously aid the convection of the vapor and/or aerosol towards the chamber outlet.

However, due to a lack of air flow in such "stagnant" volume in the aerosol generation chamber, some generated aerosol produced during a puff may not be able to promptly evacuate from the chamber. For example, as the suction downstream to the chamber outlet ceases at the end of a puff, aerosol that has already been generated in the aerosol generation chamber may not be promptly evacuated through the chamber outlet and may remain in the aerosol generation chamber. Therefore gradually, the aerosol droplets may coalesce and settle, and may adhere onto the sidewall and the base of the aerosol generation chamber. Furthermore, at the end of a puff, a partial vacuum, e.g., a lowered pressure or unequalized pressure, within the aerosol generation chamber may cause the aerosol that has already purged through the chamber outlet to backflow into the chamber, until the pressure in the aerosol generation chamber has been equalized.

Therefore advantageously, a bleed aperture may enable a smaller amount of air flow to enter or bleed into the aerosol generation chamber. The bleed aperture may be configured to allow air (i.e., a second air flow) to enter the aerosol generation chamber in an amount that contributes not more than 35% of the air flow at the outlet. The other air flow, that is the air flow entering into the housing to flow along the passage, may be designated as the first air flow. Together the first air flow and the second air flow may be substantially equal to the total amount of air flow at the outlet. The first air flow and the second air flow may enter the smoking substitute apparatus through the same or different air inlets. Optionally, said second air flow may contribute to less than any one of 30%, 25%, 20%, 15%, 10% and 5% of air flow at the outlet. This may induce a relatively low level of convection and turbulence in the aerosol generation chamber, and yet allowing the generated aerosol to be discharged through the chamber outlet more effectively. For example, in use the second air flow entering through the bleed aperture may flush the aerosol generation chamber. Said second air flow may induce a degree of turbulence in the aerosol generation chamber. However, because of the much reduced amount of air flow, the turbulence in the vicinity of the aerosol generator in the present disclosure may be expected to be significantly lower than the amount of turbulence that is otherwise expected in prior art consumables.

Furthermore, such arrangement may reduce the amount of aerosol being drawn, through the chamber outlet, back into the aerosol generation chamber at the end of a puff. Instead, at the end of the puff, the partial vacuum or lowered pressure in the aerosol generation chamber may cause the second air flow, substantially free of aerosol, to be drawn into the chamber through the bleed aperture.

Optionally, the bleed aperture is configured to have a smaller hydraulic diameter to that of the chamber outlet. Optionally, the bleed aperture has a hydraulic diameter of at least 0.01 mm, at least 0.1 mm or at least 0.3 mm. The bleed aperture may have a hydraulic diameter of up to 10 mm, up to 1 mm, or up to 0.7 mm. Advantageously, the bleed aperture may form a flow constrictor for reducing or limiting the amount of air flow entering the aerosol generation chamber there through during a user puff. That is, the bleed aperture may be sized, with respect to the flow resistance across the passage, to vary the amount of second air flow entering the aerosol generation chamber through the bleed aperture.

Optionally, the chamber outlet and the bleed aperture open at opposing ends of the aerosol generation chamber. For example, the chamber outlet may open towards the outlet of the housing, whereby the bleed aperture may open towards the base of the housing. Such arrangement may advantageously allow the second air flow to flow along the entire length of the aerosol generation chamber, and therefore it may improve the efficiency in purging or flushing residual aerosol droplets from the chamber.

The bleed aperture may be configured to allow air from the passage to enter the aerosol generation chamber.

Optionally, the bleed aperture is in fluid communication with the passage through an auxiliary passage. For example, the auxiliary passage may branch from the passage for allowing the second air flow entering the aerosol generation chamber to split from the first air flow in the passage. Such arrangement may advantageously allow said second air flow to stabilize along the auxiliary passage prior to its entrance through the bleed aperture. Alternatively, the bleed aperture may directly open to the passage without the need of an auxiliary passage.

Optionally, the auxiliary passage comprises an auxiliary flow constrictor for limiting the amount of air flow passing through the auxiliary passage. The auxiliary flow constrictor may induce a pressure drop in the second air flow thereacross, and thereby it may advantageously limit the amount of air flow entering the aerosol generation chamber through the bleed aperture.

Optionally, the auxiliary flow constrictor comprises a narrowed section of the auxiliary passage. For example, the narrowed section of the auxiliary passage may configure to have a hydraulic diameter smaller than that of the passage and therefore, it may allow a reduced amount of second air flow to flow through in comparison to that in first air flow in the passage. Advantageously, the narrowed section of the auxiliary passage may be sized to achieve a desired proportion of air flow split between passage and auxiliary passage. In some embodiments, other flow constrictors may be applied, for example an orifice, mesh and protrusions/depressions along the auxiliary passage.

Optionally, the auxiliary flow constrictor is adjustable for controlling the amount of second air flow passing through the auxiliary passage. The auxiliary flow constrictor may be adjustable mechanically or electronically. For example, the sidewall of the auxiliary passage may be deformable such that its cross sectional area may vary to control the pressure drop in the air flow thereacross. Furthermore, a part of the housing adjacent to the auxiliary passage may form from deformable material such that a user may press onto said part of housing to reduce the cross section area of the deformable auxiliary passage. Alternatively, the cross sectional area of the deformable auxiliary passage may be varied using a piezoelectric element. For example, the piezoelectric element may be energized to impart a mechanical force on the deformable auxiliary passage for varying its cross sectional area. In other embodiments, the auxiliary flow constrictor may comprise a valve positioned along the auxiliary passage or at the bleed aperture which may be actuated manually by the user or electronically through a controller of the device.

Optionally, the bleed aperture comprises a one way valve, said one way valve being configured to allow the second air flow to enter the aerosol generation chamber and to prevent leakage out of the aerosol generation chamber through the bleed aperture. For example, the one way valve may comprise a flap valve, a check valve or a duck bill valve that allows a one way flow to enter the aerosol generation chamber. Such arrangement may advantageously prevent vapor to backflow into the auxiliary passage, e.g., during vaporization where there is an increased pressure in the aerosol generation chamber, as well as containing excess aerosol precursor and coalesced aerosol droplet collected at the base of the aerosol generation chamber.

Optionally, the bleed aperture comprises a plurality of bleed apertures distributed over a base of the aerosol generation chamber. Advantageously, such arrangement may allow the second air flow to enter the aerosol generation chamber across a broader region of the base, and thus it may lead to a more effective discharge, or flushing, of the vapor in the aerosol generation chamber. Optionally, the plurality of bleed apertures may be distributed around the periphery of the base of the aerosol generation chamber. Advantageously, such arrangement may misalign the bleed apertures with the heater, and thereby it may reduce the amount of second air flow directly impinging upon the aerosol generator.

Optionally, the smoking substitute apparatus is configured to generate an aerosol having a droplet size, $d_{50}$, of at least 1 μm. Optionally, the smoking substitute apparatus is configured to generate an aerosol having a droplet size, $d_{50}$, ranged between 1 μm to 4 μm. Optionally, the smoking substitute apparatus is configured to generate an aerosol having a droplet size, $d_{50}$, ranged between 2 μm to 3 μm. Advantageously, aerosol having droplets in such size ranges may improve delivery of nicotine into the user's lung, by reducing the likelihood of nicotine deposition in the mouth and/or upper respiratory tract, e.g., in the case of oversized aerosol droplets, or not being absorbed at all, e.g., in the case of undersized aerosol droplets.

The aerosol generation chamber may be configured to discharge aerosol to the passage based on the pressure difference between the aerosol generation chamber and the passage. For example, the aerosol may be drawn into the passage due to a reduced pressure downstream, or it may be carried by the second air flow flowing through the bleed aperture, or it may be expelled from the aerosol generation chamber due to an elevated pressure resulting from vaporization of the aerosol precursor.

The chamber outlet may be defined as an opening at the aerosol generation chamber and directly opens to a junction of the passage, e.g., the passage is adjacent to the aerosol generation chamber. Alternatively, the chamber outlet may be spaced from the passage and is in fluid communication with a junction of the passage through an aerosol channel. The aerosol channel may be configured such that pressure drop in the aerosol across the aerosol channel is negligible.

A constriction may be positioned at or adjacent to the junction. That is, the cross sectional area or hydraulic diameter of the passage at said junction may be smaller than the portion of passage immediately upstream of the junction. Such arrangement may cause the first air flow to accelerate through the constriction. According to Bernoulli's principle, as the first air flow increases in speed through the constriction, the pressure therein may reduce accordingly. This may result in a reduced pressure at the junction and therefore as it passes through the junction, the first air flow may draw the vapor and/or aerosol out of the aerosol generation chamber. Advantageously, this may induce a localized pressure drop at the junction and thereby it may allow the aerosol to be extracted from the aerosol generation chamber more effectively.

Optionally, the constriction is positioned upstream of the junction. Optionally, the constriction is positioned immediately upstream of the junction. Optionally, the constriction is spaced from the junction. The constriction may be positioned at a location upstream of the junction and configured to induce a lowered pressure at the junction for drawing out the aerosol from the aerosol generation chamber.

Optionally, the constriction comprises one or more of a venturi tube, an orifice plate and a narrowed section along the passage. For example, in the case of a venturi tube, the constriction may comprise, in the direction of air flow, a flow converging portion followed by a narrowed passage, wherein the hydraulic diameter of the narrowed passage is smaller than the flow converging portion. More specifically, the chamber outlet is configured to be in fluid communication with the narrowed passage where a localized pressure drop is created by the first air flow. Advantageously, such arrangement allows the aerosol in the aerosol generation chamber to be drawn into the narrowed passage more effectively by the localized lowered pressure.

Optionally, the passage comprises an expanded portion immediately upstream of the constriction in the passage. More specifically, the expanded portion may have a larger hydraulic diameter than the constriction. Furthermore, the expanded portion may have a larger hydraulic diameter than the passage immediate upstream thereto. Advantageously, such expanded portion may allow the first air flow to slow down before it accelerates through the constriction. As a result, it may allow a larger pressure drop across the constriction, and therefore it may lead to a more effective extraction of aerosol from the aerosol generation chamber.

Optionally, a portion of the flow passage extends alongside the aerosol generation chamber. Optionally, the aerosol generation chamber is at least partially surrounded by the passage. Optionally, the aerosol generation chamber is fully surrounded by the passage. For example, the passage may take the form of an annulus surrounding the aerosol generation chamber. Advantageously, the passage may form an effective insulation for reducing heat transfer to the external surface of the housing.

Optionally, the junction is configured to be in fluid communication with the chamber outlet through a junction inlet, and wherein said junction inlet opens towards a direction orthogonal to the first air flow at the junction. That is, the aerosol may be drawn into the junction from the side of the passage. Advantageously, this may allow the aerosol to mix with the first air flow in a more effective manner, and thereby allowing aerosol to form more uniformly.

Alternatively, the chamber outlet opens in a direction substantially parallel to the first air flow at the junction. For example, the chamber outlet may open directly to the passage. Such arrangement may allow the aerosol and the first air flow to flow concurrently, and therefore advantageously, such arrangement may reduce the turbulence when the two are mixed at the junction.

Optionally, the chamber outlet may be closed by a one way valve, such as a check valve or a duck bill value, which may advantageously prevent the first air flow from entering the aerosol generation chamber.

As the aerosol precursor is being vaporized in the aerosol generation chamber, the vaporized aerosol precursor, or the vapor, may expand in the aerosol generation chamber and thereby it may increase the internal pressure at the aerosol generation chamber. Such elevated internal pressure may advantageously help forcing the aerosol through the chamber opening into the passage, even when the user is not puffing on the mouthpiece. For example, the aerosol generation chamber may have a specified volume of air at atmospheric pressure prior to the vaporization of aerosol precursor. As the user puffs on the mouthpiece, the pressure inside the passage decreases which may cause an activation of the heater and thus the vaporization process. At the same time, the localized low pressure region downstream of the aerosol generation chamber may draw out the higher-pressure air out of the aerosol generation chamber to equalize the pressure therein. This results in an equalized pressure across the aerosol generation chamber and the outlet.

During vaporization, aerosol precursor may be vaporized at the heater and expand into the cavity of the aerosol generation chamber. The vaporized aerosol precursor may immediately begin to cool and some of the condensed vapor may form aerosol droplets suspended in the air. Due to vaporization two mechanisms of pressure increase may occur in the aerosol generation chamber:

The vapor has a defined volume. Adding this volume of gaseous vapor to the defined volume of air inside the aerosol generation chamber may increase the pressure therein.

The aerosol droplets has a specified volume. These liquid droplets may displace the same volume of air.

Both effects may increase the pressure with respect to the lower pressure in the first air flow. This may aid the expulsion of vapor and aerosol from the aerosol generation chamber during vaporization.

By reducing or limiting the volume of the aerosol generation chamber, the expulsion of the aerosol from the chamber may be made more efficient. That is, a smaller aerosol generation chamber volume may result in greater pressure rise in the aerosol generation chamber for a given vapor generation rate. More specifically, increasing the internal volume of the aerosol generation chamber may reduce the amount of vapor and/or aerosol that is able to be ejected from the aerosol generation chamber during a puff, with the aerosol generated with an increase average droplet size. On the other hand, reducing the internal volume of the aerosol generation chamber increases the amount of vapor and/or aerosol during a puff with a reduction in the average aerosol droplet size. Optionally, the aerosol generation chamber is configured to have an internal volume ranging between 68 $mm^3$ to 680 $mm^3$. Optionally, the length of the aerosol generation chamber ranges between 2 mm to 20 mm. Such arrangements may advantageously allow the aerosol to be expulsed from the aerosol generation chamber at a rate greater than 0.1 mg/second during a puff.

The aerosol generation chamber may open towards the second end of the housing, or the mouthpiece. More specifically, an open end of the aerosol generation chamber may direct towards an upward direction during use. Advantageously, this may help containing any excess aerosol precursor and coalesced aerosol droplets formed in the aerosol generation chamber.

Optionally, the smoking substitute apparatus further comprises a tank for storing a reservoir of liquid aerosol precursor, the tank is spaced from the aerosol generation chamber. In the case where the aerosol generator is a heater, the tank is arranged to be in fluid communication with a wick of the heater through a liquid conduit. The tank may be provided at a location between the aerosol generation chamber and the mouthpiece, and therefore the wick may not extend directly from the aerosol generation chamber into the tank. Advantageously, this may allow the tank to be positioned flexibly at various positions within the housing, and thereby such arrangement may free up the space required for the constriction.

The liquid conduit may be sized to control the feed rate of the aerosol precursor from the tank to the wick. Optionally, the liquid conduit has a hydraulic diameter ranging from 0.01 mm to 10 mm for controlling the flow rate of the aerosol precursor from the tank towards the wick. Optionally, the liquid conduit has a hydraulic diameter ranging from 0.01 mm to 5 mm. Optionally, the liquid conduit has a hydraulic diameter of at least 0.1 mm. Optionally, the liquid conduit has a hydraulic diameter of up to 1 mm. Advantageously, such arrangement may limit the flow of aerosol precursor towards the wick under gravity, and thereby it may reduce the leakage of excess aerosol precursor into the aerosol generation chamber.

Furthermore, the inclusion of a liquid conduit may solve the problem of insufficient supply of aerosol precursor at the wick. For example, by having a reduced amount of air flow in the aerosol generation chamber, the associated driving force, e.g., the pressure drop in the aerosol generation chamber, for drawing out aerosol precursor from the tank may reduce accordingly. By relocating the tank to a position between the aerosol generation chamber and the outlet, e.g., the tank is located above the aerosol generation chamber in an upright orientation during use, the aerosol precursor may flow from the tank towards the wick under additional hydraulic head and thereby mitigates such problem. Advantageously, by providing a liquid conduit that is configured to allow sufficient flow of aerosol precursor, the wick may be prevented from drying out during vaporization.

In addition, different consumable having liquid conduits with different hydraulic diameters may be used to accommodate different types of users. For example, consumables having liquid conduits with broader hydraulic diameter may be catered for heavy users taking longer puffs, where an increased flow of aerosol precursor may reduce the likelihood of drying out at the wick. Consumables having liquid conduits with narrower hydraulic diameter may be catered for light users who take shorter puffs, where a reduced flow of aerosol precursor may reduce the amount of excess aerosol precursor at the wick.

Optionally, the aerosol generator is located at a position immediately upstream of the chamber outlet. More specifically, the aerosol generator may be positioned in the aerosol generation chamber by the chamber outlet. Advantageously, this may shorten the path of travel for the aerosol and thereby allow the aerosol to be drawn into the passage more effectively.

Alternatively, the aerosol generator is spaced from the chamber outlet. Advantageously, such arrangement may reduce the likelihood of first the air flow entering into the aerosol generation chamber through the chamber outlet, and thereby limiting the turbulence in the vicinity of the aerosol generator. Further, this may increase the residence time of the vapor in the aerosol generation chamber and thus it may allow some aerosol droplets to form and even coalesce before being entrained in the first air flow. Optionally, the aerosol generator is separated from the chamber outlet at a distance of at least 10 mm. optionally, the aerosol generator is separated from the chamber outlet at a distance ranged from 10 mm to 50 mm.

Optionally, the aerosol generation chamber is configured to have a uniform cross sectional profile along its length. Optionally, the chamber outlet is configured to have the same cross sectional profile as the aerosol generation chamber. For example, the aerosol flow path along the length of the aerosol generation chamber may have the same cross-sectional area. Advantageously, this may reduce turbulence, as well as fluctuation in pressure in the aerosol flow path and thereby such arrangement may lead to an increase in the size of aerosol droplets.

According to a second aspect of Development B there is provided a smoking substitute system for generating an aerosol, comprising:

the smoking substitute apparatus of the first aspect of Development B; and a main body configured to engage with the smoking substitute apparatus; wherein the main body comprises a controller and a power source configured to energize the heater.

According to third aspect of Development B there is provided a method of using the smoking substitute apparatus of the first aspect of Development B, comprising:

generating the aerosol with the aerosol generator; and drawing on the apparatus to cause air to enter the aerosol generation chamber in an amount that contributes not more than 35% of the air flow at the outlet.

Development C

For a smoking substitute system, it is desirable to deliver nicotine into the user's lungs, where it can be absorbed into the bloodstream. However, the present disclosure is based in part on a realization that some prior art smoking substitute systems, such delivery of nicotine is not efficient. In some prior art systems, the aerosol droplets have a size distribution that is not suitable for delivering nicotine to the lungs. Aerosol droplets of a large particle size tend to be deposited in the mouth and/or upper respiratory tract. Aerosol particles of a small (e.g., sub-micron) particle size can be inhaled into the lungs but may be exhaled without delivering nicotine to the lungs. As a result, the user would require drawing a longer puff, more puffs, or vaporizing e-liquid with a higher nicotine concentration in order to achieve the desired experience.

Furthermore, in such prior art smoking substitute systems the air inlet is often positioned at the base of the vaporizing chamber. In use, coalesced aerosol droplets that are too large to be suspended in the airflow, as well as excess aerosol precursor that is wicked from the sealed tank, may undesirably leak through the air inlet by gravity.

Accordingly, there is a need for improvement in the delivery of nicotine to a user, as well as reduction in liquid leakage, in the context of a smoking substitute system.

The present disclosure (Development C) has been devised in the light of the above considerations.

In a general aspect of Development C, the present disclosure relates to a smoking substitute apparatus having an aerosol generation chamber that is sealed against air flow except for having at least one chamber outlet that is configured to discharge aerosol therethrough.

According to a first preferred aspect of Development C there is provided a smoking substitute apparatus for generating an aerosol, comprising:

a housing;

an air inlet and an outlet formed at the housing;

a passage extending between the air inlet and the outlet, air flowing in use along the passage for inhalation by a user drawing air through the apparatus;

an aerosol generation chamber containing an aerosol generator being operable to generate an aerosol from an aerosol precursor, the aerosol generation chamber being sealed against air flow except for having at least one chamber outlet in communication with the passage, the at least one chamber outlet permitting, in use, aerosol generated by the aerosol generator to be entrained into an air flow along the passage.

In contrast to prior art smoking substitute systems, which generate an aerosol by directly passing an air flow over the heater, the aerosol generation chamber containing the aerosol generator according to the present disclosure is sealed against air flow, except for having at least one chamber outlet in communication with the passage. The at least one chamber outlet is configured to allow aerosol generated in the aerosol generation chamber to entrain into the air flow along the passage. For example, the at least one chamber outlet may be positioned downstream, in the direction of aerosol flow, to the aerosol generator so as to allow the aerosol to be discharged from the chamber towards the outlet of the housing. More specifically, the at least one chamber outlet may form the only aperture, or apertures in the case where there is a plurality of chamber outlets, of the aerosol generation chamber that provides a gas flow passage for a gas, e.g., an aerosol, through the sealed aerosol generation chamber. Therefore, such an arrangement may differ to the prior art smoking substitute systems in that it may avoid the requirement for an air flow to pass through the aerosol generator chamber in order to provide a suitable aerosol to the user for inhalation.

The aerosol generator may therefore be located in a stagnant cavity of the aerosol generation chamber, wherein said stagnant cavity may be substantially free of air flow. For example, because the air flow does not pass through the interior of the aerosol generation chamber, said interior may form the stagnant cavity during a user puff. "Stagnant" may not necessarily mean a complete lack of convection, e.g., a degree of convection may result from vapor and/or aerosol generated during its generation. Advantageously such arrangement may substantially reduce the amount of air flow induced turbulence in the vicinity of the aerosol generator. The inventors consider that this reduced turbulence can result in the formation of an aerosol with enlarged droplet sizes.

Optionally, the aerosol precursor comprises a liquid aerosol precursor. The aerosol generator may comprise a heater configured to generate the aerosol by vaporizing the liquid aerosol precursor. The liquid aerosol precursor may be an e-liquid and may comprise nicotine and a base liquid such as propylene glycol and/or vegetable glycerin and may include a flavorant. The aerosol generator may be a heater such as a heater coil wound around a wick.

In use, the aerosol generator may vaporize the aerosol precursor to form a vapor. A portion of the vapor may cool and condense to from an aerosol in the aerosol generation chamber and subsequently be discharged or entrained towards the outlet of the housing through the chamber outlet. The remaining portion of vapor may emerge through the chamber outlet to form further aerosol downstream of the chamber outlet, e.g., through the passage.

In contrast to a prior art smoking substitute apparatus, where the typical volumetric flowrates of the air flow inside the aerosol generation chamber are in excess of 1 liter per minute, a much reduced flowrate may be achieved in the aerosol generation chamber according to the present disclosure. With the reduction or elimination of the air flow through the aerosol generation chamber, the volumetric flowrate of aerosol in the aerosol generation chamber may be arranged to be less than 0.1 liter per minute. The flowrate of aerosol is to be considered in terms of the volume of the aerosol droplets combined with the volume of air entraining the aerosol droplets. Advantageously, such reduction in flowrate may substantially limit the amount of turbulence in the vicinity of the aerosol generator, and thereby increasing the median aerosol droplet size, d50, in the aerosol at the outlet.

The aerosol generation chamber may be an open ended container or a cup. The one or more chamber outlets may open towards the second end of the housing, e.g., the outlet adjacent to or in communication with a mouthpiece. When the apparatus is held upright in use, the chamber outlet may open in an upward direction. Advantageously, this may help to contain any excess aerosol precursor and/or coalesced aerosol droplets in the aerosol generation chamber, and thereby help to reduce or prevent liquid leakage out of the chamber. Alternatively, or in addition, the chamber outlet may open on a sidewall of the aerosol generation chamber, e.g., the vapor generated in the aerosol generation chamber may be discharged into a passage that leads to the outlet.

With a lack of gas flow apertures opened upstream of the aerosol generator, the base of the aerosol generation chamber may be sealed. The base may be sealed to prevent fluid leakage through a first end of the housing. More specifically, the base of the aerosol generation chamber may be completely closed or it may comprise sealed apertures for allowing electrical contacts to extend therethrough. Advantageously, such arrangement may prevent excess aerosol precursor and coalesced aerosol droplets in the aerosol generation chamber from leaking through the base of the housing.

Optionally, the passage is configured to allow an air flow entering the housing through the air inlet to bypass the aerosol generation chamber. The air flow may serve as a stream of dilution air and as such the aerosol being inhaled by the user may be of a reduced concentration in comparison to that in the aerosol generation chamber. Furthermore, the air flow may aid the aerosol to entrain through the chamber outlet and into the passage. Therefore, such arrangement may differ to prior art smoking substitute systems in that the air flow does not pass through the aerosol generation chamber. Instead, the passage may be configured to allow the entire amount of air flow entering the housing to bypass the aerosol generation chamber.

The aerosol generation chamber may be configured to discharge vapor and/or aerosol through the chamber outlet based on the pressure difference across said chamber outlet, e.g., the pressure difference between the aerosol generation chamber and the passage. For example, the aerosol and/or vapor may be drawn into the passage due to a reduced pressure downstream, and/or it may be expelled from the aerosol generation chamber due to an elevated pressure resulting from vaporization of the aerosol precursor.

The aerosol generation chamber may be configured to discharge aerosol through the chamber outlet, at least partially, by an increased internal pressure during the generation of aerosol. During vaporization aerosol precursor may be vaporized at the aerosol generator and expand into the surrounding stagnant air. The vaporized aerosol precursor may immediately begin to cool and some of the condensed vapor may form aerosol droplets suspended in the air. Due to vaporization two mechanisms of pressure increase may occur in the aerosol generation chamber.

The vapor takes up a defined volume, dependent on temperature. Adding this volume of gaseous vapor to a volume of air already inside the aerosol generation chamber may increase the pressure therein.

The aerosol droplets has a specified volume. These liquid droplets may displace the same volume of air. Note that the liquid vaporized from the aerosol generator is typically replenished in the aerosol generator (e.g., by wicking from a reservoir in the case of a heated wick).

Both effects may increase the internal pressure of the aerosol generation chamber with respect to the pressure downstream of the chamber outlet. This may aid the expulsion of vapor and/or aerosol from the aerosol generation chamber during vaporization, and even when the user is not puffing on the mouthpiece.

By reducing or limiting the volume of the aerosol generation chamber, the expulsion of the vapor and/or aerosol from the chamber may be made more efficient. For example, a smaller aerosol generation chamber volume may result in greater pressure rise in the aerosol generation chamber for a given vapor generation rate. That is, for a given amount of vapor and/or aerosol generated during a puff, a smaller aerosol generation chamber may increase its internal pressure more profoundly and thereby increases the rate of vapor and/or aerosol discharge through the chamber outlet. In other words, increasing the internal volume of the aerosol generation chamber may reduce the amount of vapor and/or aerosol that is able to be ejected from the aerosol generation chamber during a puff, with the aerosol generated with an increase average droplet size. On the other hand, reducing the internal volume of the aerosol generation chamber increases the amount of vapor and/or aerosol during a puff with a reduction in the average aerosol droplet size. Optionally, the aerosol generation chamber is configured to have an internal volume ranging between 68 $mm^3$ to 680 $mm^3$. Optionally, the length of the aerosol generation chamber ranges between 2 mm to 20 mm. Such arrangements may advantageously allow the vapor to be expulsed from the aerosol generation chamber at a rate greater than 0.1 mg/second during a puff.

Furthermore, a reduced pressure downstream of the chamber outlet may aid the withdrawal of vapor and/or aerosol from the aerosol generation chamber. For example, in the case where a passage is present, as the user puffs on the mouthpiece, the pressure inside the passage decreases and may subsequently activate a pressure sensor to begin the vaporization process. A localized low pressure region downstream of the aerosol generation chamber may draw out the higher-pressure aerosol and/or vapor out of the aerosol generation chamber to equalize the pressure therein. This results in an equalized pressure across the aerosol generation chamber and the outlet.

In some embodiments, the at least one chamber outlet may be defined as an opening at the aerosol generation chamber which is directly open to the passage, e.g., the passage is adjacent to the aerosol generation chamber. Alternatively, the at least one chamber outlet may be spaced from the passage and in fluid communication with the passage through an aerosol channel. The aerosol channel may be configured such that a pressure drop in the aerosol across the aerosol channel is negligible.

Optionally, the at least one chamber outlet may be closed by a one way valve that allows one way flow passage for aerosol discharge. For example, the one way valve may advantageously prevent ambient air, or the air flow in the passage, to enter or backflow into the aerosol generation chamber. The one way valve may be any suitable valve that permits a one way gas flow passage, for example a check valve or a duck bill value.

Optionally, the passage, or a portion of the passage, coaxially extends alongside the aerosol generation chamber. Optionally, the aerosol generation chamber is at least partially surrounded by the passage. Optionally, the aerosol generation chamber is fully surrounded by the passage. Optionally, the passage extends along the external sidewalls of the aerosol generation chamber such that an air flow may flow externally and parallel to the aerosol generation chamber. For example, the passage may take the form of an annulus surrounding the aerosol generation chamber. Advantageously, the passage may form an effective insulation for reducing heat transfer to the external surface of the housing.

Alternatively, the passage comprises one or more passages each coaxially extending alongside the aerosol generation chamber.

Optionally, the air inlet is formed at a sidewall of the housing. Alternatively, or in addition, the air inlet is opened at the first end of the housing and/or radially adjacent to the base of the aerosol generation chamber.

Optionally, the smoking substitute apparatus further comprises a tank for storing a reservoir of liquid aerosol precursor. The tank may be spaced from the aerosol generation chamber. The tank may be arranged to be in fluid communication with the wick through a liquid conduit. The tank may be provided at a location between the aerosol generation chamber and the outlet, and therefore the wick may not extend directly from the aerosol generation chamber into the tank. Advantageously, this may allow the tank to be positioned flexibly at various positions within the housing.

The liquid conduit may be sized to control the feed rate of the aerosol precursor from the tank to the wick. Optionally, the liquid conduit has a hydraulic diameter ranging from 0.01 mm to 10 mm for controlling the flow rate of the aerosol precursor from the tank towards the wick. Optionally, the liquid conduit has a hydraulic diameter ranging from 0.01 mm to 5 mm. Optionally, the liquid conduit has a hydraulic diameter ranging from 0.1 mm to 1 mm. Advantageously, such arrangements may limit the flow of aerosol precursor towards the wick under gravity, and thereby may reduce the leakage of excess aerosol precursor into the aerosol generation chamber.

Furthermore, the inclusion of a liquid conduit may solve the problem of insufficient supply of aerosol precursor at the wick. For example, by adapting a stagnant aerosol generation chamber there is a substantial lack of air flow in the aerosol generation chamber, therefore the associated driving force, e.g., the pressure drop in the aerosol generation chamber, for drawing out aerosol precursor from the tank may reduce accordingly. By relocating the tank to a position between the aerosol generation chamber and the outlet, e.g., by locating the tank above the aerosol generation chamber when the apparatus is in an upright orientation during use, the aerosol precursor may flow from the tank towards the wick under additional hydraulic head and thereby mitigate such problem. Advantageously, by providing a liquid conduit that is configured to allow sufficient flow of aerosol precursor, the wick may be prevented from drying out during vaporization.

In addition, different consumables having liquid conduits with different hydraulic diameters may be used to accommodate different types of users. For example, consumables having liquid conduits with larger hydraulic diameter may cater for heavy users who take longer puffs, because an increased flow rate of aerosol precursor may reduce the likelihood of drying out at the wick. Consumables having liquid conduits with narrower hydraulic diameter may cater for light users who take shorter puffs, because a reduced flow rate of aerosol precursor may reduce the amount of excess aerosol precursor at the wick.

Optionally, the aerosol generator is located at a position immediately upstream of the at least one chamber outlet. More specifically, the aerosol generator may be positioned in the aerosol generation chamber adjacent to the one or more chamber outlets. Advantageously, this may shorten the path of travel for the aerosol and thereby allows the aerosol to be discharged into the passage more effectively.

Alternatively, the aerosol generator may be spaced from the chamber outlet. For example, the aerosol generation may be positioned well into the stagnant cavity of the aerosol generating chamber. Optionally, the aerosol generator is adjacent to the base of the aerosol generation chamber. Advantageously, such arrangement may reduce the likelihood of air flow entering through the chamber outlet towards the vicinity of the aerosol generator. Further, this may increase the residence time of the vapor in the aerosol generation chamber and thus it may allow some aerosol droplets to form and even coalesce before being entrained in the air flow. Optionally, the aerosol generator is separated from the chamber outlet by a distance of at least 10 mm. Optionally, the aerosol generator is separated from the chamber outlet by a distance ranged from 10 mm to 50 mm.

Optionally, the aerosol generation chamber is configured to have a uniform cross sectional profile along its length. For example, the aerosol flow path along the length of the aerosol generation chamber may have the same cross-sectional area. Advantageously, this may reduce turbulence, as well as fluctuation in pressure in the aerosol flow path and thereby such arrangement may lead to an increase in the size of aerosol droplets.

Optionally, the smoking substitute apparatus is configured to generate an aerosol having a droplet size, $d_{50}$, of at least 1 μm. Optionally, the smoking substitute apparatus is configured to generate an aerosol having a droplet size, $d_{50}$, ranged between 1 μm to 4 μm. Optionally, the smoking substitute apparatus is configured to generate an aerosol having a droplet size, $d_{50}$, ranged between 2 μm to 3 μm. Advantageously, aerosol having droplets in such size ranges may improve delivery of nicotine into the user's lung, by reducing the likelihood of nicotine deposition in the mouth and/or upper respiratory tract, e.g., in the case of oversized aerosol droplets, or not being absorbed at all, e.g., in the case of undersized aerosol droplets.

According to a second aspect of Development C there is provided a smoking substitute system for generating an aerosol, comprising:

i) the smoking substitute apparatus of the first aspect of Development C; and ii) a main body configured to engage with the smoking substitute apparatus; wherein the main body comprises a controller and a power source configured to energize the aerosol generator.

According to a third aspect of Development C there is provided a method of using the smoking substitute apparatus of the first aspect of Development C, comprising:

i) generating the aerosol with the aerosol generator;

ii) drawing on the apparatus to entrain the generated aerosol, through the at least one chamber outlet, into the air flow along the passage.

Development D

For a smoking substitute system, it is desirable to deliver nicotine into the user's lungs, where it can be absorbed into the bloodstream. However, the present disclosure is based in part on a realization that some prior art smoking substitute systems, such delivery of nicotine is not efficient. In some prior art systems, the aerosol droplets have a size distribution that is not suitable for delivering nicotine to the lungs. Aerosol droplets of a large particle size tend to be deposited in the mouth and/or upper respiratory tract. Aerosol particles of a small (e.g., sub-micron) particle size can be inhaled into the lungs but may be exhaled without delivering nicotine to the lungs. As a result, the user would require drawing a longer puff, more puffs, or vaporizing e-liquid with a higher nicotine concentration in order to achieve the desired experience.

Furthermore, in such prior art smoking substitute systems the air inlet is often positioned at the base of the vaporizing chamber. In use, coalesced aerosol droplets that are too large to be suspended in the airflow, as well as excess aerosol precursor that is wicked from the sealed tank, may undesirably leak through the air inlet by gravity.

Accordingly, there is a need for improvement in the delivery of nicotine to a user, as well as reduction in liquid leakage, in the context of a smoking substitute system.

The present disclosure (Development D) has been devised in the light of the above considerations.

In a general aspect of Development D, the present disclosure relates to a smoking substitute apparatus having a passage for allowing all of the air flowing through an air inlet to bypass an aerosol generation chamber, whereby an aerosol generated in the aerosol generation chamber is arranged to be entrained into an air flow along the passage through a chamber outlet.

According to a first preferred aspect of Development D there is provided a smoking substitute apparatus for generating an aerosol, comprising:

a housing;

an air inlet and an outlet formed at the housing;

a passage extending between the air inlet and the outlet, air flowing in use through the air inlet and along the passage for inhalation by a user drawing on the apparatus; and an aerosol generation chamber containing an aerosol generator being operable to generate an aerosol from an aerosol precursor, the aerosol generation chamber comprising at least one chamber outlet in fluid communication with the passage, the at least one chamber outlet permitting, in use, aerosol generated by the aerosol generator to be entrained into an air flow along the passage;

wherein the passage extends alongside the aerosol generation chamber and is configured to allow all of the air flowing through the air inlet to bypass said aerosol generation chamber.

In contrast to prior art smoking substitute systems, which generate an aerosol by directly passing an air flow over the heater, the passage according to the present disclosure may be routed to allow all of the air flow entering the housing through the air inlet to bypass the aerosol generation chamber, and thus bypassing the aerosol generator in said chamber. The passage may extend externally to the aerosol generation chamber and be in fluid communication with the chamber outlet. In other words, the air flow may not directly pass over the aerosol generator but may only come into contact with the aerosol once the aerosol has been discharged from the aerosol generation chamber and is entrained into the passage.

The aerosol precursor may comprise a liquid aerosol precursor. The aerosol generator may comprise a heater configured to generate the aerosol by vaporizing the liquid aerosol precursor. The liquid aerosol precursor may be an e-liquid. The e-liquid may comprise nicotine and a base liquid such as propylene glycol and/or vegetable glycerin and may include a flavorant. The aerosol generator may be a heater such as a heater coil wound around a wick.

In use, the aerosol generator may vaporize the aerosol precursor to form a vapor. A portion of the vapor may cool and condense to form an aerosol in the aerosol generation chamber and subsequently be discharged to the passage through the chamber outlet. The remaining portion of vapor may emerge through the chamber outlet into the passage, and may form further aerosol upon contacting the air flow in the passage. The aerosol generation chamber may be arranged to reduce ingress of air flow from the passage, and thereby to reduce the turbulence in the aerosol generation chamber. Advantageously, because the air flow does not pass over the aerosol generator, such arrangement may reduce the amount of turbulence in the vicinity of the aerosol generation. Accordingly, an aerosol with enlarged droplet sizes may be formed.

The passage extends alongside the aerosol generation chamber. Optionally, at least a portion of the passage and aerosol generation chamber may share a sidewall of the aerosol generation chamber. As a result, the air flow in the passage may flow externally and parallel to the aerosol generation chamber.

Optionally, the aerosol generation chamber is sealed against air flow except for the at least one chamber outlet. More specifically, the at least one chamber outlet may form the only aperture, or apertures in the case where there is a plurality of chamber outlets, of the aerosol generation chamber that provides a gas flow passage for a gas, e.g., including an aerosol, through the sealed aerosol generation chamber. In other words, in such an arrangement, the aerosol generator is located in a stagnant cavity of the aerosol generation chamber, wherein said stagnant cavity is substantially free of the air flow entering the housing through the air inlet. For example, because the air flow does not pass through the internal volume of the aerosol generation chamber, said internal volume may form the stagnant cavity during a user puff. "Stagnant" may not necessarily mean a complete lack of convection, e.g., a degree of convection may result from vapor and/or aerosol generated during aerosol formation.

Optionally, the air inlet is opened at a first end of the housing and the outlet is opened at a second end of the housing opposite the first end. Optionally, the aerosol generation chamber is located towards the first end of the housing. The first end of the housing may form a base of the smoking substitute apparatus, or consumable, engagable with a main body of a smoking substitute system. The second end of the housing may comprise a mouthpiece which the user may puff on in order to draw an air flow through the passage. Therefore, the passage may extend axially along the longitudinal axis of the housing, from its base towards the mouthpiece. Advantageously, this may reduce the degree of flow turning as the air flow passes along the passage. Optionally, the air inlet is adjacent to the aerosol generation chamber at the first end of the housing.

Alternatively, or in addition, the air inlet may open on a sidewall of the housing. For example, in some embodiments, an additional air inlet may open on the sidewall of the housing and fluidly communicable with the passage. In other embodiments, the air inlet may be positioned between the chamber outlet and the outlet along the longitudinal axis of the housing. Therefore, a portion of the passage may be separated from the aerosol generation chamber. Advantageously, such arrangement may provide the shorter flow path for the air flow and thereby reduces draw resistance, as well as freeing up additional space at the peripheral of the aerosol generation chamber.

Optionally, the aerosol generation chamber is configured to allow the aerosol to entrain into the air flow in the passage based on the pressure difference between the aerosol generation chamber and the passage. For example, during the formation of aerosol, a vapor may form and expand in the aerosol generation chamber and thereby increases its internal pressure. Such elevated internal pressure may advantageously force the aerosol through the chamber opening into the passage. Furthermore, suction created by the user during a puff may induce a reduced pressure in the passage, which advantageously draws the aerosol through the chamber outlet into the passage. The aerosol generation chamber may resemble an open ended container or a cup. Optionally, the chamber outlet opens towards the second end of the housing, or the mouthpiece. More specifically, when the apparatus is held upright in use, the chamber outlet may be directed towards an upward direction during use. Advantageously, this may help to contain any excess aerosol precursor and/or coalesced aerosol droplets in the aerosol generation chamber, any thereby preventing leakage out of the chamber outlet. Alternatively, or in addition, the chamber outlet may form at a sidewall of the aerosol generation chamber, e.g., the aerosol generated in the aerosol generation chamber may be entrained into the passage from a direction orthogonal to the air flow.

Optionally, the aerosol generation chamber comprises a base, wherein the base is sealed to prevent fluid leakage through the first end of the housing. More specifically, the base of the aerosol generation chamber may be completely closed or it may comprise sealed apertures for allowing electrical contact to extending therethrough. Advantageously, such arrangement may prevent excess aerosol precursor and coalesced aerosol droplets in the aerosol generation chamber to leak through the base of the apparatus.

Optionally, the chamber outlet is positioned adjacent to the passage and opens in the direction of air flow. Advantageously, by reducing the distance of travel such arrangement may allow the aerosol to be entrained into the air flow more effectively. Further, by aligning the chamber outlet in the direction of air flow, it may reduce the likelihood of air flow ingress into the chamber. Optionally, the chamber outlet may be closed by a one way valve, such as a check valve or a duck bill value, which may advantageously prevent the air flow from entering the aerosol generation chamber.

Optionally, the aerosol generator is located adjacent to the chamber outlet. For example, the aerosol generator is located at a position immediately upstream of the chamber outlet in the path of vapor and/or aerosol. Advantageously, this may shorten the path of travel for the aerosol and thereby allow the aerosol to be entrained into the passage more effectively.

Alternatively, the aerosol generator may be spaced from the chamber outlet. For example, the aerosol generator may be positioned well into a cavity of the aerosol generation chamber. Advantageously, such arrangement may reduce the likelihood of air flow entering into the aerosol generation chamber, and thereby limiting the turbulence in the vicinity of the aerosol generator. Further, this may increase the residence time of the vapor in the aerosol generation chamber and thus it may allow some aerosol droplets to form and even coalesce before being entrained in the air flow. Optionally, the aerosol generator is separated from the chamber outlet by a distance of at least 10 mm. Optionally, the aerosol generator is separated from the chamber outlet by a distance ranged from 10 mm to 50 mm.

Optionally, the passage comprises a flow converging portion downstream to the aerosol generation chamber, the flow converging portion is configured to converge the aerosol with the air flow in the passage. Optionally, the flow converging portion comprises a funnel or a tapered section for gradually merging the aerosol with the air flow. Advantageously, this may reduce the turbulence that may prohibit the formation of larger aerosol droplets. Alternatively, the flow converging portion comprises a length of passage having a constant cross sectional profile along its length. Advantageously, this reduces the change in flow direction of the aerosol and the air flow as they flow towards the outlet. Optionally, the flow converging portion having a length of at least 10 mm. Optionally, the flow converging portion having a length between 10 mm and 50 mm.

Optionally, the aerosol generation chamber is configured to have a uniform cross sectional profile along its length. Optionally, the chamber outlet is configured to have the same cross sectional profile as the aerosol generation chamber. For example, the aerosol flow path along the length of the aerosol generation chamber may have substantially same cross-sectional area. Advantageously, this may reduce turbulence, as well as fluctuation in pressure in the aerosol flow path and thereby such arrangement may lead to an increase in the size of aerosol droplets.

Optionally, the aerosol generation chamber is at least partially surrounded by the passage. Optionally, the passage coaxially extends alongside the aerosol generation chamber. For example, the passage may form an annulus around the aerosol generation chamber. More specifically, the aerosol generation chamber may be fully surrounded by the passage. Advantageously, the passage may form an effective insulation for reducing heat transfer to the external surface of the housing.

Alternatively, the passage comprises one or more passages each extending alongside the aerosol generation chamber. The passage may comprise a pair of passages extending along opposing sides of the aerosol generation chamber. For example, the sidewall of the aerosol generation chamber may be formed from partition walls separating the aerosol generation chamber from the flow path.

Optionally, the smoking substitute apparatus is configured to generate an aerosol having a median droplet size, $d_{50}$, of at least 1 μm. Optionally, the smoking substitute apparatus is configure to generate an aerosol having a median droplet size, $d_{50}$, ranged between 1 μm to 4 μm. Optionally, the smoking substitute apparatus is configure to generate an aerosol having a median droplet size, d50, ranged between 2 μm to 3 μm. Advantageously, aerosol having droplets in such size ranges may improve delivery of nicotine into the user's lung, by reducing the likelihood of nicotine deposition in the mouth and/or upper respiratory tract, e.g., in the case of oversized aerosol droplets, or not being absorbed at all, e.g., in the case of undersized aerosol droplets.

According to a second aspect of Development D there is provided a smoking substitute system for generating an aerosol, comprising:

the smoking substitute apparatus of the first aspect of Development D; and a main body configured to engage with the smoking substitute apparatus;

wherein the main body comprises a controller and a power source configured to energize the aerosol generator.

According to a third aspect of Development D there is provided a method of using the smoking substitute apparatus of the first aspect of Development D, comprising:

generating the aerosol with the aerosol generator;

drawing on the apparatus to entrain the generated aerosol, through the at least one chamber outlet, into the air flow along the passage.

The disclosure includes the combination of the developments, aspects and preferred features described except where such a combination is clearly impermissible or expressly avoided.

BRIEF DESCRIPTION OF THE DRAWINGS

So that the disclosure may be understood, and so that further developments, aspects and features thereof may be appreciated, embodiments illustrating the principles of the disclosure will now be discussed in further detail with reference to the accompanying figures, in which.

DETAILED DESCRIPTION

Further background to the present disclosure and further aspects and embodiments of the present disclosure will now be discussed with reference to the accompanying figures. Further aspects and embodiments will be apparent to those skilled in the art. The contents of all documents mentioned in this text are incorporated herein by reference in their entirety.

Figure 17:
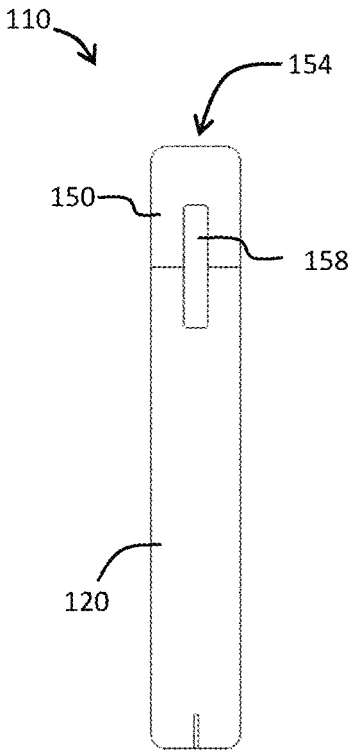
FIG. 17 is a schematic front view of a smoking substitute system, according to a first reference arrangement, in an engaged position.
Figure 18:
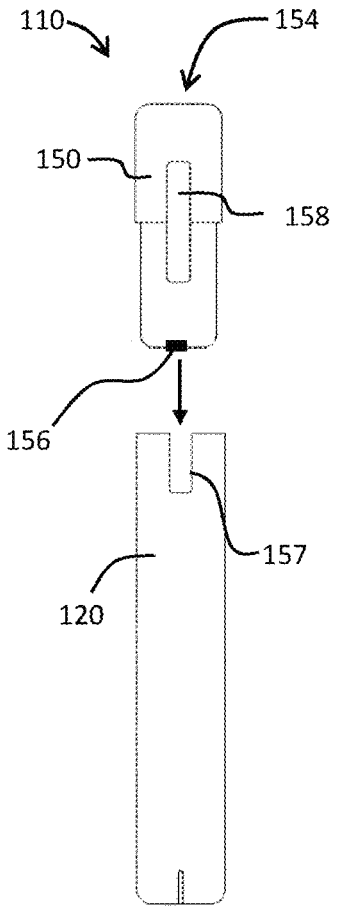
FIG. 18 is a schematic front view of the smoking substitute system of the first reference arrangement in a disengaged position.

FIGS. 17 and 18 illustrate a smoking substitute system in the form of an e-cigarette system 110. The system 110 comprises a main body 120 of the system 110, and a smoking substitute apparatus in the form of an e-cigarette consumable (or "pod") 150. In the illustrated embodiment the consumable 150 (sometimes referred to herein as a smoking substitute apparatus) is removable from the main body 120, so as to be a replaceable component of the system 110. The e-cigarette system 110 is a closed system in the sense that it is not intended that the consumable should be refillable with e-liquid by a user.

As is apparent from FIGS. 17 and 18, the consumable 150 is configured to engage the main body 120. FIG. 17 shows the main body 120 and the consumable 150 in an engaged state, whilst FIG. 18 shows the main body 120 and the consumable 150 in a disengaged state. When engaged, a portion of the consumable 150 is received in a cavity of corresponding shape in the main body 120 and is retained in the engaged position by way of a snap-engagement mechanism. In other embodiments, the main body 120 and consumable 150 may be engaged by screwing one into (or onto) the other, or through a bayonet fitting, or by way of an interference fit.

The system 110 is configured to vaporize an aerosol precursor, which in the illustrated embodiment is in the form of a nicotine-based e-liquid 160. The e-liquid 160 comprises nicotine and a base liquid including propylene glycol and/or vegetable glycerin. In the present embodiment, the e-liquid 160 is flavored by a flavorant. In other embodiments, the e-liquid 160 may be flavorless and thus may not include any added flavorant.

Figure 19:
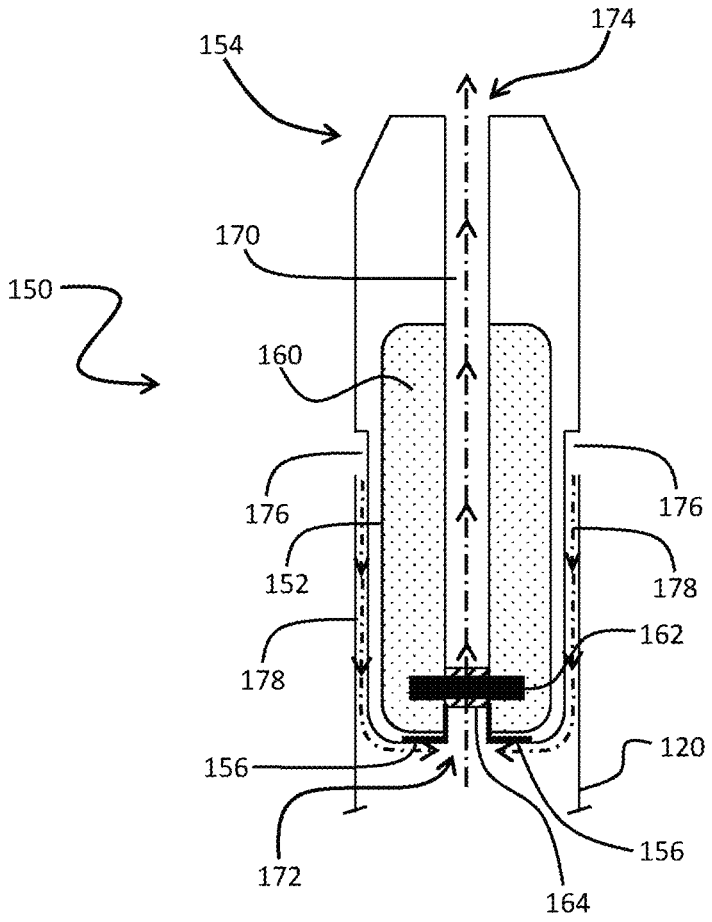
FIG. 19 is a schematic longitudinal cross sectional view of a smoking substitute apparatus of the first reference arrangement.

FIG. 19 shows a schematic longitudinal cross sectional view of a smoking substitute apparatus according to a reference arrangement that is configured to form part of the smoking substitute system shown in FIGS. 17 and 18. The smoking substitute apparatus, or consumable 150 as shown in FIG. 19 is provided as a reference arrangement to illustrate the features of a consumable 150 and its interaction with the main body 120. In FIG. 19, the e-liquid 160 is stored within a reservoir in the form of a tank 152 that forms part of the consumable 150. In the illustrated embodiment, the consumable 150 is a "single-use" consumable 150. That is, upon exhausting the e-liquid 160 in the tank 152, the intention is that the user disposes of the entire consumable 150. The term "single-use" does not necessarily mean the consumable is designed to be disposed of after a single smoking session. Rather, it defines the consumable 150 is not arranged to be refilled after the e-liquid contained in the tank 152 is depleted. The tank may include a vent (not shown) to allow ingress of air to replace e-liquid that has been used from the tank. The consumable 150 preferably includes a window 158 (see FIGS. 1 and 2), so that the amount of e-liquid in the tank 152 can be visually assessed. The main body 120 includes a slot 157 so that the window 158 of the consumable 150 can be seen whilst the rest of the tank 152 is obscured from view when the consumable 150 is received in the cavity of the main body 120. The consumable 150 may be referred to as a "clearomizer" when it includes a window 158, or a "cartomizer" when it does not.

In other embodiments, the e-liquid (i.e., aerosol precursor) may be the only part of the system that is truly "single-use". That is, the tank may be refillable with e-liquid or the e-liquid may be stored in a non-consumable component of the system. For example, in such other embodiments, the e-liquid may be stored in a tank located in the main body or stored in another component that is itself not single-use (e.g., a refillable cartomizer).

The external wall of tank 152 is provided by a casing of the consumable 150. The tank 152 annularly surrounds, and thus defines a portion of, a passage 170 that extends between a vaporizer inlet 172 and an outlet 174 at opposing ends of the consumable 150. In this respect, the passage 170 comprises an upstream end at the end of the consumable 150 that engages with the main body 120, and a downstream end at an opposing end of the consumable 150 that comprises a mouthpiece 154 of the system 110.

Figure 3:
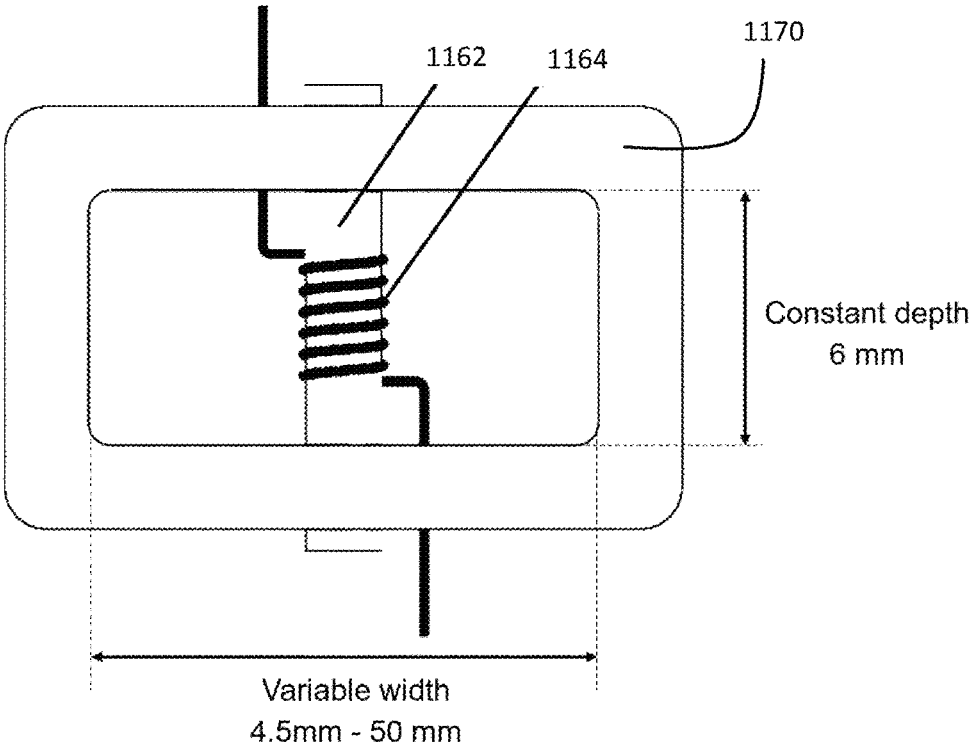
FIG. 3 shows a schematic transverse cross sectional view an example rectangular tube with a wick and heater coil installed. In this example, the internal width of the tube is 12 mm.

When the consumable 150 is received in the cavity of the main body 120 as shown in FIG. 3, a plurality of device air inlets 176 are formed at the boundary between the casing of the consumable and the casing of the main body. The device air inlets 176 are in fluid communication with the vaporizer inlet 172 through an inlet flow channel 178 formed in the cavity of the main body which is of corresponding shape to receive a part of the consumable 150. Air from outside of the system 110 can therefore be drawn into the passage 170 through the device air inlets 176 and the inlet flow channels 178.

When the consumable 150 is engaged with the main body 120, a user can inhale (i.e., take a puff) via the mouthpiece 154 so as to draw air through the passage 170, and so as to form an air flow (indicated by the dashed arrows in FIG. 19) in a direction from the vaporizer inlet 172 to the outlet 174. Although not illustrated, the passage 170 may be partially defined by a tube (e.g., a metal tube) extending through the consumable 150. In FIG. 19, for simplicity, the passage 170 is shown with a substantially circular cross-sectional profile with a constant diameter along its length. In other arrangements and in some embodiments, the passage may have other cross-sectional profiles, such as oval shaped or polygonal shaped profiles. Further, in other arrangements and some embodiments, the cross sectional profile and the diameter (or hydraulic diameter) of the passage may vary along its longitudinal axis.

The smoking substitute system 110 is configured to vaporize the e-liquid 160 for inhalation by a user. To provide this operability, the consumable 150 comprises an aerosol generator in the form of a heater having a porous wick 162 and a resistive heating element in the form of a heating filament 164 that is helically wound (in the form of a coil) around a portion of the porous wick 162. The porous wick 162 extends across the passage 170 (i.e., transverse to a longitudinal axis of the passage 170 and thus also transverse to the air flow along the passage 170 during use) and opposing ends of the wick 162 extend into the tank 152 (so as to be immersed in the e-liquid 160). In this way, e-liquid 160 contained in the tank 152 is conveyed from the opposing ends of the porous wick 162 to a central portion of the porous wick 162 so as to be exposed to the air flow in the passage 170.

The helical filament 164 is wound about the exposed central portion of the porous wick 162 and is electrically connected to an electrical interface in the form of electrical contacts 156 mounted at the end of the consumable that is proximate the main body 120 (when the consumable and the main body are engaged). When the consumable 150 is engaged with the main body 120, electrical contacts 156 make contact with corresponding electrical contacts (not shown) of the main body 120. The main body electrical contacts are electrically connectable to a power source (not shown) of the main body 120, such that (in the engaged position) the filament 164 is electrically connectable to the power source. In this way, power can be supplied by the main body 120 to the filament 164 in order to heat the filament 164. This heats the porous wick 162 which causes e-liquid 160 conveyed by the porous wick 162 to vaporize and thus to be released from the porous wick 162. The vaporized e-liquid becomes entrained in the air flow and, as it cools in the air flow (between the heated wick and the outlet 174 of the passage 170), condenses to form an aerosol. This aerosol is then inhaled, via the mouthpiece 154, by a user of the system 110. As e-liquid is lost from the heated portion of the wick, further e-liquid is drawn along the wick from the tank to replace the e-liquid lost from the heated portion of the wick.

The filament 164 and the exposed central portion of the porous wick 162 are positioned across the passage 170. More specifically, the part of passage that contains the filament 164 and the exposed portion of the porous wick 162 forms an aerosol generation chamber. In the illustrated example, the aerosol generation chamber has the same cross-sectional diameter as the passage 170. However, in other embodiments the aerosol generation chamber may have a different cross sectional profile as the passage 170. For example, the aerosol generation chamber may have a larger cross sectional diameter than at least some of the downstream part of the passage 170 so as to enable a longer residence time for the air inside the aerosol generation chamber.

Figure 20:
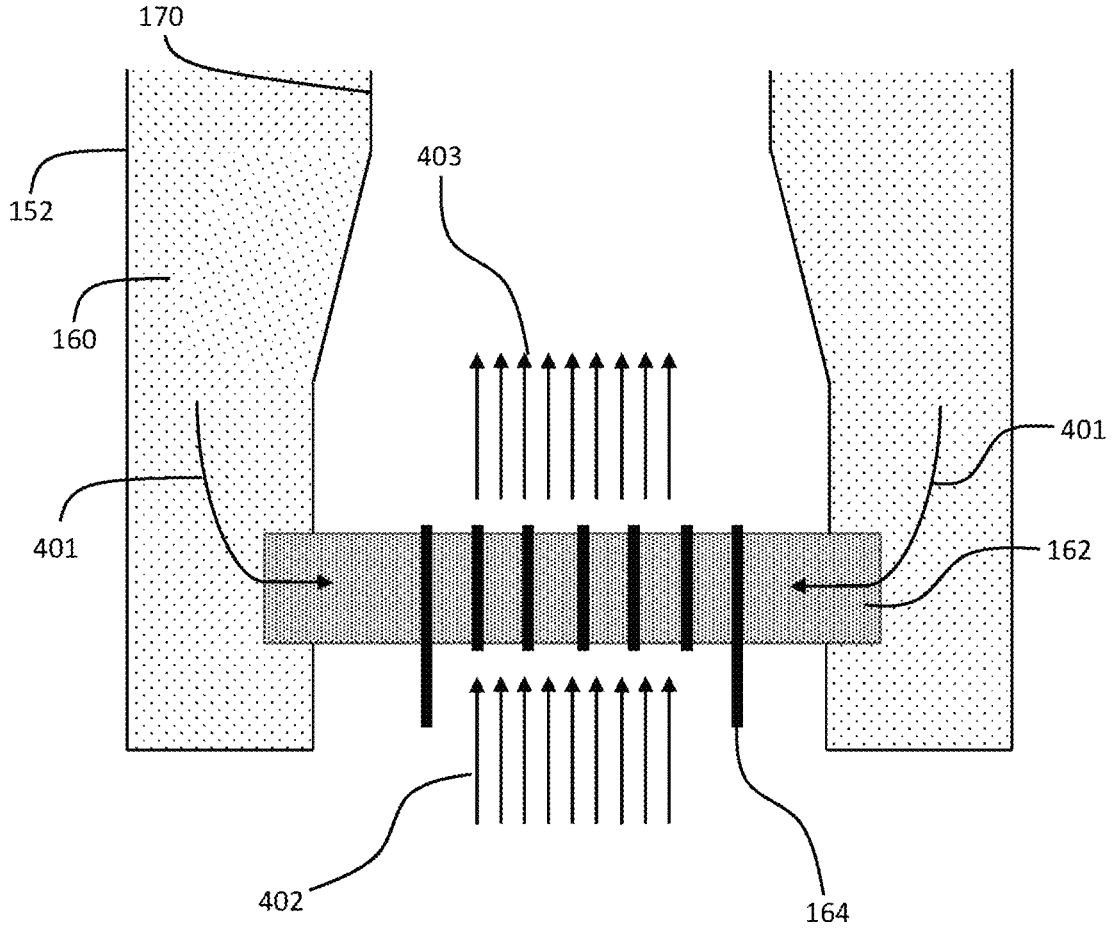
FIG. 20 is an enlarged schematic cross sectional view of part of the air passage and aerosol generation chamber of the first reference arrangement.

FIG. 20 illustrates in more detail the aerosol generation chamber of the reference arrangement as shown in FIG. 19 and therefore the region of the consumable 150 around the wick 162 and filament 164. The helical filament 164 is wound around a central portion of the porous wick 162. The porous wick extends across passage 170. E-liquid 160 contained within the tank 152 is conveyed as illustrated schematically by arrows 401, i.e., from the tank and towards the central portion of the porous wick 162.

When the user inhales, air is drawn from through the inlets 176 shown in FIG. 19, along inlet flow channel 178 to aerosol generation chamber inlet 172 and into the aerosol generation chamber containing porous wick 162. The porous wick 162 extends substantially transverse to the air flow direction. The air flow passes around the porous wick, at least a portion of the air flow substantially following the surface of the porous wick 162. In examples where the porous wick has a cylindrical cross-sectional profile, the air flow may follow a curved path around an outer periphery of the porous wick 162.

At substantially the same time as the air flow passes around the porous wick 162, the filament 164 is heated so as to vaporize the e-liquid which has been wicked into the porous wick. The air flow passing around the porous wick 162 picks up this vaporized e-liquid, and the vapor-containing air flow is drawn in direction 403 further down passage 170.

The power source of the main body 120 may be in the form of a battery (e.g., a rechargeable battery such as a lithium-ion battery). The main body 120 may comprise a connector in the form of e.g., a USB port for recharging this battery. The main body 120 may also comprise a controller that controls the supply of power from the power source to the main body electrical contacts (and thus to the filament 164). That is, the controller may be configured to control a voltage applied across the main body electrical contacts, and thus the voltage applied across the filament 164. In this way, the filament 164 may only be heated under certain conditions (e.g., during a puff and/or only when the system is in an active state). In this respect, the main body 120 may include a puff sensor (not shown) that is configured to detect a puff (i.e., inhalation). The puff sensor may be operatively connected to the controller so as to be able to provide a signal, to the controller, which is indicative of a puff state (i.e., puffing or not puffing). The puff sensor may, for example, be in the form of a pressure sensor or an acoustic sensor.

Although not shown, the main body 120 and consumable 150 may comprise a further interface which may, for example, be in the form of an RFID reader, a barcode or QR code reader. This interface may be able to identify a characteristic (e.g., a type) of a consumable 150 engaged with the main body 120. In this respect, the consumable 150 may include any one or more of an RFID chip, a barcode or QR code, or memory within which is an identifier and which can be interrogated via the interface.

Development A

Figure 21A:
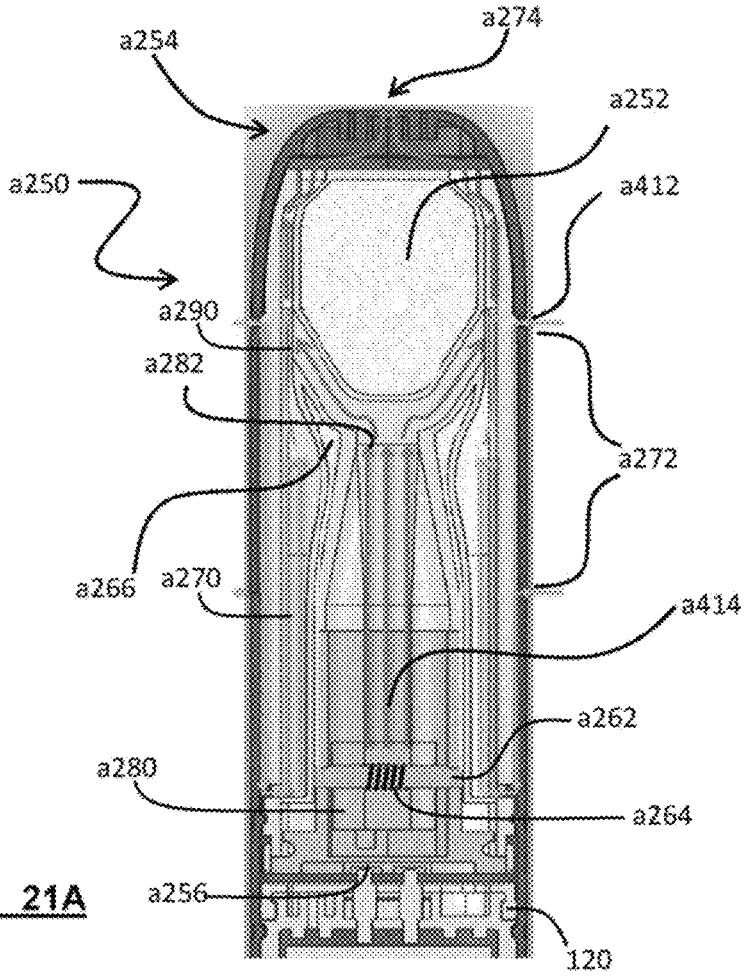
FIG. 21A is a schematic longitudinal cross sectional view of a smoking substitute apparatus of the first embodiment of Development A.
Figure 21B:
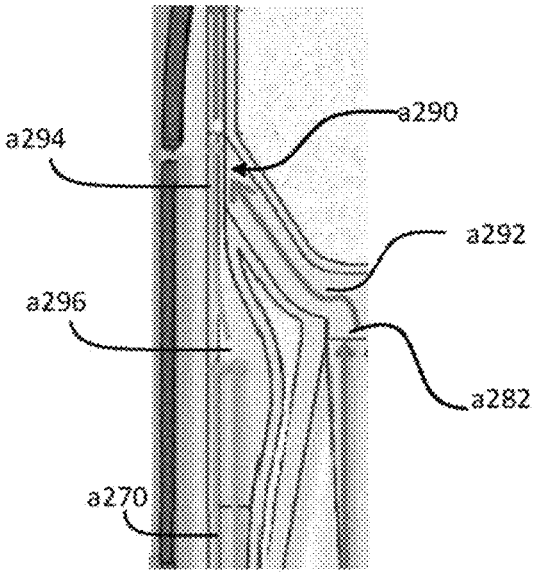
FIG. 21B is an enlarged schematic cross sectional view of a junction of the first embodiment as shown in FIG. 21A.

FIGS. 21A and 21B respectively illustrates a longitudinal cross sectional view of a consumable a250 and an enlarged cross sectional view of a junction of the consumable a250 according to the first embodiment of the present disclosure. In FIG. 21A, the consumable a250 is shown attached, at a first end of the consumable a250, to the main body 120 of FIG. 17 and FIG. 18. More specifically, the consumable a250 is configured to engage and disengage with the main body 120 and is interchangeable with the reference arrangement 150 as shown in FIGS. 19 and 20. Furthermore, the consumable a250 is configured to interact with the main body 120 in the same manner as the reference arrangement 150 and the user may operate the consumable a250 in the same manner as the reference arrangement 150.

The consumable a250 comprises a housing. The housing comprises an aerosol generation chamber a280 for generating an aerosol. The housing having a plurality of air inlets a272 defined at the sidewall of the housing. An outlet a274 is defined at a second end of the consumable 250 that comprises a mouthpiece a254. A pair of passages a270 each extends between the respective air inlet a272 and the outlet a274 to provide flow passage for an air flow a412 as a user puffs on the mouthpiece a254. In the illustrated embodiment, the passages extend from the air inlets a272 towards the first end of the consumable a250 before routing back towards the outlet a274 at the second end of the consumable a250. The path of the air flow a412 is illustrated in FIGS. 21A and 21B. In other embodiments, the passage a270 may extend from the air inlets a272 directly to the outlet a274 without routing towards the first end of consumable a250.

In contrast with the consumable 150 as shown in FIGS. 19 and 20, the air flow passages a270 of the consumable a250 is configured to bypass the aerosol generation chamber a280. Such arrangement allows aerosol precursor to be vaporized in absence of the air flow. Therefore, the aerosol generation chamber may be considered to be a "stagnant" chamber. For example, volumetric flowrate of vapor and/or aerosol in the aerosol generation chamber is configured to be less than 0.1 liter per minute. The vaporized aerosol precursor may cool and therefore condense to form an aerosol in the aerosol generation chamber a280, which is subsequently drawn into or entrained with the air flow in passages a270. In addition, a portion of the vaporized aerosol precursor may remain as a vapor before leaving the aerosol generation chamber a280, and subsequently forms an aerosol as it is cooled by the cooler air flow in the passages a270. The flow path of the vapor and/or aerosol a414 is illustrated in FIGS. 21A and 21B.

As shown in FIGS. 21A and 21B, the aerosol generation chamber a280 takes the form of an open ended container, or a cup, with a chamber outlet a282 opened towards the outlet a274 of the consumable a250. The chamber outlet a282 serves as the only opening to the interior of the aerosol generation chamber a280. In the illustrated embodiment, the chamber outlet a282 is configured to be in fluid communication with junctions a290 at the passages a270 through respective aerosol channels a292. In other words, the aerosol generation chamber a280 is sealed against air flow except for having the chamber outlet a282 in communication with the passages a270, the chamber outlet a282 permitting, in use, aerosol generated by the heater to be entrained into an air flow along the passage a270. The junctions a290 merges the aerosol channels a292 with the passages a270 such that vapor and/or aerosol formed in the aerosol generation chamber a280 may expand or be drawn into the passages a270 through a junction inlet of respective junctions a290. The aerosol channels form a buffering volume to minimize the amount of air flow entering the aerosol generation chamber a280. In some other embodiments, the chamber outlet a282 directly opens towards the junctions a290 at respective passages a270, and therefore in such embodiments the aerosol channel a292 may be omitted.

In the illustrated embodiment, the aerosol generation chamber is configured to have a length of 20 mm and a volume of 680 mm3. The aerosol generation chamber is configured to allow aerosol to be expulsed through the chamber outlet at a rate greater than 0.1 mg/second. In other embodiments the aerosol generation chamber may be configured to have an internal volume ranging between 68 mm3 to 680 mm3, wherein the length of the aerosol generation chamber may range between 2 mm to 20 mm.

As shown in FIGS. 21A and 21B, a part of each of the passages a270 extends alongside a portion of the external sidewalls of the aerosol generation chamber a280. The aerosol generation chamber a280 comprises a heater extending across its width. The heater comprises a porous wick a262 and a heating filament a264 helically wound around a portion of the porous wick a262. A tank a252 is provided in the space between the aerosol generation chamber a280 and the outlet a274 for storing a reservoir of aerosol precursor. Therefore, in contrast with the reference arrangement as shown in FIGS. 19 and 20, the tank a252 in this embodiment does not substantially surround the aerosol generation chamber a280 nor the passages a270. Instead, as shown in FIG. 21A, the tank is substantially positioned above the aerosol generation chamber a280 and the porous wick a262 when the consumable a250 is placed in an upright orientation during use. The end portions of the porous wick a262 extend through the sidewalls of the aerosol generation chamber a280 and into liquid conduits a266 which is in fluid communication with the tank a252. Such arrangement may allow the aerosol precursor stored in the tank a252 to convey towards the porous wick a262 through the liquid conduits a266 by gravity. The liquid conduits a266 are configured to have a hydraulic diameter that allow a controlled amount of aerosol precursor to flow from the tank a252 towards the porous wick a262. More specifically, the size of liquid conduits a266 may be selected based on the rate of aerosol precursor consumption during vaporization. For example, each of the liquid conduits a266 is sized such that it allows a sufficient amount of aerosol precursor to flow towards and replenish the wick, yet not large enough to cause excessive aerosol precursor to leak into the aerosol generation chamber. The liquid conduits a266 are configured to have a hydraulic diameter ranging from 0.01 mm to 10 mm or 0.01 mm to 5 mm. Preferably, the liquid conduits a266 are configured to have a hydraulic diameter in the range of 0.1 mm to 1 mm.

The heating filament is electrically connected to electrical contacts a256 at the base of the aerosol generation chamber a280, which is sealed to prevent air ingress or fluid leakage. As shown in FIG. 21A, when the first end of the consumable a250 is received into the main body 120, the electrical contacts a256 are put into electrical communication with corresponding electrical contacts of the main body 120, and thereby allowing the heater to be energized.

The vaporized aerosol precursor, or aerosol in the condensed form, may discharge from the aerosol generation chamber a280 based on pressure difference between the aerosol generation chamber a280 and the passages a270. Such pressure difference may arise from i) an increased pressure in the aerosol generation chamber a280 during vaporization of aerosol, and/or ii) a reduced pressure in the passages a270 during a puff.

During a puff, the aerosol generated in the aerosol generation chamber a280 may be drawn out from the chamber outlet a282 by a region of lowered pressure downstream created by Venturi effect. As best illustrated in FIG. 21B, junctions a290 each comprises a constriction a294 which formed from a narrowed section of respective passage a270. The constrictions a294 are configured to have a smaller cross sectional area than the respective passages a270 upstream, or more specifically immediately upstream, to the junctions a290. In the illustrated embodiment, the passages a270 further comprise widened portion a296 immediately upstream of the constrictions a294. Said widened portions a296 are configured to have a larger cross sectional area in comparison to the passages a270 upstream.

During a user puff, where the user draws an air flow from air inlets a272 towards the outlet a274, the velocity of the air flow may reduce in the widened portions a296 due to the enlarged cross sectional area thereat. As the air flow continues along the passages a270 it converges through the constrictions a294 and thereby increases in velocity. According to Bernoulli's principle, as the air flow increases in speed through a constriction, it results in a region of localized pressure drop thereat. As such, as the air flow passes through junctions a290, it may induce additional suction at the junction inlets for drawing out vapor and/or aerosol from the aerosol generation chamber towards the air flow. Such phenomena may be referred to as the Venturi effect. Advantageously, such arrangement allows vapor and/or aerosol to be withdrawn from the aerosol generation chamber in a more effective manner.

The junction inlets at junction a290, as shown in FIG. 21B, open in a direction orthogonal to the air flow. That is, the junction inlets open at a sidewall of the passage. This allows the vapor and/or aerosol from the aerosol generation chamber a280 to entrain into the air flow at an angle, and thus improving localized mixing of the different streams, as well as encouraging aerosol formation. The aerosol may be fully formed in the air flow and be drawn out through the outlet at the mouthpiece.

The illustrated embodiment comprises a widened portions a296 immediately upstream of the constrictions a294, this may enable the air flow to accelerate from a lowered velocity and thereby creating a larger localized pressure drop across the constrictions a294. However, in other embodiments such widened portions may be omitted, e.g., the passages a270 upstream of the constrictions a294 may each be configured to have a substantially uniform cross sectional area.

In some other embodiments, different constrictions a294 may be used. For example, an orifice plate having an aperture with a smaller cross sectional area than the passage a270 may be provided at or adjacent to the junctions for accelerating the air flow thereacross. Such orifice plates may advantageously reduce the footprint of the constrictions a294.

In the illustrated embodiment, the heater is positioned within the aerosol generation chamber a280, e.g., the heater is spaced from the chamber outlet a282. Such arrangement may reduce or prevent the amount of air flow entering the aerosol generation chamber, and therefore it may minimize the amount of turbulence in the vicinity of the heater. Furthermore, such arrangement may increase the residence time of vapor in the stagnant aerosol generation chamber a280, and thereby it may result in the formation of larger aerosol droplets. In some other embodiments, the heater may be positioned adjacent to the chamber outlet and therefore that the path of aerosol a414 from the heater to the chamber outlet a282 is shortened. This may allow aerosol to be drawn into or entrained with the air flow in a more efficient manner.

With the absence of, or much reduced, air flow in the aerosol generation chamber, the aerosol as generated by the illustrated embodiment has a median droplet size d50 of at least 1 μm. More preferably, the aerosol as generated by the illustrated embodiment has an averaged droplet size d50 of ranged between 2 μm to 3 μm.

Figure 22:
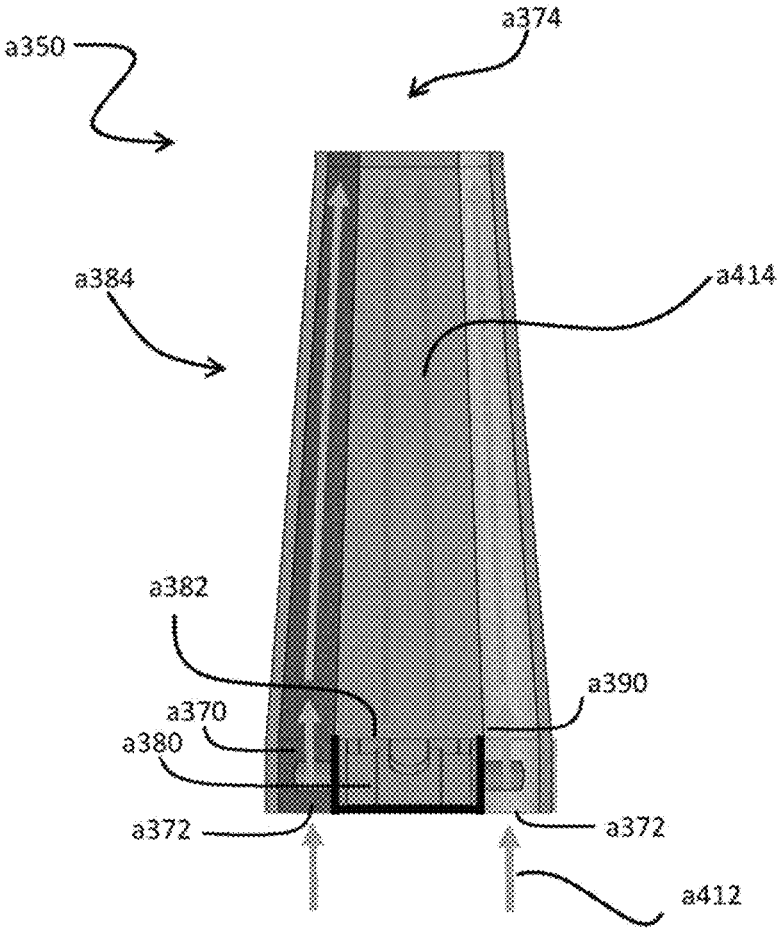
FIG. 22 is a plan view of a base of a smoking substitute apparatus of a second embodiment of Development A.

FIG. 22 illustrates a cross sectional view of a flow converging portion a384 of a consumable a350 according to a second embodiment of the present disclosure. In order to illustrate the internal structure of the consumable a350 more clearly, the heater and its electrical connections are not shown but nevertheless present. The consumable a350 comprises air inlets a372 that open at the base of consumable a350. The air inlets a372 lead to the passage a370 that extend alongside the external sidewalls of the aerosol generation chamber a380 and towards an outlet a374.

As shown in FIG. 22, the passage a370 comprises a flow converging portion a384 downstream of a chamber outlet a382. The flow converging portion a384 comprises a funnel or a tapered section for gradually merging the aerosol and the air flow. The flow path of the aerosol a414 and the flow path of the air flow a412 extend concurrently into the flow converging portion a384 as illustrated in FIG. 22. Such an arrangement may help minimizing the turbulence when the two streams are merged and thereby it may allow aerosol to be formed with larger droplet sizes. The aerosol is discharged, longitudinally along the flow converging portion a384 and through the outlet a374.

In the illustrated embodiment, junctions a390 are formed in the passage a370 adjacent to the chamber outlet a382, and wherein the chamber outlet a382 opens in a direction parallel to the air flow at said junctions a390. During a user puff, air flow is drawn into the consumable a350 through the air inlets a372. Since the air flow is drawn from the atmosphere into the air inlets a372, said air inlets a372 may therefore serve as a constriction that accelerates the air flow through the passage a370. According to Bernoulli's principle, such increase in air flow velocity results in a localized pressure drop in the vicinity of junctions a390. As such the air flow passing through the junction a390 it draws out the aerosol from the aerosol generation chamber a380, whereby the two streams subsequently form an aerosol in the flow converging portion a384 further downstream.

The experiments reported below have relevance to the embodiments disclosed above in particular in view of the "stagnant chamber" configuration used for the vaporization chamber, the experiments showing that control over the flow conditions at the wick lead to control over the particle size of the aerosol.

Development B

Figure 23A:
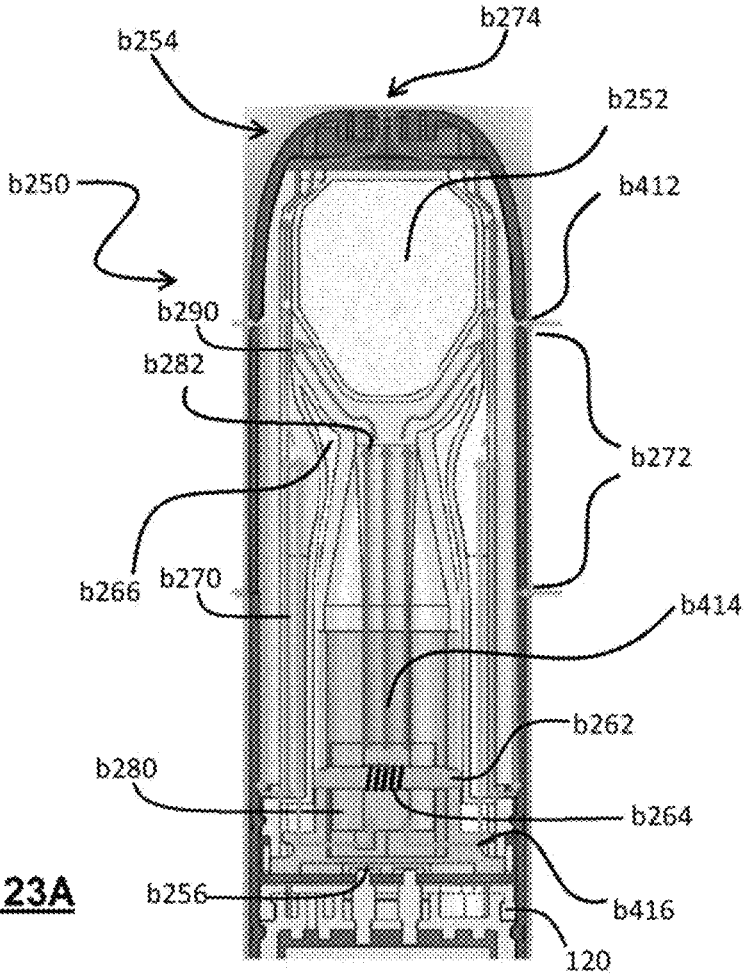
FIG. 23A is a schematic longitudinal cross sectional view of a smoking substitute apparatus of the first embodiment of Development B.
Figure 23B:
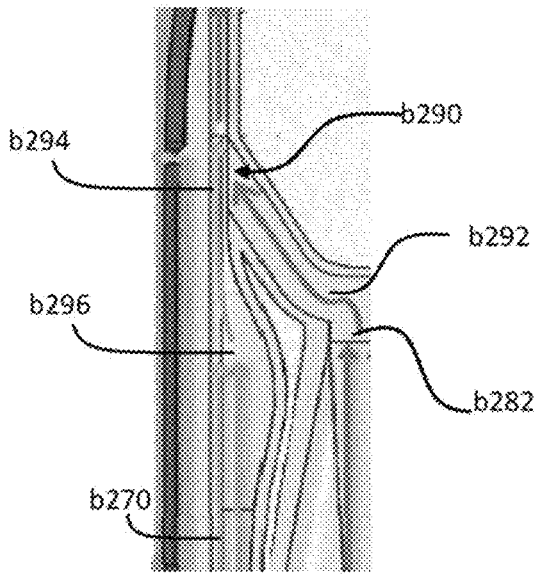
FIG. 23B is an enlarged schematic cross sectional view of a junction of the first embodiment of Development B as shown in FIG. 23A.
Figure 23C:
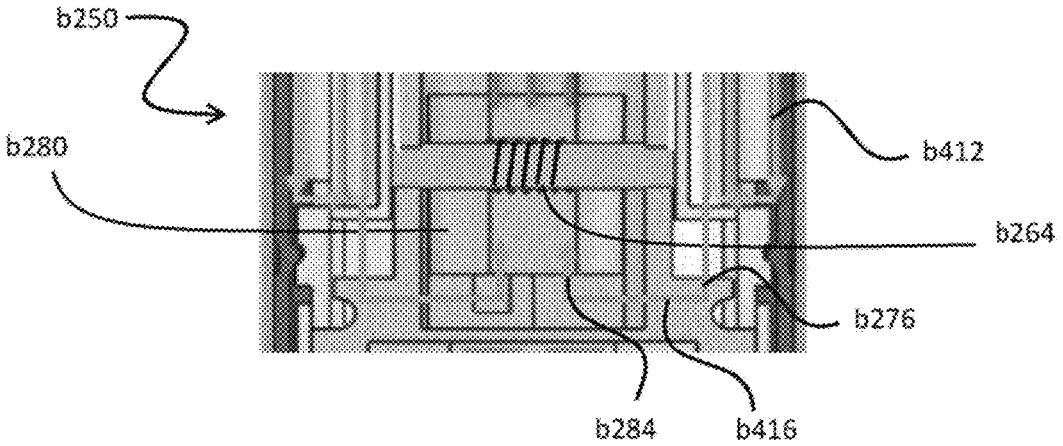
FIG. 23C is an enlarged schematic cross sectional view of a base of the first embodiment of Development B as shown in FIG. 23A.

FIGS. 23A, 23B and 23C respectively illustrate a longitudinal cross sectional view of a consumable b250, an enlarged cross sectional view of a junction of the consumable b250, and an enlarged cross sectional view of the base of the consumable b250 according to the first embodiment of the present disclosure. In FIG. 23A, the consumable b250 is shown attached, at a first end of the consumable b250, to the main body 120 of FIG. 17 and FIG. 18. More specifically, the consumable b250 is configured to engage and disengage with the main body 120 and is interchangeable with the reference arrangement 150 as shown in FIGS. 19 and 20. Furthermore, the consumable b250 is configured to interact with the main body 120 in the same manner as the reference arrangement 150 and the user may operate the consumable b250 in substantially the same manner as the reference arrangement 150.

The consumable b250 comprises a housing. The housing comprises an aerosol generation chamber b280 for generating an aerosol. The housing has a plurality of air inlets b272 defined at the sidewall of the housing. An outlet b274 is defined at a second end of the consumable b250 that comprises a mouthpiece b254. Passages b270 each extend between the respective air inlet b272 and the outlet b274 to provide flow passages for an air flow b412 as a user puffs on the mouthpiece b254. In the illustrated embodiment, the passages extend from the air inlets b272 towards the first end of the consumable b250 before routing back to towards the outlet b274 at the second end of the consumable b250. The path of the air flow b412 is illustrated in FIGS. 23A, 23B and 23C. In other embodiments, the passages b270 may extend from the air inlets b272 directly to the outlets b274 without routing towards the first end of consumable b250.

In addition, as best shown in FIG. 23C, a pair of auxiliary passages b276 are branched out from their respective passages b270, whereby the air flow entering the housing is split into a first air flow (e.g., continues along the passages b270 and towards the outlet) and a second air flow (e.g., following the auxiliary passages b276 to enter the aerosol generation chamber b280). The auxiliary passages b276 are configured to provide flow passage for a second air flow entering the air inlets b272 to enter the aerosol generation chamber b280 through bleed apertures b284 at a base of the aerosol generation chamber b280. The path of second air flow b416 entering through the bleed apertures b284 is shown in FIGS. 23A and 23C.

In contrast with the consumable 150 as shown in FIGS. 19 and 20, the air flow passages b270 of the consumable b250 allow the majority of air flow, or first air flow, b412 to bypass the aerosol generation chamber b280. The relatively smaller second air flow b416 may enter the aerosol generation chamber through the bleed apertures b284 primarily for reducing the amount of partial vacuum (e.g., lowered pressure) within the aerosol generation chamber b280 during a puff, as well as displacing residual aerosol therefrom. Together the first air flow b412 and the second air flow b416 contributes to the total amount of air flow at the outlet. The amount of said second air flow b416 contributes not more than 35% of the air flow at the outlet b274. The amount of said first air flow b412 contributes at least 65% of the air flow at the outlet b274. Such arrangement allows aerosol precursor to be vaporized in presence of a much reduced air flow in comparison to the reference arrangement 150, thus resulting in a much reduced turbulence. The vaporized aerosol precursor may cool and therefore condense to form an aerosol in the aerosol generation chamber b280, which is subsequently drawn into or entrained with the first air flow in passages b270. In addition, a portion of the vaporized aerosol precursor may remain as a vapor before leaving the aerosol generation chamber b280, and subsequently forms an aerosol as it is cooled by the cooler air flow in the passages b270. The flow path of the vapor and/or aerosol b414 is illustrated in FIGS. 23A and 23B.

As shown in FIGS. 23A and 23B, the aerosol generation chamber b280 having a chamber outlet b282 opened towards the outlet b274 of the consumable b250. In the illustrated embodiment, the chamber outlet b282 is configured to be in fluid communication with junctions b290 at passages b270 through respective aerosol channels b292. The junction b290 merges the aerosol channels b292 with the passages b270 such that vapor and/or aerosol formed in the aerosol generation chamber b280 may expand or be drawn into the passages b270 through a junction inlet of respective junctions b290. The aerosol channels b292 form a buffering volume to minimize the amount of air flow back-flowing into the aerosol generation chamber b280. In some other embodiments, the chamber outlet b282 directly opens towards the junctions b290 at respective passages b270, and therefore in such embodiments the aerosol channels b292 may be omitted. In the illustrated embodiment, the aerosol generation chamber is configured to have a length of 20 mm and a volume of 680 mm3. The aerosol generation chamber is configured to allow aerosol to be expulsed through the chamber outlet at a rate greater than 0.1 mg/second. In other embodiments the aerosol generation chamber may be configured to have an internal volume ranging between 68 mm3 to 680 mm3, wherein the length of the aerosol generation chamber may range between 2 mm to 20 mm.

As shown in FIGS. 23A and 23B, a part of each of the passages b270 extends alongside a portion of the external sidewalls of the aerosol generation chamber b280. The aerosol generation chamber b280 comprises a heater extending across its width. The heater comprises a porous wick b262 and a heating filament b264 helically wound around a portion of the porous wick b262. A tank b252 is provided in the space between the aerosol generation chamber b280 and the outlet b274 for storing a reservoir of aerosol precursor. Therefore, in contrast with the reference arrangement as shown in FIGS. 19 and 20, the tank b252 in this embodiment does not substantially surround the aerosol generation chamber 280 nor the passages 270. Instead, as shown in FIG. 21A, the tank is substantially positioned above the aerosol generation chamber b280 and the porous wick b262 when the consumable b250 is placed in an upright orientation. The end portions of the porous wick b262 extend through the sidewalls of the aerosol generation chamber b280 and into liquid conduits b266 which is in fluid communication with the tank b252. Such arrangement may allow the aerosol precursor stored in the tank b252 to convey towards the porous wick b262 through the liquid conduits b266 by gravity. The liquid conduits b266 are configured to have a hydraulic diameter that allow a controlled amount of aerosol precursor to flow from the tank b252 towards the porous wick b262. More specifically, the size of liquid conduits b266 may be selected based on the rate of aerosol precursor consumption during vaporization. For example, each of the liquid conduits b266 is sized such that it allows a sufficient amount of aerosol precursor to flow towards and replenish the wick, yet not large enough to cause excessive aerosol precursor to leak into the aerosol generation chamber. The liquid conduits b266 are configured to have a hydraulic diameter ranging from 0.01 mm to 10 mm or 0.01 mm to 5 mm. Preferably, the liquid conduits b266 are configured to have a hydraulic diameter in the range of 0.1 mm to 1 mm.

The heating filament is electrically connected to electrical contacts b256 at the base of the aerosol generation chamber b280. As shown in FIG. 23A, when the first end of the consumable b250 is received into a cavity of the main body 120, the electrical contacts b256 are put into electrical communication with corresponding electrical contacts of the main body 120, and thereby allowing the heater to be energized.

The aerosol may discharge from the aerosol generation chamber b280 based on pressure difference between the aerosol generation chamber b280 and the passages b270. Such pressure difference may arise from i) an increased pressure in the aerosol generation chamber b280 during vaporization of aerosol precursor, ii) the second air flow b416 entering into the aerosol generation chamber b280 through the bleed apertures b284, and/or iii) a reduced pressure in the first air flow along the passages b270 during a puff.

For example, during a user puff the bleed apertures b284 allow a second air flow to enter through the base of the aerosol generation chamber b280 before flowing towards the chamber outlet b282. Such second air flow sweeps the length of the chamber b280 and thereby allows residual aerosol droplets to be evacuated from the aerosol generation chamber b280. Moreover, during or after the user puff the second air flow b416 entering the bleed apertures b284 may help equalizing a partial vacuum (e.g., a lowered pressure) in the aerosol generation chamber b280 which could otherwise hold back the generated aerosol in the aerosol generation chamber b280. Thus, such arrangement aids the discharge of generated aerosol through the chamber outlet b282.

In the illustrated embodiment, a pair of bleed apertures b284 are provided across the base of the aerosol generation chamber b280. That is, the second air flow b416 is distributed over an enlarged region at the base and therefore such arrangement may improve the efficiency in evacuating the generated aerosol from the aerosol generation chamber b280. In some other embodiment, the bleed apertures b284 may be arranged in the peripheral region of the base and do not axially align with the heater. Thus, such arrangement may reduce the chance the second air flow b416 directly impinging directly upon the heater as it enters the aerosol generation chamber b280.

The proportion of the first and second airflow splitting respectively between the passages b270 and the auxiliary passages b276 depends upon the relative flow resistance along their respective flow paths. For example, the bleed apertures b284 may have a smaller hydraulic diameter than the passages b270 and therefore results in an elevated flow resistance. Such arrangement limits the second air flow entering the aerosol generation chamber b280 through the bleed apertures b284. The size of the bleed apertures may range between 0.01 to 10 mm, or within the range of 0.01 mm to 1 mm. In the present embodiment, the bleed apertures each measure 1 mm in diameter.

Alternatively, or in addition, the relative flow resistance between the auxiliary passages b276 and the passages b270 may be varied by changing the relative sizes of the auxiliary passages b276 and/or passages b270. For example, narrower auxiliary passages b276 may be adapted to limit the flowrate of the second air flow therethrough, and therefore accordingly increasing the flowrate of the first air flow bypassing the aerosol generation chamber b280 through the passages b270. The bleed aperture is configured to allow air from the passage b270 to enter the aerosol generation chamber. In the illustrated embodiment, an air flow amounting to less than 35% of the air flow at the outlet branches out from the passages b270 to enter the aerosol generation chamber through the bleed apertures b284. In some other embodiments, the amount of second air flow entering the aerosol generation chamber b280 through the bleed apertures b284 is less than any one of 30%, 25%, 20%, 15%, 10% and 5% of the air flow at the outlet.

In some embodiments, the auxiliary flow passages b276 and/or the bleed apertures b284 may each be provided with a one way valve, such as a check valve. Said one way valve may provide one way flow passage for the second air flow b416 to enter the aerosol generation chamber b280, as well as keeping aerosol precursor and/or aerosol droplets from leaking, through the bleed apertures b284, into the auxiliary passages b276.

During a puff, the aerosol generated in the aerosol generation chamber b280 may be drawn out from the chamber outlet b282 by a region of lowered pressure downstream created by a Venturi effect. As best illustrated in FIG. 23B, junctions b290 each comprises a constriction b294 which formed from a narrowed section of respective passage b270. The flow constrictions b294 are configured to have a smaller cross sectional area than the respective passages b270 upstream, or more specifically immediately upstream, to the junctions b290. In the illustrated embodiment, the passages b270 further comprise widened portions b296 immediately upstream of the flow constrictions b294. Said widened portions b296 are configured to have a larger cross sectional area in comparison to the respective passages b270 upstream.

During a user puff, where the user draws an air flow from air inlets b272 towards the outlet b274, the velocity of the first air flow may reduce in the widened portions b296 due to the enlarged cross sectional area thereat. As the first air flow continues along the passages b270 it converges through the flow constrictions b294 and thereby increases in velocity. According to Bernoulli's principle, as the air flow increases in speed through a constriction, it results in a region of localized pressure drop thereat. As such, as the first air flow passes through junctions b290, it may induce additional suction at the junction inlets for drawing out vapor and/or aerosol from the aerosol generation chamber towards the air flow. Such phenomena may be referred to as the Venturi effect. Advantageously, such arrangement allows vapor and/or aerosol to be withdrawn from the aerosol generation chamber in a more effective manner.

The junction inlets at junction b290, as shown in FIG. 23B, open in a direction orthogonal to the first air flow. That is, the junction inlets open at a sidewall of the passage. This allows the vapor and/or aerosol from the aerosol generation chamber b280 to entrain into the first air flow at an angle, and thus improving localized mixing of the different streams, as well as encouraging aerosol formation. The aerosol may be fully formed in the first air flow and be drawn out through the outlet at the mouthpiece.

The illustrated embodiment comprises widened portions b296 immediately upstream of the constrictions b294, this enables the first air flow to accelerate from a lowered velocity and thereby creating a larger localized pressure drop across the constrictions b294. However, in other embodiments such widened portions may be omitted, e.g., the passages b270 upstream of the constrictions b294 may each be configured to have a substantially uniform cross sectional area.

In some other embodiments, different constrictions b294 may be used. For example, an orifice plate having an aperture with a smaller cross sectional area than the respective passage b270 may be provided at or adjacent to each of the junctions for accelerating the air flow thereacross. Such orifice plates may advantageously reduce the footprint of the constrictions b294.

In the illustrated embodiment, the heater is positioned within the aerosol generation chamber b280, e.g., the heater is spaced from the chamber outlet b282. Such arrangement may reduce or prevent the amount of air flow entering the aerosol generation chamber, and therefore it may minimize the amount of turbulence in the vicinity of the heater. Furthermore, such arrangement may increase the residence time of vapor in the aerosol generation chamber b280, and thereby it may result in the formation of larger aerosol droplets. In some other embodiments, the heater may be positioned adjacent to the chamber outlet and therefore that the path of aerosol b414 from the heater to the chamber outlet b282 is shortened. This may allow aerosol to be drawn into or entrained with the first air flow in a more efficient manner.

With the absence of, or much reduced, air flow in the aerosol generation chamber, the aerosol as generated by the illustrated embodiment has a median droplet size d50 of at least 1 μm. More preferably, the aerosol as generated by the illustrated embodiment has a median droplet size d50 in the range 2 μm to 3 μm.

Figure 24:
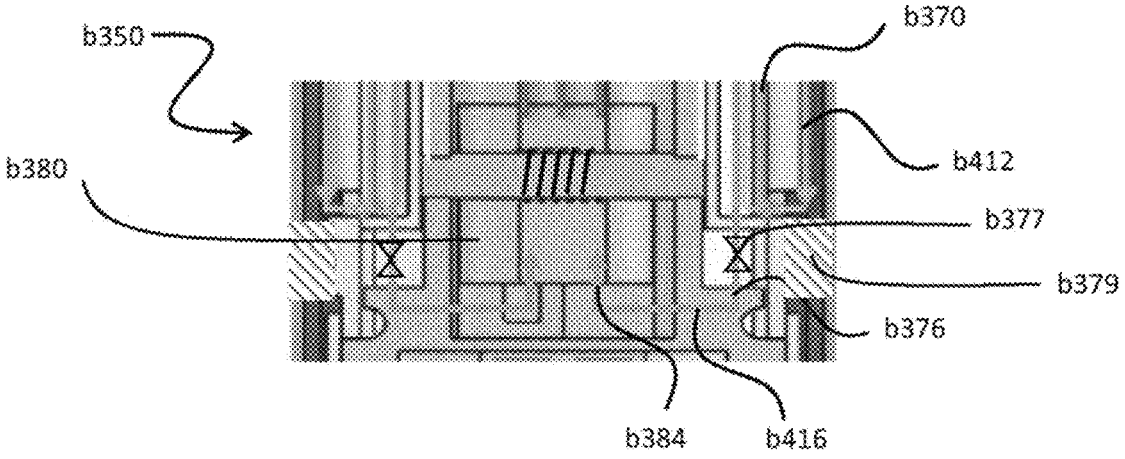
FIG. 24 is an enlarged schematic cross sectional view of a base of a smoking substitute apparatus of the second embodiment of Development B.

FIG. 24 illustrates an enlarged cross sectional view of the base of the consumable b350 according to the second embodiment of the present disclosure. The consumable b350 is similar to consumable b250 of the first embodiment, apart from that the auxiliary passages b376 in consumable b350 each comprises a variable auxiliary flow constrictor b377 for varying the flow resistance thereacross. The variable auxiliary flow constrictors b377 may each comprise one or more of a manually actuated valve, an electronically actuated valve and a deformable auxiliary passage wall. More specifically, the variable auxiliary flow constrictors b377 are configured to vary the cross sectional area along a section of or the entire auxiliary passage b376.

In the illustrated embodiment, the variable auxiliary flow constrictors b377 each comprises a section of the deformable auxiliary passage wall b377, which is actuated by depressing an adjacent section of deformable sidewall at the housing b379. Both sections of deformable auxiliary passage walls b377 and deformable housing sidewalls b379 are formed from an elastomer, such as rubber. In use, a user may press onto the section of deformable housing sidewalls b379, causing them to bias towards and therefore compress their respective deformable auxiliary passage walls b377. This results in a narrowed auxiliary passages b376 with an increased flow resistance, and thereby allowing a larger amount of first air flow b412 to bypass the aerosol generation chamber b380 through the passages b370 during a user puff. Upon releasing the pressure on the deformation housing sidewalls b379, the elastic auxiliary passage walls b377 may return to their original shape and therefore the cross sectional area of the auxiliary passages b376 may expand, thus allowing an increased proportion of air flow to enter the aerosol generation chamber b380 through the bleed apertures b384.

In some other embodiments, the variable auxiliary passage walls b377 may be actuated electronically. For example, the variable auxiliary passage walls b377 may each comprise a piezoelectric element electrically connected to the controller in the main body 120. Such arrangement may allow the section of deformation housing walls to be omitted. To actuate the variable auxiliary passage walls b377, the controller may apply an electrical current across the piezoelectric elements and thereby imparting a mechanical force on their respective deformable passage walls b377. This may result in the narrowing of the auxiliary passages b376 and therefore allowing a larger amount of first air flow b412 to bypass the aerosol generation chamber b380 through the passage b370 during a user puff. In some other embodiments, the variable auxiliary flow constrictors may instead be provided at the bleed apertures for controlling the portion of air flow passing through the bleed apertures. For example, the variable auxiliary flow constrictors may be an electronically actuated valve positioned across the respective bleed apertures. The electronically actuated valves are electrically connected to the controller of the main body 120. In use, the controller controls the degree of opening at the electronically actuated valves in order to vary the hydraulic diameter of the bleed apertures.

The experimental results reported below are relevant to the embodiments disclosed above in that they show the effect of altering the flow conditions at the wick on the particle size of the generated aerosol.

Development C

Figure 25:
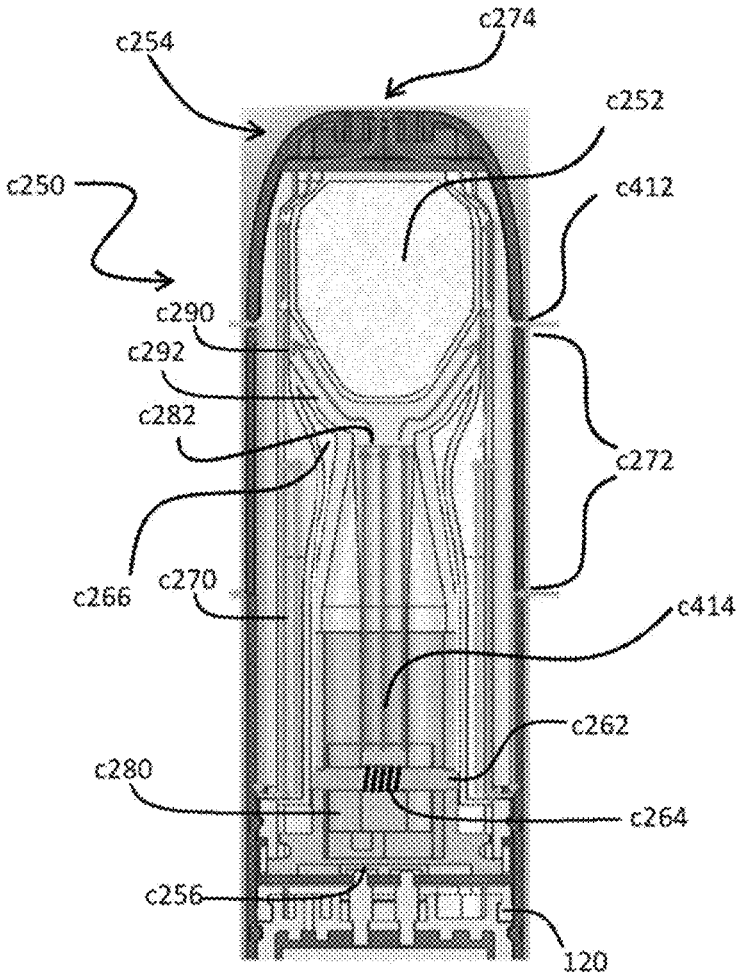
FIG. 25 is a schematic longitudinal cross sectional view of a smoking substitute apparatus of the first embodiment of Development C.

FIG. 25 illustrates a longitudinal cross sectional view of a consumable c250 according to the first embodiment of the present disclosure. In FIG. 25, the consumable c250 is shown attached, at a first end of the consumable c250, to the main body 120 of FIG. 17 and FIG. 18. More specifically, the consumable c250 is configured to engage and disengage with the main body 120 and is interchangeable with the reference arrangement 150 as shown in FIGS. 19 and 20. Furthermore, the consumable c250 is configured to interact with the main body 120 in the same manner as the reference arrangement 150 and the user may operate the consumable c250 in the same manner as the reference arrangement 150.

The consumable c250 comprises a housing. The consumable c250 comprises an aerosol generation chamber c280 in the housing. As shown in FIG. 25, the aerosol generation chamber c280 takes the form of an open ended container, or a cup, with a single chamber outlet c282 opened towards the outlet c274 of the consumable c250.

In the illustrated embodiment, the housing has a plurality of air inlets c272 defined or opened at the sidewall of the housing. An outlet c274 is defined or opened at a second end of the consumable c250 that comprises a mouthpiece c254. A pair of passages c270 each extend between the respective air inlets c272 and the outlet c274 to provide flow passage for an air flow c412 as a user puffs on the mouthpiece c254. The chamber outlet c282 is configured to be in fluid communication with the passages c270. The passages c270 extend from the air inlets c272 towards the first end of the consumable c250 before routing back to towards the outlet c274 at the second end of the consumable c250. That is, a portion of each of the passages c270 axially extends alongside the aerosol generation chamber c280. The path of the air flow path c412 is illustrated in FIG. 25. In other embodiments, the passages c270 may extend from the air inlet c272 directly to the outlet c274 without routing towards the first end of consumable c250, e.g., the passages c270 may not axially extend alongside the aerosol generation chamber c280.

In some other embodiments, the housing may not be provided with any air inlet for an air flow to enter the housing. For example, the chamber outlet may directly connected to the outlet of the housing by an aerosol passage and therefore said aerosol passage may only convey aerosol as generated in the aerosol generation chamber. In these embodiments, the discharge of aerosol are largely driven by the pressure increase during vaporization of aerosol form.

Referring back to the embodiment of FIG. 25, the chamber outlet c282 is positioned downstream from the heater in the direction of the vapor and/or aerosol flow c414 and serves as the only gas flow passage to the internal volume of the aerosol generation chamber c280. In other words, the aerosol generation chamber c280 is sealed against air flow except for having the chamber outlet c282 in communication with the passages c270, the chamber outlet c282 permitting, in use, aerosol generated by the heater to be entrained into an air flow along the passage c270. In some other embodiments, the sealed aerosol generation chamber c280 may comprise a plurality of chamber outlets c282 each arranged in fluid commutation with the passages c270. In the illustrated embodiment, the aerosol generation chamber c280 does not comprise any aperture upstream of the heater that may serve as an air flow inlet. In contrast with the consumable 150 as shown in FIGS. 19 and 20, the passages c270 of the consumable c250 allow the air flow, e.g., an entire amount of air flow, entering the housing to bypass the aerosol generation chamber c280. Such arrangement allows aerosol precursor to be vaporized in absence of the air flow. Therefore, the aerosol generation chamber may be considered to be a "stagnant" chamber. For example, the volumetric flowrate of vapor and/or aerosol in the aerosol generation chamber is configured to be less than 0.1 liter per minute. The vaporized aerosol precursor may cool and therefore condense to form an aerosol in the aerosol generation chamber c280, which is subsequently expulsed into or entrained with the air flow in passages c270. In addition, a portion of the vaporized aerosol precursor may remain as a vapor before leaving the aerosol generation chamber c280, and subsequently forms an aerosol as it is cooled by the air flow in the passages c270. The flow path of the vapor and/or aerosol c414 is illustrated in FIG. 25.

In the illustrated embodiment, the chamber outlet c282 is configured to be in fluid communication with a junction c290 at each of the passages c270 through a respective vapor channel c292. The junctions c290 merge the vapor channels c292 with their respective passages c270 such that vapor and/or aerosol formed in the aerosol generation chamber c280 may expand or entrain into the passages c270 through junction inlets of said junctions c290. The vapor channels form a buffering volume to minimize the amount of air flow that may back flow into the aerosol generation chamber c280. In some other embodiments (not illustrated), the chamber outlet c282 may directly open towards the junction c290 at the passage, and therefore in such embodiments the vapor channel c292 may be omitted.

In some embodiments (not illustrated), the chamber outlet may be closed by a one way valve. Said one way valve may be configured to allow a one way flow passage for the vapor and/or aerosol to be discharged from the aerosol generation chamber, and to reduce or prevent the air flow in the passages from entering the aerosol generation chamber.

In the illustrated embodiment, the aerosol generation chamber c280 is configured to have a length of 20 mm and a volume of 680 mm3. The aerosol generation chamber is configured to allow vapor to be expulsed through the chamber outlet at a rate greater than 0.1 mg/second. In other embodiments the aerosol generation chamber may be configured to have an internal volume ranging between 68 mm3 to 680 mm3, wherein the length of the aerosol generation chamber may range between 2 mm to 20 mm.

As shown in FIG. 25, a part of each of the passages c270 axially extends alongside the aerosol generation chamber c280. For example, the passages c270 are formed between the aerosol generation chamber c280 and the housing. Such an arrangement reduces heat transfer from the aerosol generation chamber c280 to the external surfaces of the housing.

The aerosol generation chamber c280 comprises a heater extending across its width. The heater comprises a porous wick c262 and a heating filament c264 helically wound around a portion of the porous wick c262. A tank c252 is provided in the space between the aerosol generation chamber c280 and the outlet c274, the tank being for storing a reservoir of aerosol precursor. Therefore, in contrast with the reference arrangement as shown in FIGS. 19 and 20, the tank c252 in this embodiment does not substantially surround the aerosol generation chamber nor the passage c270. Instead, as shown in FIG. 25, the tank is substantially positioned above the aerosol generation chamber c280 and the porous wick c262 when the consumable c250 is placed in an upright orientation during use. The end portions of the porous wick c262 each extend through the sidewalls of the aerosol generation chamber c280 and into a respective liquid conduit c266 which is in fluid communication with the tank c252. The wick c262, saturated with aerosol precursor, may prevent gas flow passage into the liquid conduits c266 and the tank c252. Such an arrangement may allow the aerosol precursor stored in the tank c252 to convey towards the porous wick c262 through the liquid conduits c266 by gravity. The liquid conduits c266 are configured to have a hydraulic diameter that allow a controlled amount of aerosol precursor to flow from the tank c252 towards the porous wick c262. More specifically, the size of liquid conduits c266 are selected based on the rate of aerosol precursor consumption during vaporization. For example, the liquid conduits c266 are sized to allow a sufficient amount of aerosol precursor to flow towards and replenish the wick, yet not so large as to cause excessive aerosol precursor to leak into the aerosol generation chamber. The liquid conduits c266 are configured to have a hydraulic diameter ranging from 0.01 mm to 10 mm or 0.01 mm to 5 mm. Preferably, the liquid conduits c266 are configured to have a hydraulic diameter in the range of 0.1 mm to 1 mm.

The heating filament is electrically connected to electrical contacts c256 at the base of the aerosol generation chamber c280, sealed to prevent air ingress or fluid leakage. As shown in FIG. 25, when the first end of the consumable c250 is received into the main body 120, the electrical contacts c256 establish electrical communication with corresponding electrical contacts of the main body 120, and thereby allow the heater to be energized.

The vaporized aerosol precursor, or aerosol in the condensed form, may discharge from the aerosol generation chamber c280 based on pressure difference between the aerosol generation chamber c280 and the passages c270. Such pressure difference may arise form i) an increased pressure in the aerosol generation chamber c280 during vaporization of aerosol form, and/or ii) a reduced pressure in the passage during a puff.

For example, when the heater is energized and forms a vapor, it expands in to the stagnant cavity of the aerosol generation chamber c280 and thereby causes an increase in internal pressure therein. The vaporized aerosol precursor may immediately begin to cool and may form aerosol droplets. Such increase in internal pressure causes convection inside the aerosol generation chamber which aids expulsing aerosol through the chamber outlet c282 and into the passages c270.

In the illustrated embodiment, the heater is positioned within the stagnant cavity of the aerosol generation chamber c280, e.g., the heater is spaced from the chamber outlet c282. Such arrangement may reduce or prevent the amount of air flow entering the aerosol generation chamber, and therefore it may minimize the amount of turbulence in the vicinity of the heater. Furthermore, such arrangement may increase the residence time of vapor in the stagnant aerosol generation chamber c280, and thereby may result in the formation of larger aerosol droplets. In some other embodiments, the heater may be positioned adjacent to the chamber outlet and therefore that the path of vapor c414 from the heater to the chamber outlet c282 is shortened. This may allow vapor to be drawn into or entrained with the air flow in a more efficient manner.

The junction inlet at each of the junctions c290 opens in a direction orthogonal or non-parallel to the air flow. That is, the junction inlet each opens at a sidewall of the respective passages c270. This allows the vapor and/or aerosol from the aerosol generation chamber c280 to entrain into the air flow at an angle, and thus improving localized mixing of the different streams, as well as encouraging aerosol formation. The aerosol may be fully formed in the air flow and be drawn out through the outlet at the mouthpiece.

With the absence of, or much reduced, air flow in the aerosol generation chamber, the aerosol as generated by the illustrated embodiment has a median droplet size d50 of at least 1 μm. More preferably, the aerosol as generated by the illustrated embodiment has a median droplet size d50 of ranged between 2 μm to 3 μm.

The experiments reported below have relevance to the embodiments disclosed above in particular in view of the "stagnant chamber" configuration used for the vaporization chamber, the experiments showing that control over the flow conditions at the wick lead to control over the particle size of the aerosol.

Development D

Figure 26A:
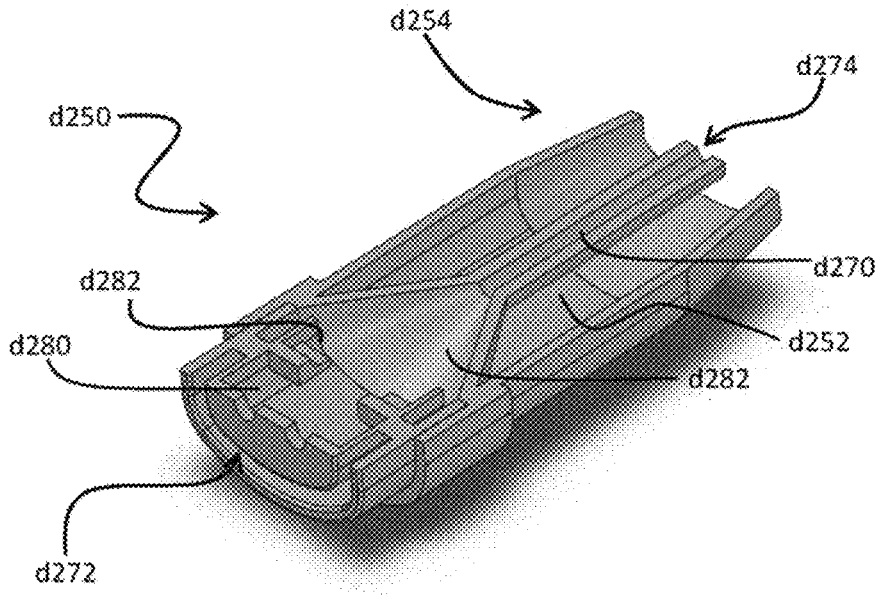
FIG. 26A is a schematic perspective cross sectional view of a smoking substitute apparatus of the first embodiment of Development D.
Figure 26B:
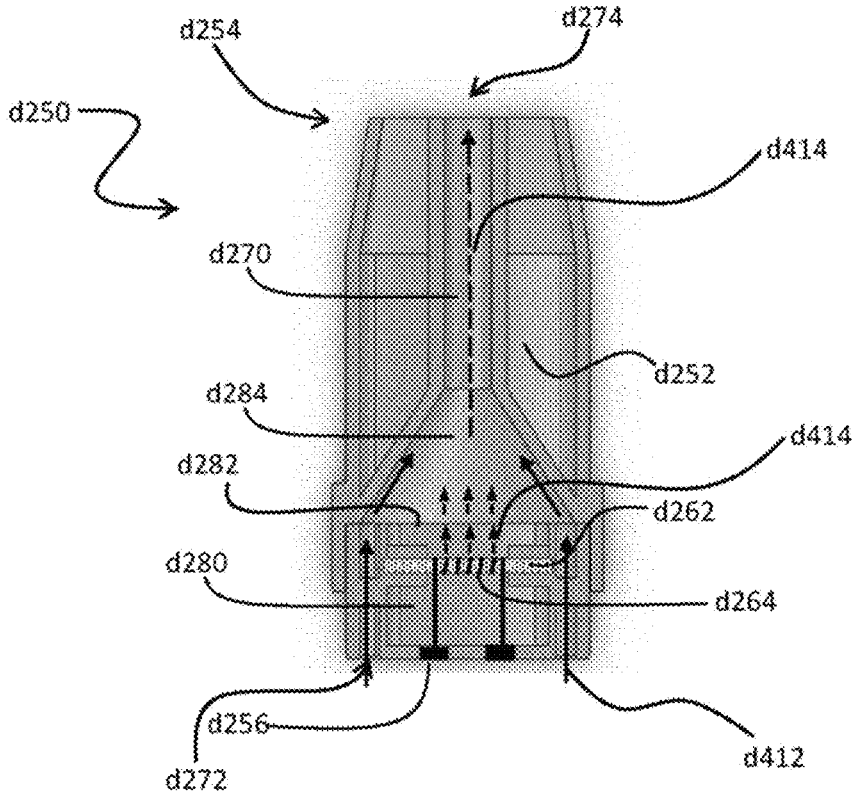
FIG. 26B is a schematic longitudinal cross sectional view of the smoking substitute apparatus of the first embodiment of Development D.

FIGS. 26A and 26B respectively illustrates a perspective sectional view and plan sectional view of a consumable d250 according to the first embodiment of the present disclosure. In FIG. 26A, the heater and its electrical connections are omitted from the drawing to better illustrate the internal construction of the consumable d250, but they are nevertheless present. The consumable d250 is configured to engage and disengage with the main body 120 as shown in FIGS. 17 and 18, e.g., the consumable d250 is interchangeable with the prior art consumable 150 as shown in FIGS. 19 and 20. Furthermore, the consumable d250 is configured to interact with the main body 120 in the same manner as the consumable 150 and the user may operate the consumable d250 in the same manner as the consumable 150.

The consumable d250 comprises a housing. The housing having an air inlet d272 defined at a first end of the consumable d250 engageable with the main body 120, and an outlet d274 defined at a second end of the consumable d250 that comprises a mouthpiece d254. A passage d270 extends between the air inlet d272 and the outlet d274 to provide flow passage for an air flow d412 as a user puffs on the mouthpiece d254. That is, when the consumable d250 is engaged with the main body 120, a user can inhale or puff via a mouthpiece d254 so as to draw air through passage d270, and so as to form an air flow in a direction from an air inlet d272 to the outlet d274. The path of the air flow d412 is illustrated as solid arrows in FIG. 26B.

In contrast with the consumable 150 as shown in FIGS. 19 and 20, the air flow passage d270 of the consumable d250 bypasses the aerosol generation chamber d280. For example, the aerosol generation chamber d280 comprises a chamber outlet d282 that is positioned downstream of a heater therein, and wherein the chamber outlet d282 forms the only aperture at the aerosol generation chamber d280 that provides gas flow passage. Because the chamber outlet d282 is positioned downstream of the heater, such arrangement allows aerosol precursor to be vaporized in absence of the air flow. Therefore, the aerosol generation chamber may be considered to be a "stagnant" chamber and substantially free of the air flow drawn in by a puff. The vaporized aerosol precursor may cool and therefore condense to form an aerosol in the aerosol generation chamber d280, which is subsequently entrained into the air flow in passage d270 through the chamber outlet d282. In addition, a portion of the vaporized aerosol precursor may remain as a vapor before leaving the aerosol generation chamber d280, and subsequently forms an aerosol as it is cooled by the cooler air flow in the passage d270. A degree of flow convection in the aerosol generation chamber d280 may nevertheless result from localized pressure increase during the vaporization of aerosol precursor. However, the turbulence in the aerosol generation chamber d280 during vaporization of aerosol precursor and formation of aerosol droplets, in particular in the vicinity of the heater, is substantially less than that in the aerosol generation chamber 180 of the reference arrangement as shown in FIGS. 19 and 20. The flow path of the aerosol and/or vapor d414 is illustrated as dotted arrows in FIG. 26B.

As shown in FIGS. 26A and 26B, the aerosol generation chamber d280 takes the form of an open ended container, or a cup, with the chamber outlet d282 opened towards the outlet d274 of the consumable d250. The chamber outlet d282 is positioned downstream to the heater in the direction of the vapor and/or aerosol flow d414 and serves as the only gas flow passage to the internal volume of the aerosol generation chamber d280. In other words, the aerosol generation chamber d280 is sealed against air flow except for having the chamber outlet d282 in communication with the passages d270, the chamber outlet d282 permitting, in use, aerosol generated by the heater to be entrained into an air flow along the passage d270. The passage d270 extends, in the form of an annulus, from the air inlet d272 and alongside the external sidewalls of the aerosol generation chamber d280. That is, the passage d270 surrounds the length of aerosol generation chamber d280. More specifically, the aerosol generation chamber d280 can be described as being completely enclosed in a widened part of passage d270 towards the first end of the consumable d250.

In other embodiments, the air inlet may open on a sidewall of the housing at a position between the chamber outlet and the outlet along the longitudinal axis of the housing. For example, the passage extends directly from the air inlet towards the outlet without extending along the sidewall of the aerosol generation chamber. The passage may nevertheless be in fluid communication with the chamber opening.

In other embodiments, additional air inlets may open on a sidewall of the housing and fluidly connect to the passage. For example, the additional air inlets may be fluidly communicative with the passage between the air inlet and the chamber outlet. Additional air inlets may alternatively, or in addition, fluidly connect with the passage at a position between the chamber outlet and the outlet. Such arrangement may limit the amount of air flow sweeping across the chamber outlet and thereby minimizes the chances of air flow ingress through said chamber outlet and into the aerosol generation chamber.

The aerosol generation chamber d280 comprises a heater extending across its width. The heater comprises a porous wick d262 and a heating filament d264 helically wound around a portion of the porous wick d262. A tank d252 is provided towards the second end of the consumable d250 for storing a reservoir of aerosol precursor. The tank d252 annularly surrounds a narrowed portion of passage d270 towards the outlet d274. The end portions of the porous wick d262 extend through respective wick apertures at the sidewalls of the aerosol generation chamber d280 and into the tank d252 for wicking aerosol precursor stored therein. When the porous wick d262 is primed with aerosol precursor, e.g., during use, it blocks and thereby prevents gas flow passage through said wick apertures.

In the illustrated embodiment, the air inlet d272 is arranged to be radially adjacent to the base of the aerosol generation chamber d280. That is, the air inlet d272 does not open at the base of aerosol generation chamber and instead it leads to the passage d270 that bypasses the aerosol generation chamber. Furthermore, the heating filament is electrically connected to electrical contacts d256 at the base of the aerosol generation chamber d280 through sealed apertures, which prevents air ingress or fluid leakage therethrough. Therefore, such arrangement may reduce or eliminate leakage of excess aerosol precursor through the air inlet d272 at the first end of the housing.

In the illustrated embodiment, as shown in FIG. 26B, the air inlet d272 is levelled with the base of the aerosol generation chamber d280, e.g., the base of the aerosol generation chamber d280 also forms the base of the housing. In other embodiments, the base of the aerosol generation chamber d280 may not be level with the air inlet d272. For example, the base of aerosol generation chamber d280 may recede into, or protrude out of, the first end of the housing.

At the downstream end of the aerosol generation chamber d280 there is provided the chamber outlet d282 that serves as the only opening to the interior of the aerosol generation chamber d280 that allows gas flow passage. More specifically, the chamber outlet d282 opens downstream of the heater in the direction of aerosol flow, and forms the only aperture in the aerosol generation chamber d280 that provides gas flow passage to the internal volume of the chamber. For example, an air flow would not be able to enter into the aerosol generation chamber d280 through sealed apertures at the base of the aerosol generation chamber d280, nor through the apertures on the sidewall of aerosol generation chamber where the ends of the wick extend.

The chamber outlet d282 is opened substantially in the direction of air flow passing through the channel d270, e.g., the aerosol and the air flow flows in a concurrent direction. Such arrangement reduces the amount of air flow that may enter the aerosol generation chamber d280. In some embodiments, a plurality of chamber outlets d282 are opened at the aerosol generation chamber d280 each positioned downstream of the heater in the direction of aerosol flow.

The vaporized aerosol precursor, or aerosol in the condensed form, may discharge from the aerosol generation chamber d280 based on pressure difference between the aerosol generation chamber d280 and the passage d270. Such pressure difference may arise form i) an increased pressure in the aerosol generation chamber d280 during vaporization of aerosol form, and/or ii) a reduced pressure in the passage during a puff.

In the illustrated embodiment, the heater is positioned adjacent to the chamber outlet and therefore that the path of aerosol d414 from the heater to the chamber outlet d282 is shortened. This may allow aerosol to be entrained into the air flow more efficiently. In some other embodiments, the heater may be positioned further into the aerosol generation chamber d280, e.g., it is spaced from the chamber outlet d282, in order to reduce the amount of turbulence in the vicinity of the heater.

Referring to FIGS. 26A and 26B, the passage d270 further comprises a flow converging portion d284 downstream of the chamber outlet d282. In the illustrated embodiment, the flow converging portion d284 comprises a funnel or a tapered section for gradually merging the aerosol and the air flow. For example, the flow converging portion d284 may resemble an extractor hood where suction of a user puff may draw in aerosol from the aerosol generation chamber d280 and an air flow through the passage d270. Such arrangement may help minimizing the turbulence when the two streams are merged and thereby it may allow aerosol to be formed with larger droplet sizes. During the user puff, the aerosol is discharged with the air flow along the passage d270 and through the outlet d274.

With the absence of, or much reduced, air flow in the aerosol generation chamber, the aerosol as generated by the illustrated embodiment has droplet size d50 of at least 1 μm. Preferably, the aerosol as generated by the illustrated embodiment has a median droplet size d50 ranging from 2 μm to 3 μm.

Figure 27A:
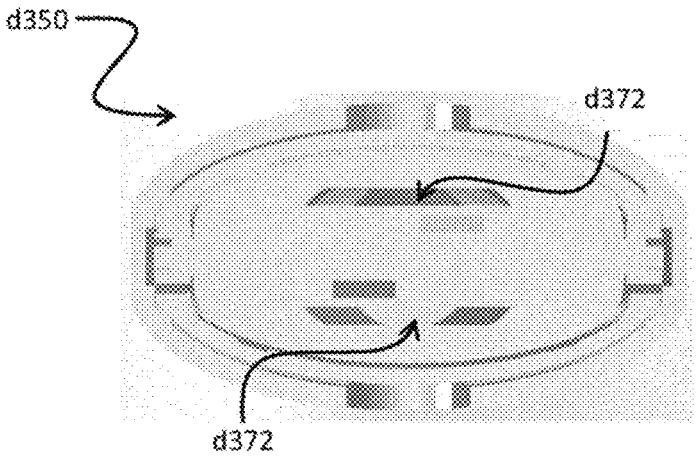
FIG. 27A is a plan view of a base of a smoking substitute apparatus of a second embodiment of Development D.
Figure 27B:
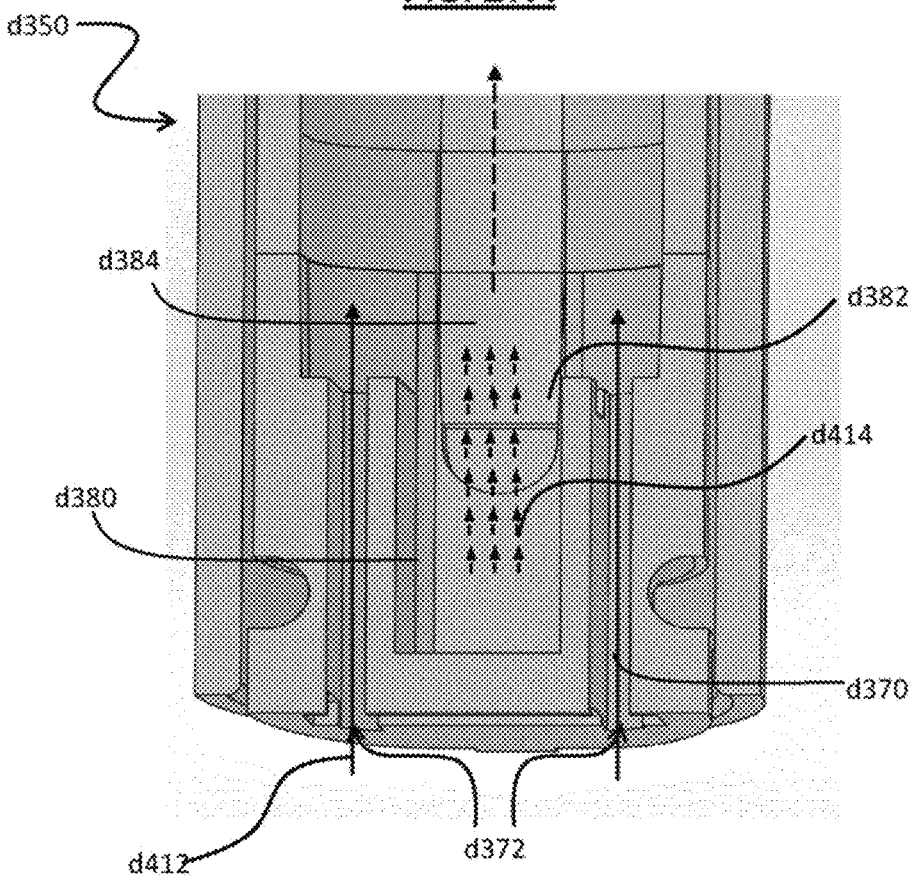
FIG. 27B is an enlarged schematic perspective cross sectional view of the smoking substitute apparatus of the second embodiment of Development D.

FIGS. 27A and 27B respectively illustrates a plan view and a perspective cross sectional view of a consumable d350 according to a second embodiment of the present disclosure. In order to illustrate the internal structure of the consumable d350 more clearly, the heater and its electrical connections are not shown but nevertheless present. The consumable d350 comprises a pair of air inlets d372 that open across the base of consumable d350. The air inlets d372 each leads to a respective passage d370 that extend along the external sidewalls of the aerosol generation chamber d380. In this embodiment, the passages d370 do not form an annulus but instead the passages d370 are two discrete passages d370 provided on either sides of the aerosol generation chamber d380. In other words, the aerosol generation chamber d380 is separated from the passages d370 by a pair of partition walls, or side walls of aerosol generation chamber d380. Such arrangement may allow a more compact apparatus to be formed. The passages d370 merges into a single passage d370 once the passages d370 have extended beyond the chamber outlet d382. That is, a flow converging portion d384 is provided in the passage immediately downstream of the chamber outlet d382. The flow converging portion d384 in the illustrated embodiment does not comprise a tapering section. Instead, the flow converging portion d384 comprises an enlarged chamber. That is, as the air flow and aerosol progresses along their respective flow paths d412, d414, the combined cross sectional area increases as they converge downstream of the chamber outlet d382.

The experimental work reported below has relevance to the embodiments described above in particular in view of the effect of the conditions at the wick brought about by the inlet arrangements in the embodiments. Such inlet arrangements affect the velocity of air flow close to the wick and also affect the cooling rate experienced by vapor emitted from the wick.

EXAMPLES

There now follows a disclosure of certain examples of experimental work undertaken to determine the effects of certain conditions in the smoking substitute apparatus on the particle size of the generated aerosol. However, the present disclosure is to be understood to not be limited in its application to the specific experimentation, results, and laboratory procedures disclosed herein after. Rather, the Examples are simply provided as one of various embodiments and are meant to be exemplary, not exhaustive.

Introduction

Aerosol droplet size is a considered to be an important characteristic for smoking substitution devices. Droplets in the range of 2-5 μm are preferred in order to achieve improved nicotine delivery efficiency and to minimize the hazard of second-hand smoking. However, at the time of writing (September 2019), commercial EVP devices typically deliver aerosols with droplet size averaged around 0.5 μm, and to the knowledge of the inventors not a single commercially available device can deliver an aerosol with an average particle size exceeding 1 μm.

The present inventors speculate, without themselves wishing to be bound by theory, that there has to date been a lack of understanding in the mechanisms of e-liquid evaporation, nucleation and droplet growth in the context of aerosol generation in smoking substitute devices. The present inventors have therefore studied these issues in order to provide insight into mechanisms for the generation of aerosols with larger particles. The present inventors have carried out experimental and modelling work alongside theoretical investigations, leading to significant achievements as now reported.

This disclosure considers the roles of air velocity, air turbulence and vapor cooling rate in affecting aerosol particle size.

Experiments

In the following examples, a Malvern PaNalytical Spraytec laser diffraction system was employed for the particle size measurement. In order to limit the number of variables, the same coil and wick (1.5 ohms Ni—Cr coil, 1.8 mm Y07 cotton wick), the same e-liquid (1.6% freebase nicotine, 65:35 propylene glycol (PG)/vegetable glycerin (VG) ratio, no added flavor) and the same input power (10 W) were used in all experiments. Y07 represents the grade of cotton wick, meaning that the cotton has a linear density of 0.7 grams per meter.

Particle sizes were measured in accordance with ISO 13320:2009(E), which is an international standard on laser diffraction methods for particle size analysis. This is particularly well suited to aerosols, because there is an assumption in this standard that the particles are spherical (which is a good assumption for liquid-based aerosols). The standard is stated to be suitable for particle sizes in the range 0.1 micron to 3 mm.

The results presented here concentrate on the volume-based median particle size Dv50. This is to be taken to be the same as the parameter d50 used above.

First Example: Rectangular Tube Testing

Figure 1:
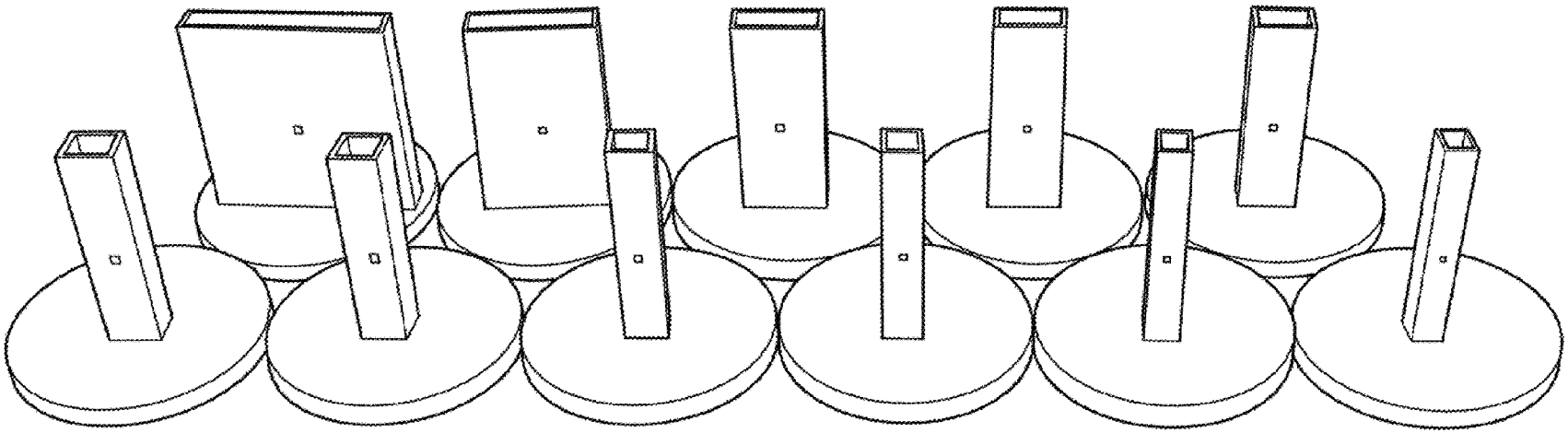
FIG. 1 illustrates a set of rectangular tubes for use in experiments to assess the effect of flow and cooling conditions at the wick on aerosol properties. Each tube has the same depth and length but different width.

The work of a first example reported here based on the inventors' insight that aerosol particle size might be related to: 1) air velocity; 2) flow rate; and 3) Reynolds number. In a given EVP device, these three parameters are inter-linked to each other, making it difficult to draw conclusions on the roles of each individual factor. In order to decouple these factors, experiments of a first example were carried out using a set of rectangular tubes having different dimensions. These were manufactured by 3D printing. The rectangular tubes were 3D printed in an MJP 2500 3D printer. FIG. 1 illustrates the set of rectangular tubes. Each tube has the same depth and length but different width. Each tube has an integral end plate in order to provide a seal against air flow outside the tube. Each tube also has holes formed in opposing side walls in order to accommodate a wick.

Figure 2:
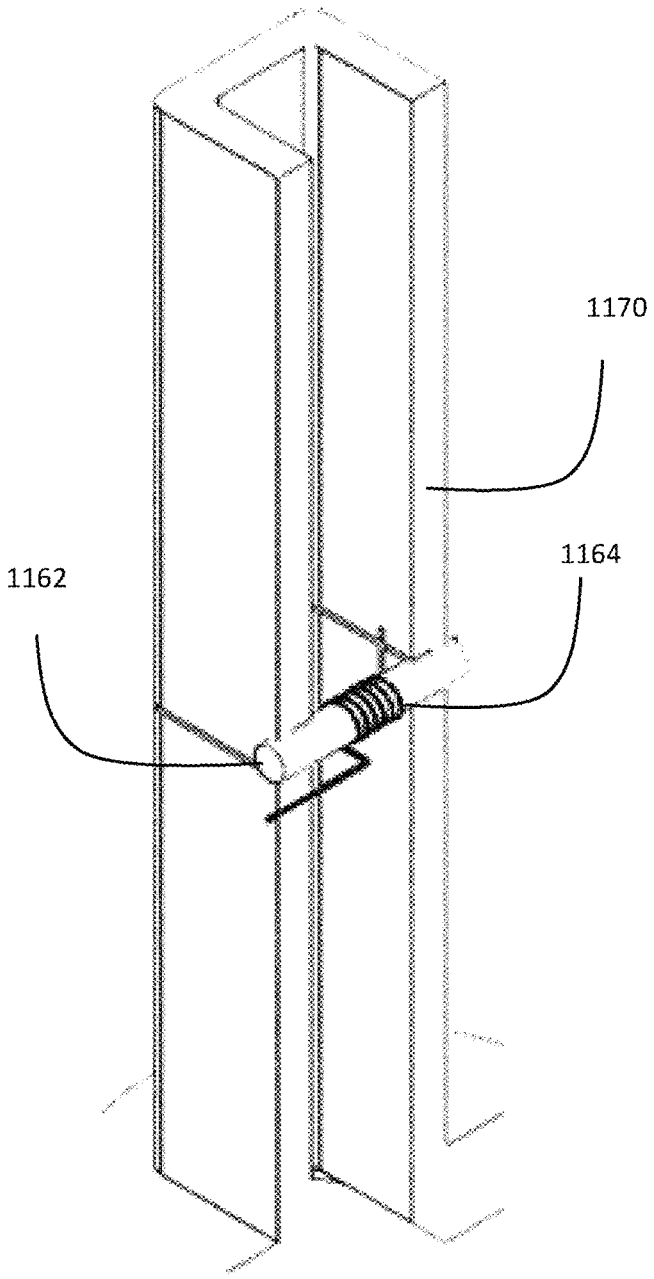
FIG. 2 shows a schematic perspective longitudinal cross sectional view of an example rectangular tube with a wick and heater coil installed.

FIG. 2 shows a schematic perspective longitudinal cross sectional view of an example rectangular tube 1170 with a wick 1162 and heater coil 1164 installed. The location of the wick is about half way along the length of the tube. This is intended to allow the flow of air along the tube to settle before reaching the wick.

FIG. 3 shows a schematic transverse cross sectional view an example rectangular tube 1170 with a wick 1162 and heater coil 1164 installed. In this example, the internal width of the tube is 12 mm.

The rectangular tubes were manufactured to have same internal depth of 6 mm in order to accommodate the standardized coil and wick, however the tube internal width varied from 4.5 mm to 50 mm. In this disclosure, the "tube size" is referred to as the internal width of rectangular tubes.

The rectangular tubes with different dimensions were used to generate aerosols that were tested for particle size in a Malvern PaNalytical Spraytec laser diffraction system. An external digital power supply was dialed to 2.6 A constant current to supply 10 W power to the heater coil in all experiments. Between two runs, the wick was saturated manually by applying one drop of e-liquid on each side of the wick.

Three groups of experiments were carried out in this study of a first example:

1. 1.3 lpm (liters per minute, L $min^{-1}$ or LPM) constant flow rate on different size tubes
2. 2.0 lpm constant flow rate on different size tubes
3. 1 m/s constant air velocity on 3 tubes: i) 5 mm tube at 1.4 lpm flow rate; ii) 8 mm tube at 2.8 lpm flow rate; and iii) 20 mm tube at 8.6 lpm flow rate.

Table 1 shows a list of experiments of a first example. The values in "calculated air velocity" column were obtained by simply dividing the flow rate by the intersection area at the center plane of wick. Reynolds numbers (Re) were calculated through the following equation:

$$Re = \frac{\rho v L}{\mu},$$

where: ρ is the density of air (1.225 $kg/m^3$); v is the calculated air velocity in table 1; μ is the viscosity of air ($1.48\times10^{-5}$ $m^2/s$); L is the characteristic length calculated by:

$$L = \frac{4P}{A},$$

where: P is the perimeter of the flow path's intersection, and A is the area of the flow path's intersection.

TABLE 1

List of experiments in the rectangular tube study

| | Tube size [mm] | Flow rate [lpm] | Reynolds number | Calculated air velocity [m/s] |
|---|---|---|---|---|
| 1.3 lpm constant flow rate | 4.5 | 1.3 | 153 | 1.17 |
| | 6 | 1.3 | 142 | 0.71 |
| | 7 | 1.3 | 136 | 0.56 |
| | 8 | 1.3 | 130 | 0.47 |
| | 10 | 1.3 | 120 | 0.35 |
| | 12 | 1.3 | 111 | 0.28 |
| | 20 | 1.3 | 86 | 0.15 |
| | 50 | 1.3 | 47 | 0.06 |
| 2.0 lpm constant flow rate | 4.5 | 2.0 | 236 | 1.81 |
| | 5 | 2.0 | 230 | 1.48 |
| | 6 | 2.0 | 219 | 1.09 |
| | 8 | 2.0 | 200 | 0.72 |
| | 12 | 2.0 | 171 | 0.42 |
| | 20 | 2.0 | 132 | 0.23 |
| | 50 | 2.0 | 72 | 0.09 |
| 1.0 m/s constant air velocity | 5.0 | 1.4 | 155 | 1.00 |
| | 8 | 2.8 | 279 | 1.00 |
| | 20 | 8.6 | 566 | 1.00 |

Five repetition runs were carried out for each tube size and flow rate combination. Between adjacent runs there were at least 5 minutes wait time for the Spraytec system to be purged. In each run, real time particle size distributions were measured in the Spraytec laser diffraction system at a sampling rate of 2500 per second, the volume distribution median (Dv50) was averaged over a puff duration of 4 seconds. Measurement results were averaged and the standard deviations were calculated to indicate errors as shown in section 4 below.

Second Example: Turbulence Tube Testing

The Reynolds numbers in Table 1 are all well below 1000, therefore, it is considered fair to assume all the experiments of a first example would be under conditions of laminar flow. Further experiments (of a second example) were carried out and reported in this section to investigate the role of turbulence.

Turbulence intensity was introduced as a quantitative parameter to assess the level of turbulence. The definition and simulation of turbulence intensity is discussed below.

Different device designs were considered in order to introduce turbulence. In the experiments of the second example reported here, jetting panels were added in the existing 12 mm rectangular tubes upstream of the wick. This approach enables direct comparison between different devices as they all have highly similar geometry, with turbulence intensity being the only variable.

Figure 4A:
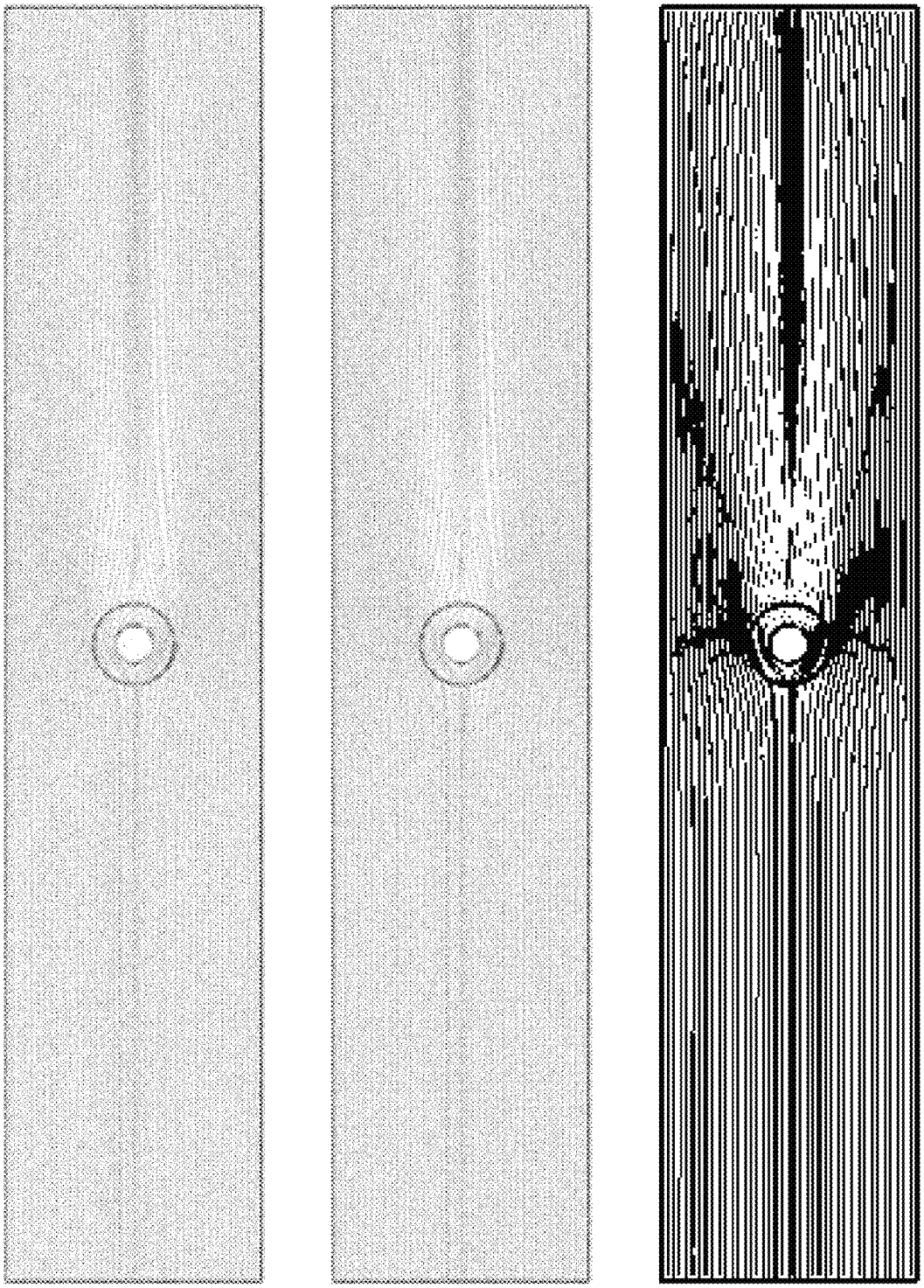
FIGS. 4A-4D show air flow streamlines in the four devices used in a turbulence study.
Figure 4B:
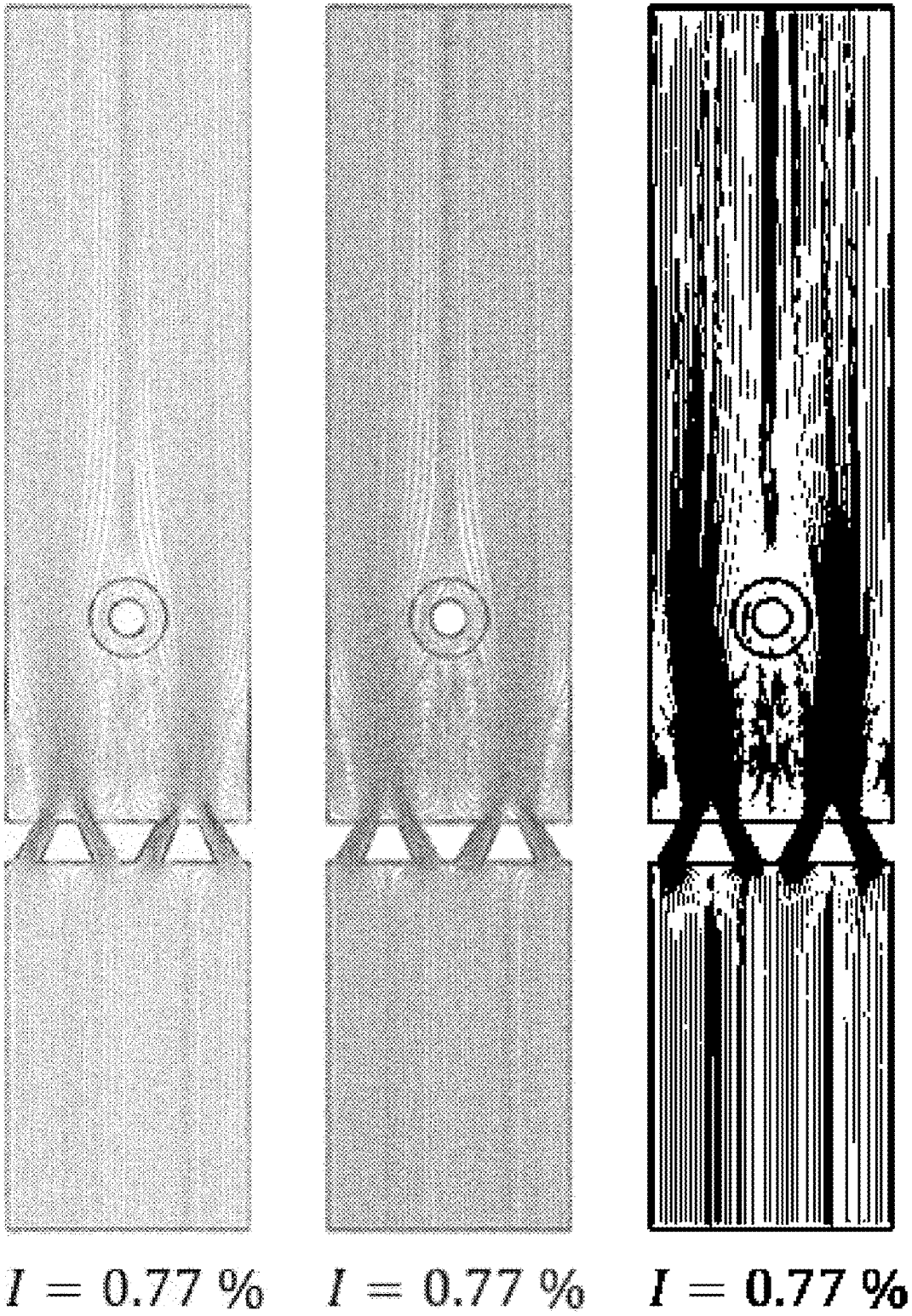
Figure 4C:
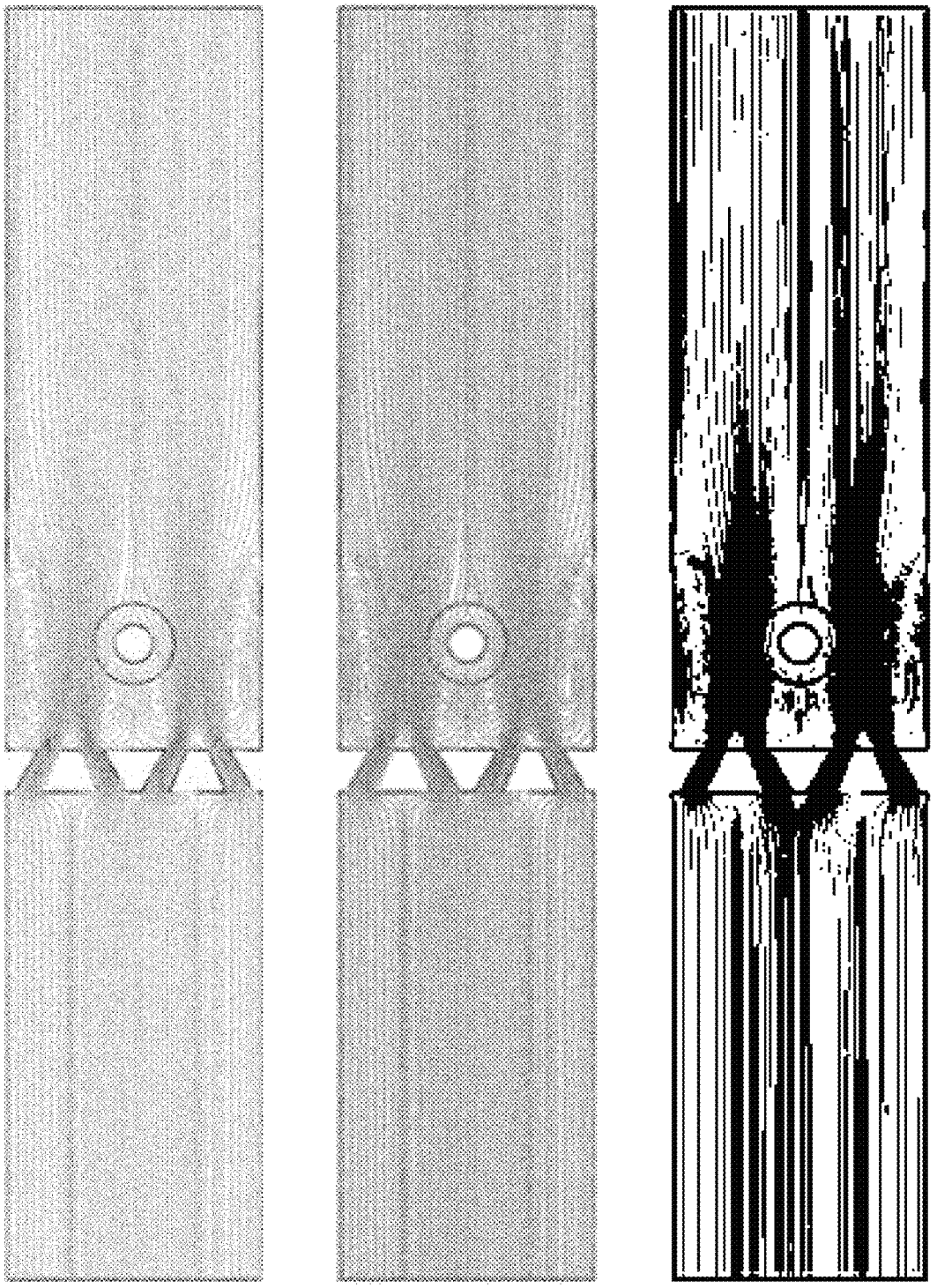
Figure 4D:
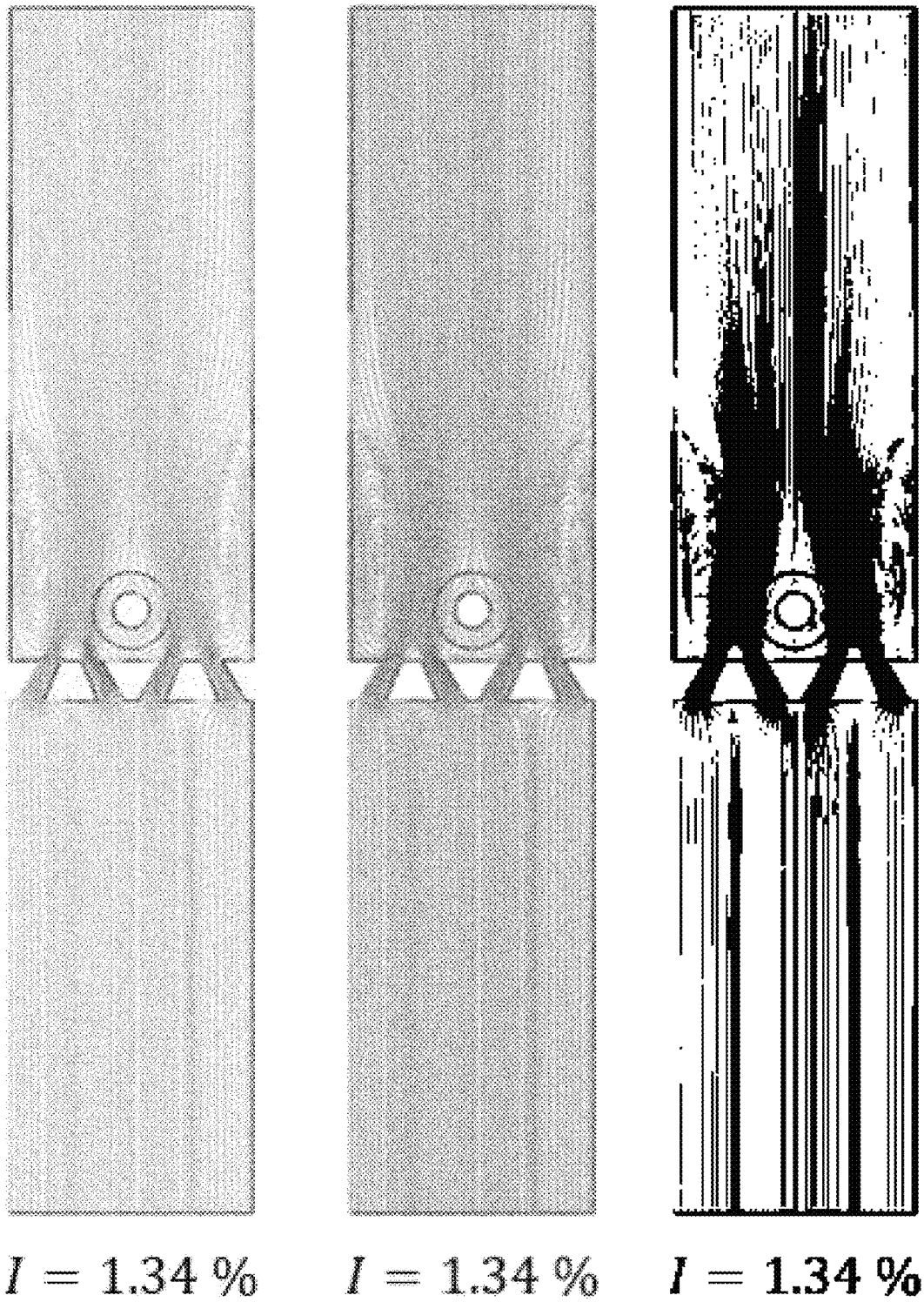

FIGS. 4A-4D show air flow streamlines in the four devices used in this turbulence study of the second example. FIG. 4A is a standard 12 mm rectangular tube with wick and coil installed as explained previously, with no jetting panel. FIG. 4B has a jetting panel located 10 mm below (upstream from) the wick. FIG. 4C has the same jetting panel 5 mm below the wick. FIG. 4D has the same jetting panel 2.5 mm below the wick. As can be seen from FIGS. 4B-4D, the jetting panel has an arrangement of apertures shaped and directed in order to promote jetting from the downstream face of the panel and therefore to promote turbulent flow. Accordingly, the jetting panel can introduce turbulence downstream, and the panel causes higher level of turbulence near the wick when it is positioned closer to the wick. As shown in FIGS. 4A-4D, the four geometries gave turbulence intensities of 0.55%, 0.77%, 1.06% and 1.34%, respectively, with FIG. 4A being the least turbulent, and FIG. 4D being the most turbulent.

For each of FIGS. 4A-4D, there are shown three modelling images. The image on the left shows the original image (color in the original), the central image shows a greyscale version of the image and the right hand image shows a black and white version of the image. As will be appreciated, each version of the image highlights slightly different features of the flow. Together, they give a reasonable picture of the flow conditions at the wick.

These four devices were operated to generate aerosols following the procedure explained above (the first example) using a flow rate of 1.3 lpm and the generated aerosols were tested for particle size in the Spraytec laser diffraction system.

Third Example: High Temperature Testing

This experiment of a third example aimed to investigate the influence of inflow air temperature on aerosol particle size, in order to investigate the effect of vapor cooling rate on aerosol generation.

Figure 5:
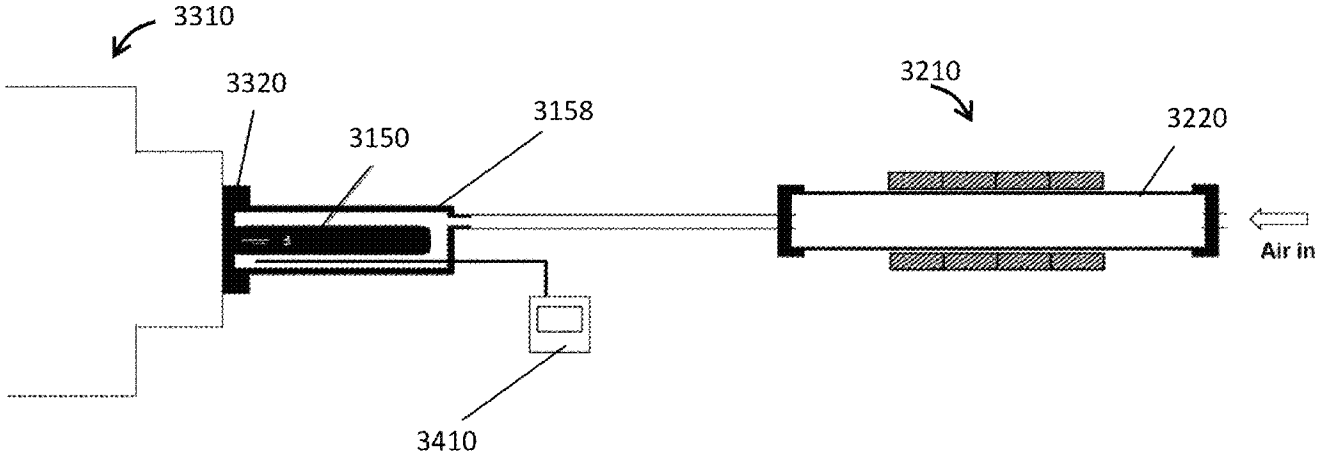
FIG. 5 shows the experimental set up to investigate the influence of inflow air temperature on aerosol particle size, in order to investigate the effect of vapor cooling rate on aerosol generation.

The experimental set up of the third example is shown in FIG. 5. The testing used a Carbolite Gero EHA 12300B tube furnace 3210 with a quartz tube 3220 to heat up the air. Hot air in the tube furnace was then led into a transparent housing 3158 that contains the EVP device 3150 to be tested. A thermocouple meter 3410 was used to assess the temperature of the air pulled into the EVP device. Once the EVP device was activated, the aerosol was pulled into the Spraytec laser diffraction system 3310 via a silicone connector 3320 for particle size measurement.

Figure 7:
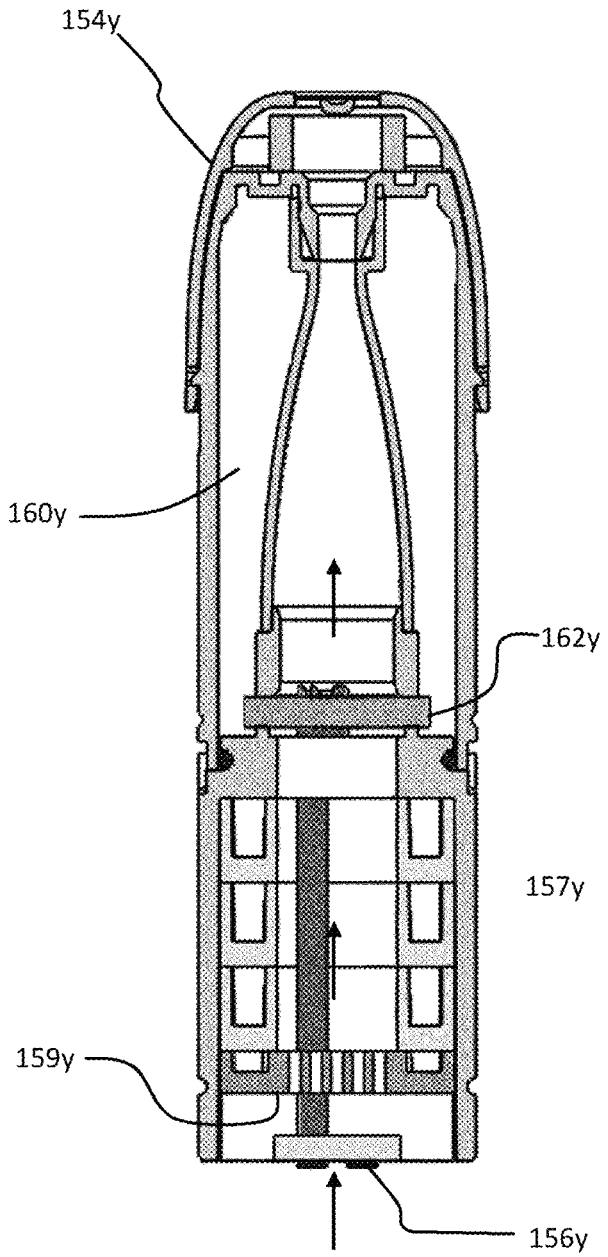
FIG. 7 shows a schematic longitudinal cross sectional view of a second smoking substitute apparatus (pod 2) used to assess influence of inflow air temperature on aerosol particle size.
Figure 8A:
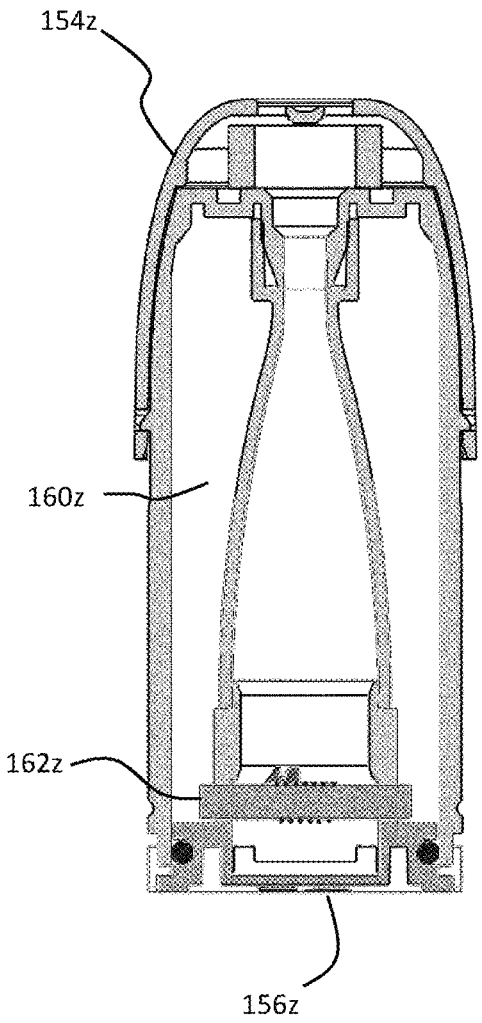
FIG. 8A shows a schematic longitudinal cross sectional view of a third smoking substitute apparatus (pod 3) used to assess influence of inflow air temperature on aerosol particle size.
Figure 8B:
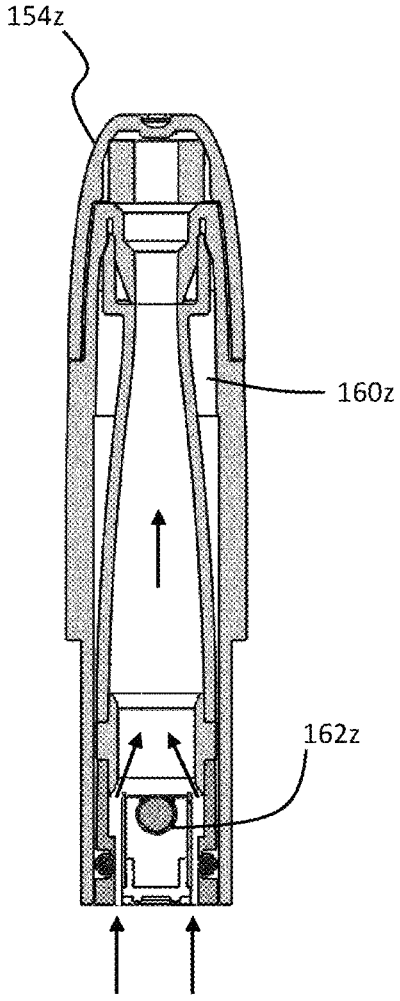
FIG. 8B shows a schematic longitudinal cross sectional view of the same third smoking substitute apparatus (pod 3) in a direction orthogonal to the view taken in FIG. 8A.

Three smoking substitute apparatuses (referred to as "pods") were tested in the study: pod 1 is the commercially available "myblu optimised" pod (FIG. 6); pod 2 is a pod featuring an extended inflow path upstream of the wick (FIG. 7); and pod 3 is pod with the wick located in a stagnant vaporization chamber and the inlet air bypassing the vaporization chamber but entraining the vapor from an outlet of the vaporization chamber (FIGS. 8A and 8B).

Figure 6:
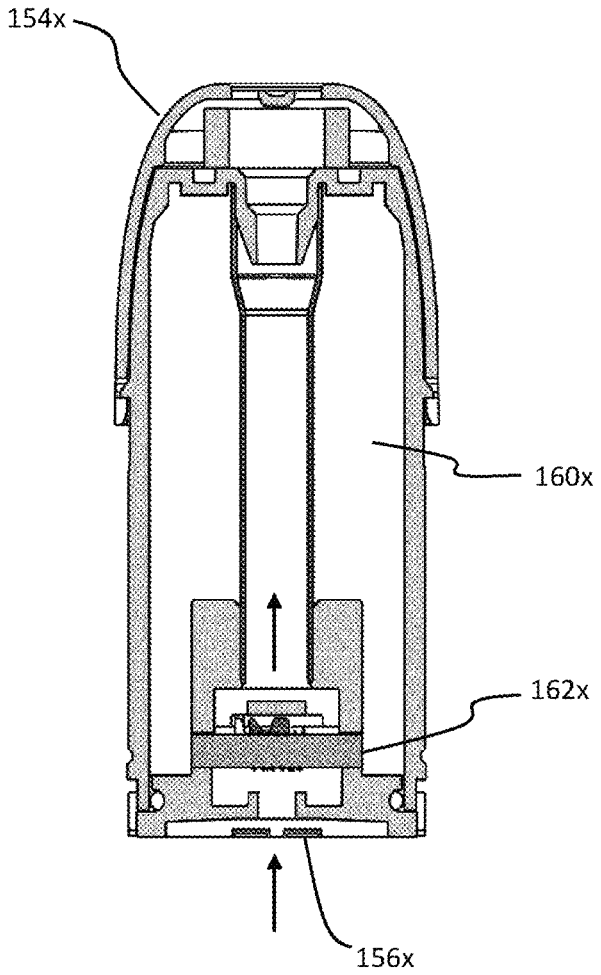
FIG. 6 shows a schematic longitudinal cross sectional view of a first smoking substitute apparatus (pod 1) used to assess influence of inflow air temperature on aerosol particle size.

Pod 1, shown in longitudinal cross sectional view (in the width plane) in FIG. 6, has a main housing that defines a tank 160*x* holding an e-liquid aerosol precursor. Mouthpiece 154*x* is formed at the upper part of the pod. Electrical contacts 156*x* are formed at the lower end of the pod. Wick 162*x* is held in a vaporization chamber. The air flow direction is shown using arrows.

Pod 2, shown in longitudinal cross sectional view (in the width plane) in FIG. 7, has a main housing that defines a tank 160*y* holding an e-liquid aerosol precursor. Mouthpiece 154*y* is formed at the upper part of the pod. Electrical contacts 156*y* are formed at the lower end of the pod. Wick 162*y* is held in a vaporization chamber. The air flow direction is shown using arrows. Pod 2 has an extended inflow path (plenum chamber 157*y*) with a flow conditioning element 159*y*, configured to promote reduced turbulence at the wick 162*y*.

FIG. 8A shows a schematic longitudinal cross sectional view of pod 3. FIG. 8B shows a schematic longitudinal cross sectional view of the same pod 3 in a direction orthogonal to the view taken in FIG. 8A. Pod 3 has a main housing that defines a tank 160*z* holding an e-liquid aerosol precursor. Mouthpiece 154*z* is formed at the upper part of the pod. Electrical contacts 156*z* are formed at the lower end of the pod. Wick 162*z* is held in a vaporization chamber. The air flow direction is shown using arrows. Pod 3 uses a stagnant vaporizer chamber, with the air inlets bypassing the wick and picking up the vapor/aerosol downstream of the wick.

All three pods were filled with the same e-liquid (1.6% freebase nicotine, 65:35 PG/VG ratio, no added flavor). Three experiments of the third example were carried out for each pod: 1) standard measurement in ambient temperature; 2) only the inlet air was heated to 50° C.; and 3) both the inlet air and the pods were heated to 50° C. Five repetition runs were carried out for each experiment and the Dv50 results were taken and averaged.

Modelling Work

In the following examples, modelling work was performed using COMSOL Multiphysics 5.4, engaged physics include: 1) laminar single-phase flow; 2) turbulent single-phase flow; 3) laminar two-phase flow; 4) heat transfer in fluids; and (5) particle tracing. Data analysis and data visualization were mostly completed in MATLAB R2019a.

Fourth Example: Velocity Modelling

Air velocity in the vicinity of the wick is believed to play an important role in affecting particle size. In the first example, the air velocity was calculated by dividing the flow rate by the intersection area, which is referred to as "calculated velocity" in a fourth example. This involves a very crude simplification that assumes velocity distribution to be homogeneous across the intersection area.

In order to increase reliability of the fourth example, computational fluid dynamics (CFD) modelling was performed to obtain more accurate velocity values:

1) The average velocity in the vicinity of the wick (defined as a volume from the wick surface to 1 mm away from the wick surface)
2) The maximum velocity in the vicinity of the wick (defined as a volume from the wick surface to 1 mm away from the wick surface)

TABLE 2

Average and maximum velocity in the vicinity of wick surface obtained from CFD modelling.

| | Tube size [mm] | Flow rate [lpm] | Calculated velocity* [m/s] | Average velocity** [m/s] | Maximum Velocity** [m/s] |
|---|---|---|---|---|---|
| 1.3 lpm constant flow rate | 4.5 | 1.3 | 1.17 | 0.99 | 1.80 |
| | 6 | 1.3 | 0.71 | 0.66 | 1.22 |
| | 7 | 1.3 | 0.56 | 0.54 | 1.01 |
| | 8 | 1.3 | 0.47 | 0.46 | 0.86 |
| | 10 | 1.3 | 0.35 | 0.35 | 0.66 |
| | 12 | 1.3 | 0.28 | 0.27 | 0.54 |
| | 20 | 1.3 | 0.15 | 0.15 | 0.32 |
| | 50 | 1.3 | 0.06 | 0.05 | 0.12 |
| 2.0 lpm constant flow rate | 4.5 | 2.0 | 1.81 | 1.52 | 2.73 |
| | 5 | 2.0 | 1.48 | 1.31 | 2.39 |
| | 6 | 2.0 | 1.09 | 1.02 | 1.87 |
| | 8 | 2.0 | 0.72 | 0.71 | 1.31 |
| | 12 | 2.0 | 0.42 | 0.44 | 0.83 |
| | 20 | 2.0 | 0.23 | 0.24 | 0.49 |
| | 50 | 2.0 | 0.09 | 0.08 | 0.19 |

*Calculated by dividing flow rate with intersection area

**Obtained from CFD modelling

The CFD model uses a laminar single-phase flow setup. For each experiment, the outlet was configured to a corresponding flowrate, the inlet was configured to be pressure-controlled, the wall conditions were set as "no slip". A 1 mm wide ring-shaped domain (wick vicinity) was created around the wick surface, and domain probes were implemented to assess the average and maximum magnitudes of velocity in this ring-shaped wick vicinity domain.

The CFD model of the fourth example outputs the average velocity and maximum velocity in the vicinity of the wick for each set of experiments carried out in the first example. The outcomes are reported in Table 2.

Fifth Example: Turbulence Modelling

Turbulence intensity (I) is a quantitative value that represents the level of turbulence in a fluid flow system. It is defined as the ratio between the root-mean-square of velocity fluctuations, u', and the Reynolds-averaged mean flow velocity, U:

$$1 = \frac{u'}{U} = \frac{\sqrt{\frac{1}{3}(u_x'^2 + u_y'^2 + u_z'^2)}}{\sqrt{\overline{u_x}^2 + \overline{u_y}^2 + \overline{u_z}^2}} = \frac{\sqrt{\frac{1}{3}[(u_x - \overline{u_x})^2 + (u_y - \overline{u_y})^2 + +(u_z - \overline{u_z})^2]}}{\sqrt{\overline{u_x}^2 + \overline{u_y}^2 + \overline{u_z}^2}},$$

where $u_x$, $u_y$ and $u_z$ are the x-, y- and z-components of the velocity vector, $\overline{u_x}$, $\overline{u_y}$, and $\overline{u_z}$ represent the average velocities along three directions.

Higher turbulence intensity values represent higher levels of turbulence. As a rule of thumb, turbulence intensity below 1% represents a low-turbulence case, turbulence intensity between 1% and 5% represents a medium-turbulence case, and turbulence intensity above 5% represents a high-turbulence case.

In a fifth example, turbulence intensity was obtained from CFD simulation using turbulent single-phase setup in COMSOL Multiphysics. For each of the four experiments explained in the second example, above, the outlet was set to 1.3 lpm, the inlet was set to be pressure-controlled, and all wall conditions were set to be "no slip".

Turbulence intensity of the fifth example was assessed within the volume up to 1 mm away from the wick surface (defined as the wick vicinity domain). For the four experiments explained in the second example, the turbulence intensities are 0.55%, 0.77%, 1.06% and 1.34%, respectively, as also shown in FIGS. 4A-4D.

Sixth Example: Cooling Rate Modelling

The cooling rate modelling of the sixth example involves three coupling models in COMSOL Multiphysics: 1) laminar two-phase flow; 2) heat transfer in fluids, and 3) particle tracing. The model is setup in three steps:

(1) Set Up Two Phase Flow Model

Laminar mixture flow physics was selected for the sixth example. The outlet was configured in the same way as in the fourth example. However, this model of the sixth example includes two fluid phases released from two separate inlets: the first one is the vapor released from wick surface, at an initial velocity of 2.84 cm/s (calculated based on 5 mg total particulate mass over 3 seconds puff duration) with initial velocity direction normal to the wick surface; the second inlet is air influx from the base of tube, the rate of which is pressure-controlled.

(2) Set Up Two-Way Coupling with Heat Transfer Physics

The inflow and outflow settings in heat transfer physics was configured in the same way as in the two-phase flow model. The air inflow was set to 25° C., and the vapor inflow was set to 209° C. (boiling temperature of the e-liquid formulation). In the end, the heat transfer physics is configured to be two-way coupled with the laminar mixture flow physics. The above model reaches steady state after approximately 0.2 second with a step size of 0.001 second.

(3) Set Up Particle Tracing

A wave of 2000 particles were release from wick surface at t=0.3 second after the two-phase flow and heat transfer model has stabilized. The particle tracing physics has one-way coupling with the previous model, which means the fluid flow exerts dragging force on the particles, whereas the particles do not exert counterforce on the fluid flow. Therefore, the particles function as moving probes to output vapor temperature at each timestep.

The model of the sixth example outputs average vapor temperature at each time steps. A MATLAB script was then created to find the time step when the vapor cools to a target temperature (50° C. or 75° C.), based on which the vapor cooling rates were obtained (Table 3).

TABLE 3

Average vapor cooling rate obtained from Multiphysics modelling.

| | Tube size [mm] | Flow rate [lpm] | Cooling rate to 50° C. [° C./ms] | Cooling rate to 75° C. [° C./ms] |
|---|---|---|---|---|
| 1.3 lpm | 4.5 | 1.3 | 11.4 | 44.7 |
| constant | 6 | 1.3 | 5.48 | 14.9 |
| Flow rate | 7 | 1.3 | 3.46 | 7.88 |
| | 8 | 1.3 | 2.24 | 5.15 |
| | 10 | 1.3 | 1.31 | 2.85 |
| | 12 | 1.3 | 0.841 | 1.81 |
| | 20 | 1.3 | 0* | 0.536 |
| | 50 | 1.3 | 0 | 0 |
| 2.0 lpm | 4.5 | 2.0 | 19.9 | 670 |
| constant | 5 | 2.0 | 13.3 | 67 |
| Flow rate | 6 | 2.0 | 8.83 | 26.8 |
| | 8 | 2.0 | 3.61 | 8.93 |
| | 12 | 2.0 | 1.45 | 3.19 |
| | 20 | 2.0 | 0.395 | 0.761 |
| | 50 | 2.0 | 0 | 0 |

*Zero cooling rate when the average vapor temperature is still above target temperature after 0.5 second

Results and Discussions

Particle size measurement results for the rectangular tube testing example above (the first example) are shown in Table 4. For every tube size and flow rate combination, five repetition runs were carried out in the Spraytec laser diffraction system. The Dv50 values from five repetition runs were averaged, and the standard deviations were calculated to indicate errors, as shown in Table 4.

In this section, the roles of different factors affecting aerosol particle size will be discussed based on experimental and modelling results.

TABLE 4

Particle size measurement results for the rectangular tube testing.

| | Tube size [mm] | Flow rate [lpm] | Dv50 average [μm] | Dv50 standard deviation [μm] |
|---|---|---|---|---|
| 1.3 lpm constant Flow rate | 4.5 | 1.3 | 0.971 | 0.125 |
| | 6 | 1.3 | 1.697 | 0.341 |
| | 7 | 1.3 | 2.570 | 0.237 |
| | 8 | 1.3 | 2.705 | 0.207 |
| | 10 | 1.3 | 2.783 | 0.184 |
| | 12 | 1.3 | 3.051 | 0.325 |
| | 20 | 1.3 | 3.116 | 0.354 |
| | 50 | 1.3 | 3.161 | 0.157 |
| 2.0 lpm constant Flow rate | 4.5 | 2.0 | 0.568 | 0.039 |
| | 5 | 2.0 | 0.967 | 0.315 |
| | 6 | 2.0 | 1.541 | 0.272 |
| | 8 | 2.0 | 1.646 | 0.363 |
| | 12 | 2.0 | 3.062 | 0.153 |
| | 20 | 2.0 | 3.566 | 0.260 |
| | 50 | 2.0 | 3.082 | 0.440 |
| 1.0 m/s constant air velocity | 5.0 | 1.4 | 1.302 | 0.187 |
| | 8 | 2.8 | 1.303 | 0.468 |
| | 20 | 8.6 | 1.463 | 0.413 |

Seventh Example: Decouple the Factors Affecting Particle Size

Figure 9:
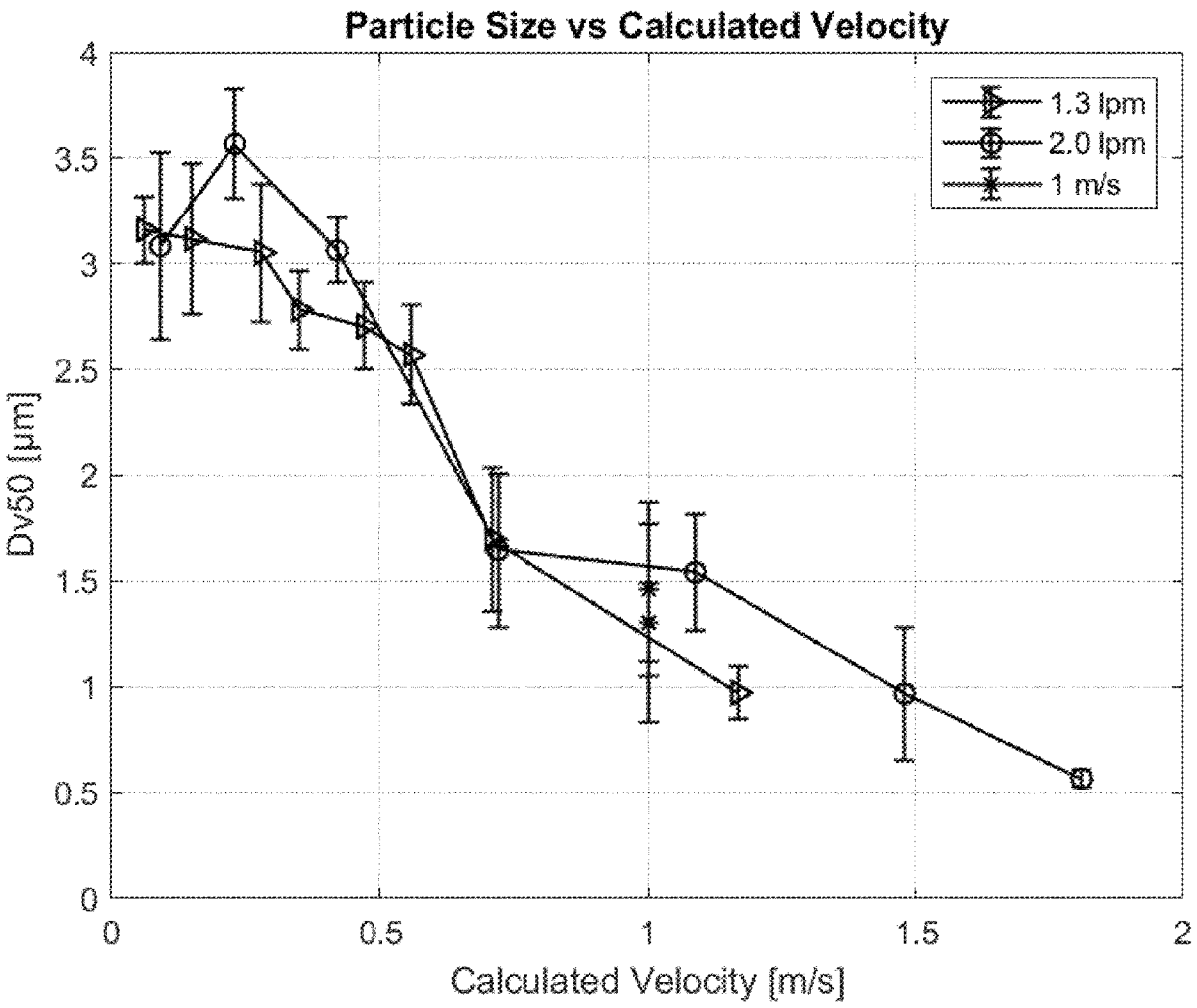
FIG. 9 shows a plot of aerosol particle size (Dv50) experimental results against calculated air velocity.

The particle size (Dv50) experimental results of a seventh example are plotted against calculated air velocity in FIG. 9. The graph shows a strong correlation between particle size and air velocity.

Different size tubes were tested at two flow Rates: 1.3 lpm and 2.0 lpm. Both groups of data show the same trend that slower air velocity leads to larger particle size. The conclusion was made more convincing by the fact that these two groups of data overlap well in FIG. 9: for example, the 6 mm tube delivered an average Dv50 of 1.697 μm when tested at 1.3 lpm flow rate, and the 8 mm tube delivered a highly similar average Dv50 of 1.646 μm when tested at 2.0 lpm flow rate, as they have similar air velocity of 0.71 and 0.72 m/s, respectively.

Figure 10:
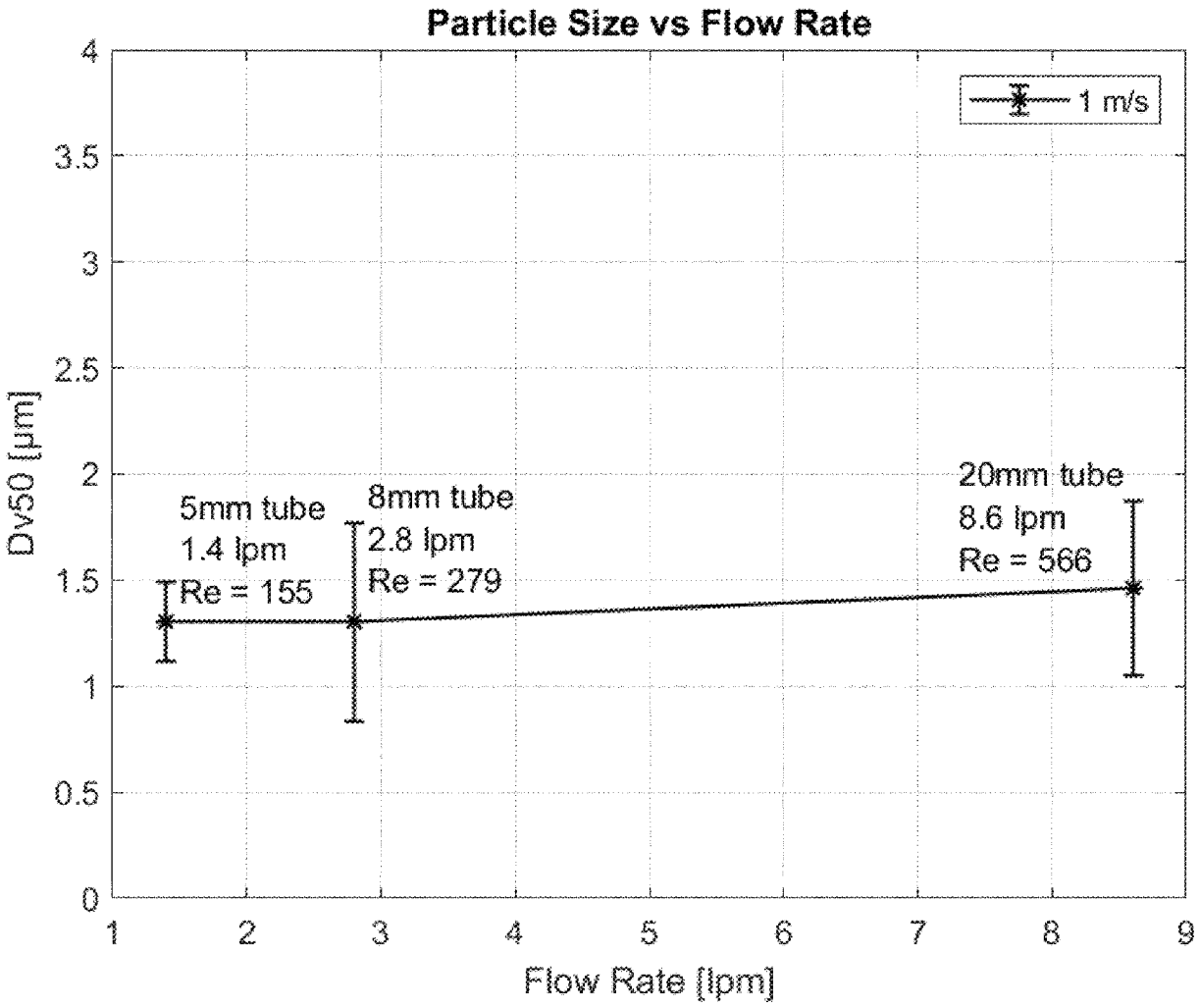
FIG. 10 shows a plot of aerosol particle size (Dv50) experimental results against the flow rate through the apparatus for a calculated air velocity of 1 m/s.

In addition, FIG. 10 shows the results of three experiments of the seventh example, with highly different setup arrangements: 1) 5 mm tube measured at 1.4 lpm flow rate with Reynolds number of 155; 2) 8 mm tube measured at 2.8 lpm flow rate with Reynolds number of 279; and 3) 20 mm tube measured at 8.6 lpm flow rate with Reynolds number of 566. It is relevant that these setup arrangements have one similarity: the air velocities are all calculated to be 1 m/s. FIG. 10 shows that, although these three sets of experiments have different tube sizes, flow rates and Reynolds numbers, they all delivered similar particle sizes, as the air velocity was kept constant. These three data points were also plotted out in FIG. 9 (1 m/s data with star marks) and they tie in nicely into particle size-air velocity trendline.

The above results of the seventh example lead to a strong conclusion that air velocity is an important factor affecting the particle size of EVP devices. Relatively large particles are generated when the air travels with slower velocity around the wick. It can also be concluded that flow rate, tube size and Reynolds number are not necessarily independently relevant to particle size, providing the air velocity is controlled in the vicinity of the wick.

Eighth Example: Further Consideration of Velocity

In FIG. 9 the "calculated velocity" was obtained by dividing the flow rate by the intersection area, which is a crude simplification that assumes a uniform velocity field. In order to increase reliability of the work, CFD modelling has been performed to assess the average and maximum velocities in the vicinity of the wick. In an eighth example, the "vicinity" was defined as a volume from the wick surface up to 1 mm away from the wick surface.

Figure 11:
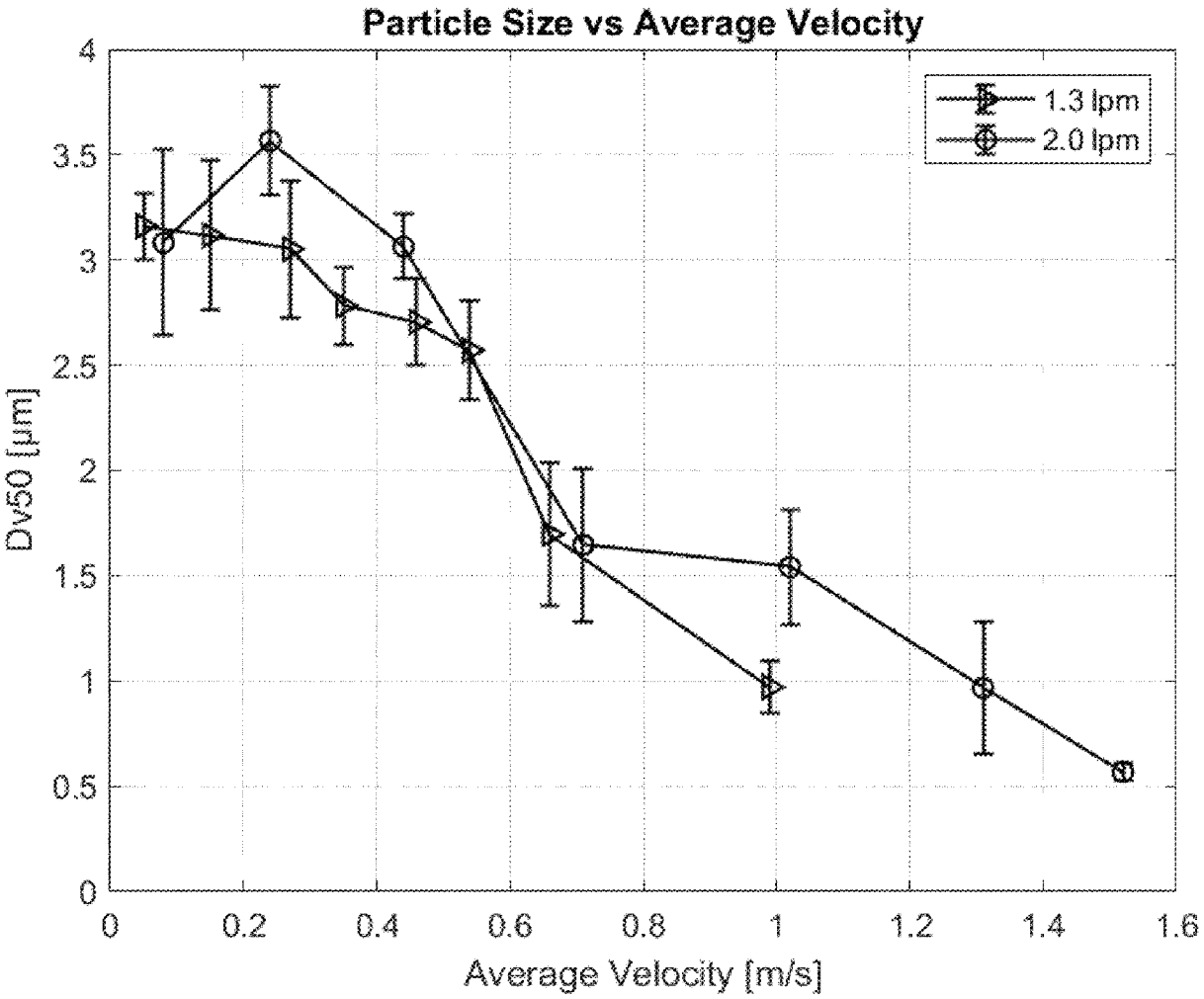
FIG. 11 shows a plot of aerosol particle size (Dv50) experimental results against the average magnitude of the velocity in the vaporizer surface region, as obtained from CFD modelling.
Figure 12:
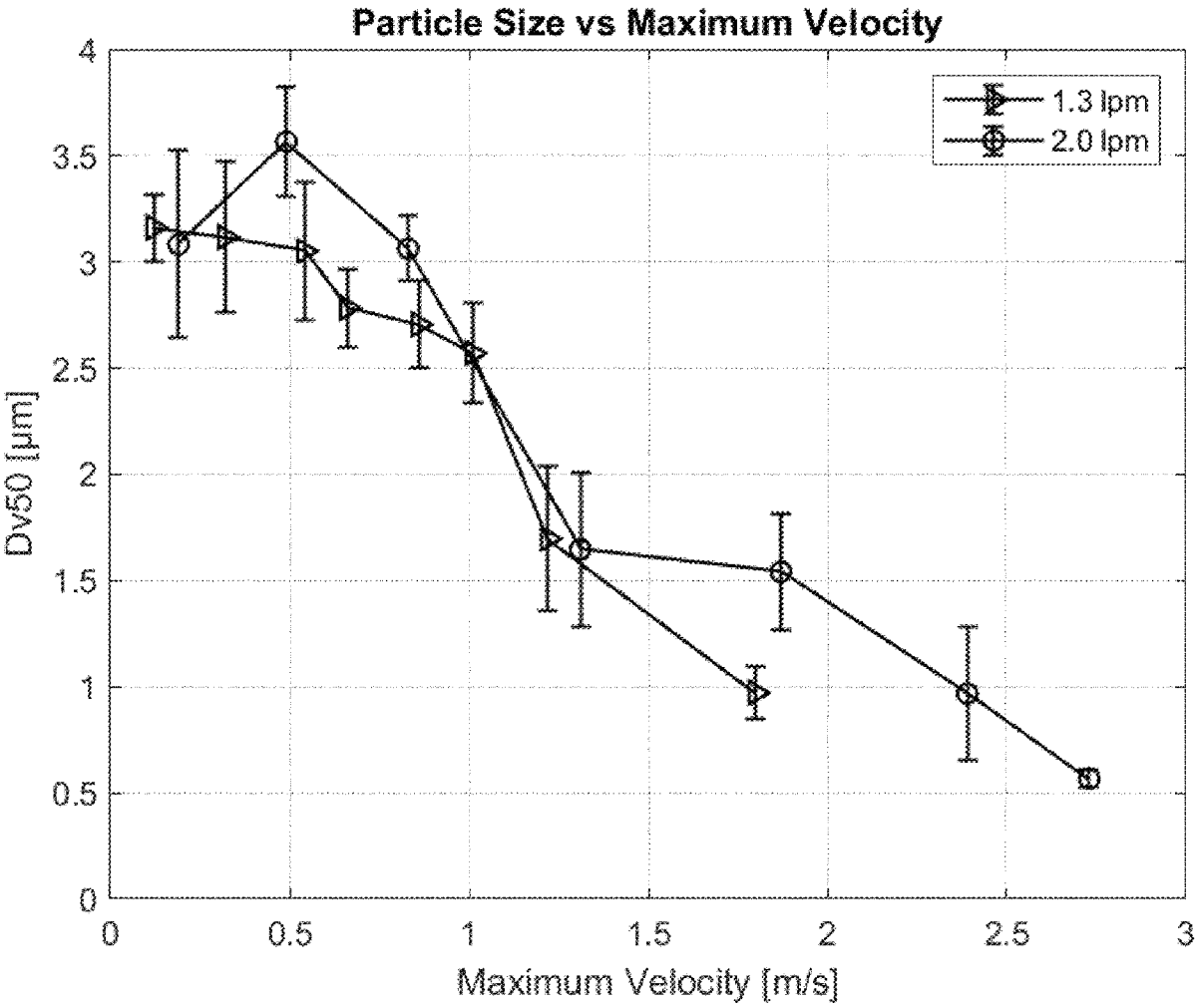
FIG. 12 shows a plot of aerosol particle size (Dv50) experimental results against the maximum magnitude of the velocity in the vaporizer surface region, as obtained from CFD modelling.

The particle size measurement data of the eighth example were plotted against the average velocity (FIG. 11) and maximum velocity (FIG. 12) in the vicinity of the wick, as obtained from CFD modelling.

The data in these two graphs indicates that in order to obtain an aerosol with Dv50 larger than 1 μm, the average velocity should be less than or equal to 1.2 m/s in the vicinity of the wick and the maximum velocity should be less than or equal to 2.0 m/s in the vicinity of the wick.

Furthermore, in order to obtain an aerosol with Dv50 of 2 μm or larger, the average velocity should be less than or equal to 0.6 m/s in the vicinity of the wick and the maximum velocity should be less than or equal to 1.2 m/s in the vicinity of the wick.

It is considered that typical commercial EVP devices deliver aerosols with Dv50 around 0.5 μm, and there is no commercially available device that can deliver aerosol with Dv50 exceeding 1 μm. It is considered that typical commercial EVP devices have average velocity of 1.5-2.0 m/s in the vicinity of the wick.

Ninth Example: The Role of Turbulence

The role of turbulence has been investigated in terms of turbulence intensity in a ninth example, which is a quantitative characteristic that indicates the level of turbulence. In the ninth example, four tubes of different turbulence intensities were used to general aerosols which were measured in the Spraytec laser diffraction system. The particle size (Dv50) experimental results of the ninth example are plotted against turbulence intensity in FIG. 13.

Figure 13:
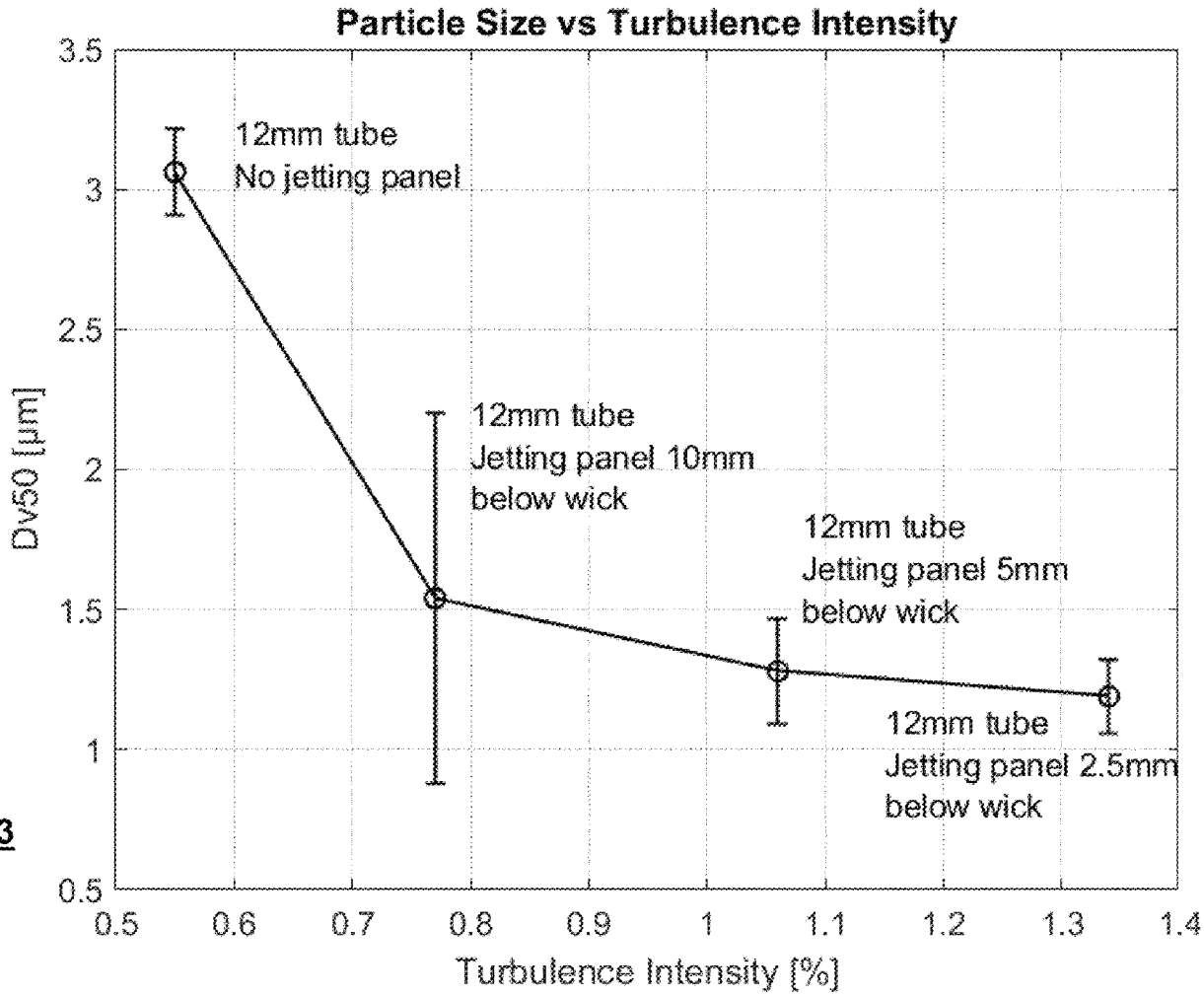
FIG. 13 shows a plot of aerosol particle size (Dv50) experimental results against the turbulence intensity.

The graph suggests a correlation between particle size and turbulence intensity, that lower turbulence intensity is beneficial for obtaining larger particle size. It is noted that when turbulence intensity is above 1% (medium-turbulence case), there are relatively large measurement fluctuations. In FIG. 13, the tube with a jetting panel 10 mm below the wick has the largest error bar, because air jets become unpredictable near the wick after traveling through a long distance.

The results of the ninth example clearly indicate that laminar air flow is favorable for the generation of aerosols with larger particles, and that the generation of large particle sizes is jeopardized by introducing turbulence. In FIG. 13, the 12 mm standard rectangular tube (without jetting panel) delivers above 3 μm particle size (Dv50). The particle size values reduced by at least a half when jetting panels were added to introduce turbulence.

Tenth Example: Vapor Cooling Rate

Figure 14:
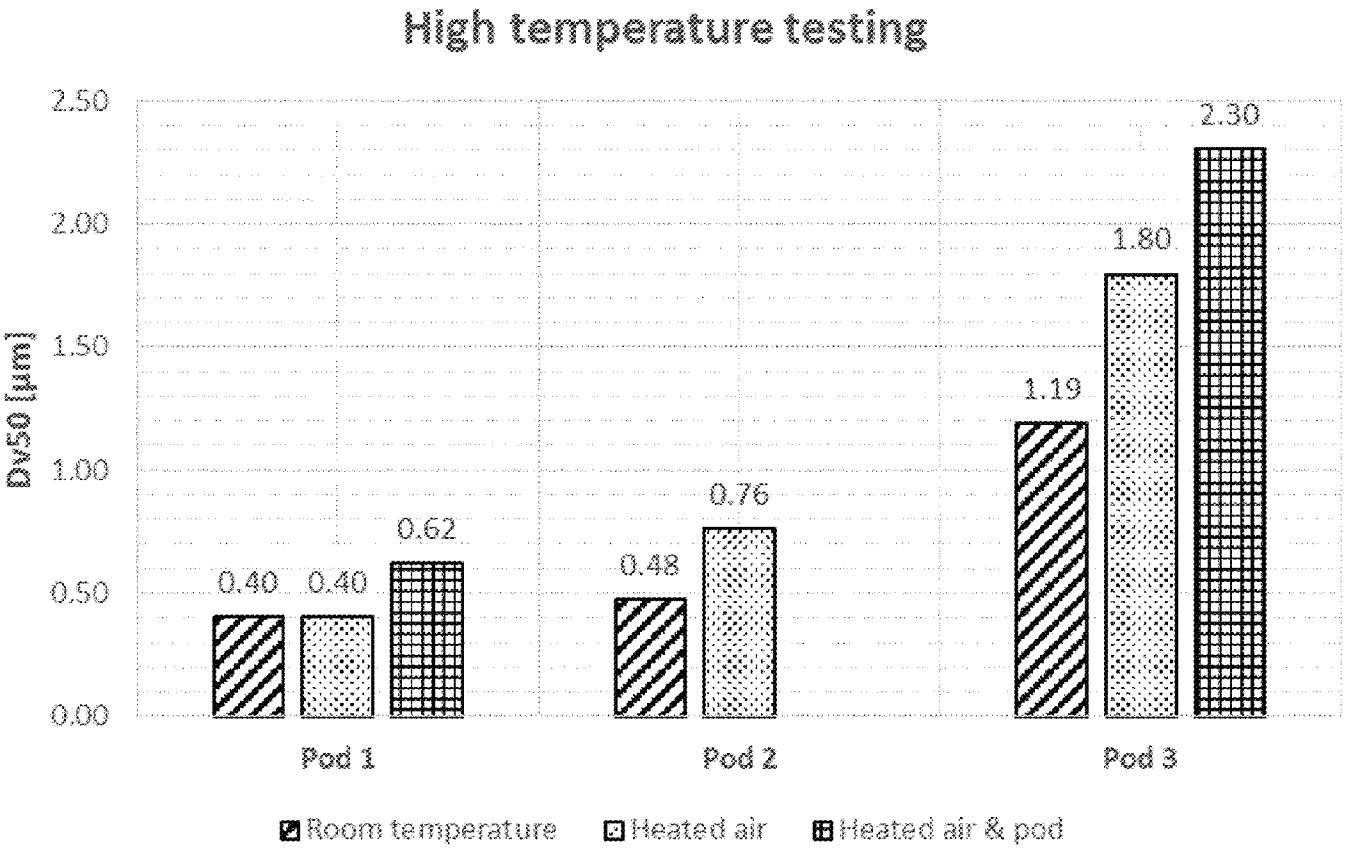
FIG. 14 shows a plot of aerosol particle size (Dv50) experimental results dependent on the temperature of the air and the heating state of the apparatus.

FIG. 14 shows the high temperature testing results of a tenth example. Larger particle sizes were observed from all 3 pods when the temperature of inlet air increased from room temperature (23° C.) to 50° C. When the pods were heated as well, two of the three pods saw even larger particle size measurement results, while pod 2 was unable to be measured due to significant amount of leakage.

Without wishing to be bound by theory, the results of the tenth example are in line with the inventors' insight that control over the vapor cooling rate provides an important degree of control over the particle size of the aerosol. As reported above, the use of a slow air velocity can have the result of the formation of an aerosol with large Dv50. It is considered that this is due to slower air velocity allowing a slower cooling rate of the vapor.

Another conclusion related to laminar flow can also be explained by a cooling rate theory of the tenth example: laminar flow allows slow and gradual mixing between cold air and hot vapor, which means the vapor can cool down in slower rate when the airflow is laminar, resulting in larger particle size.

The results in FIG. 14 further validate this cooling rate theory of the tenth example: when the inlet air has higher temperature, the temperature difference between hot vapor and cold air becomes smaller, which allows the vapor to cool down at a slower rate, resulting in larger particle size; when the pods were heated as well, this mechanism was exaggerated even more, leading to an even slower cooling rate and an even larger particle size.

Eleventh Example: Further Consideration of Vapor Cooling Rate

Figure 15:
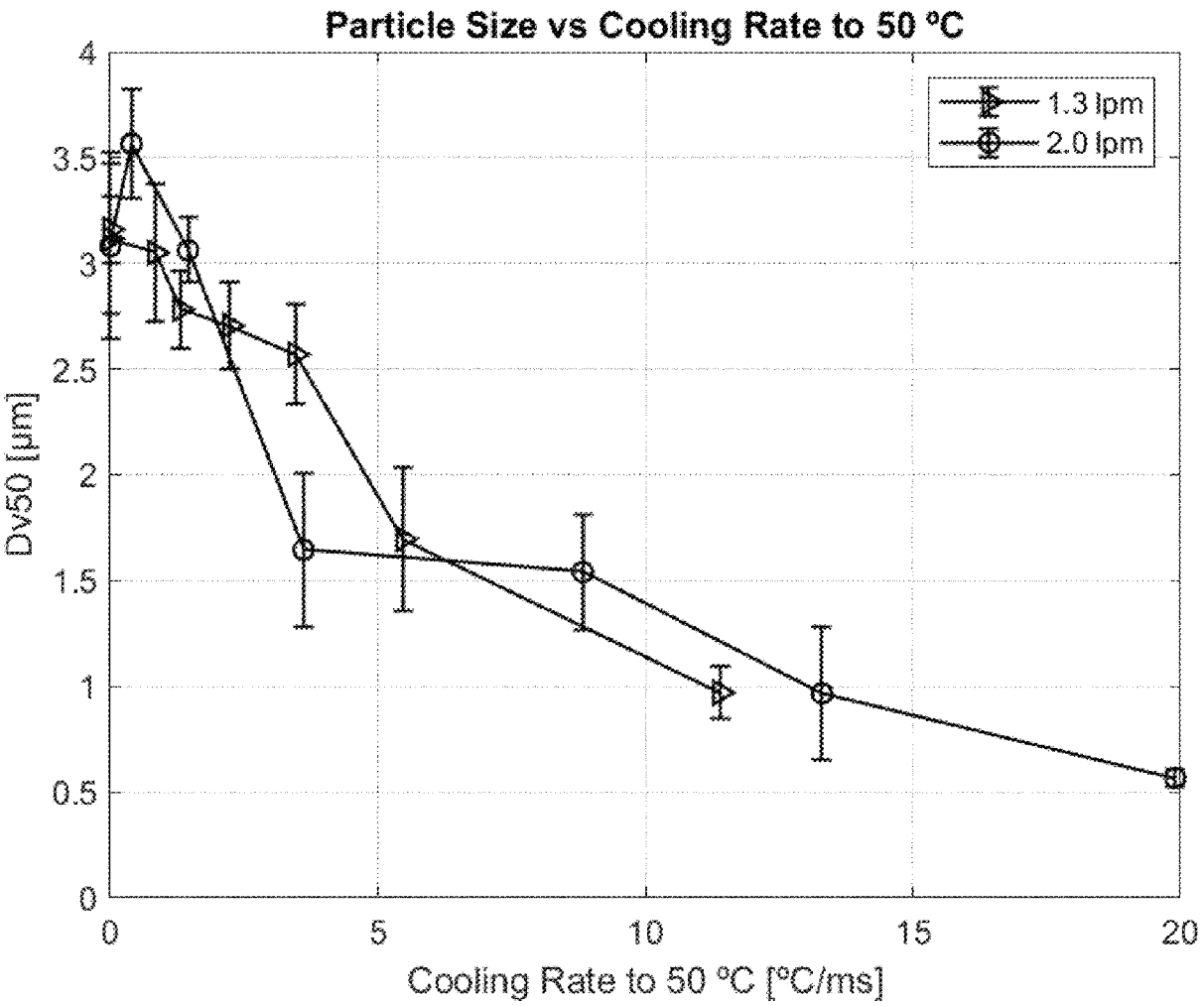
FIG. 15 shows a plot of aerosol particle size (Dv50) experimental results against vapor cooling rate to 50° C.
Figure 16:
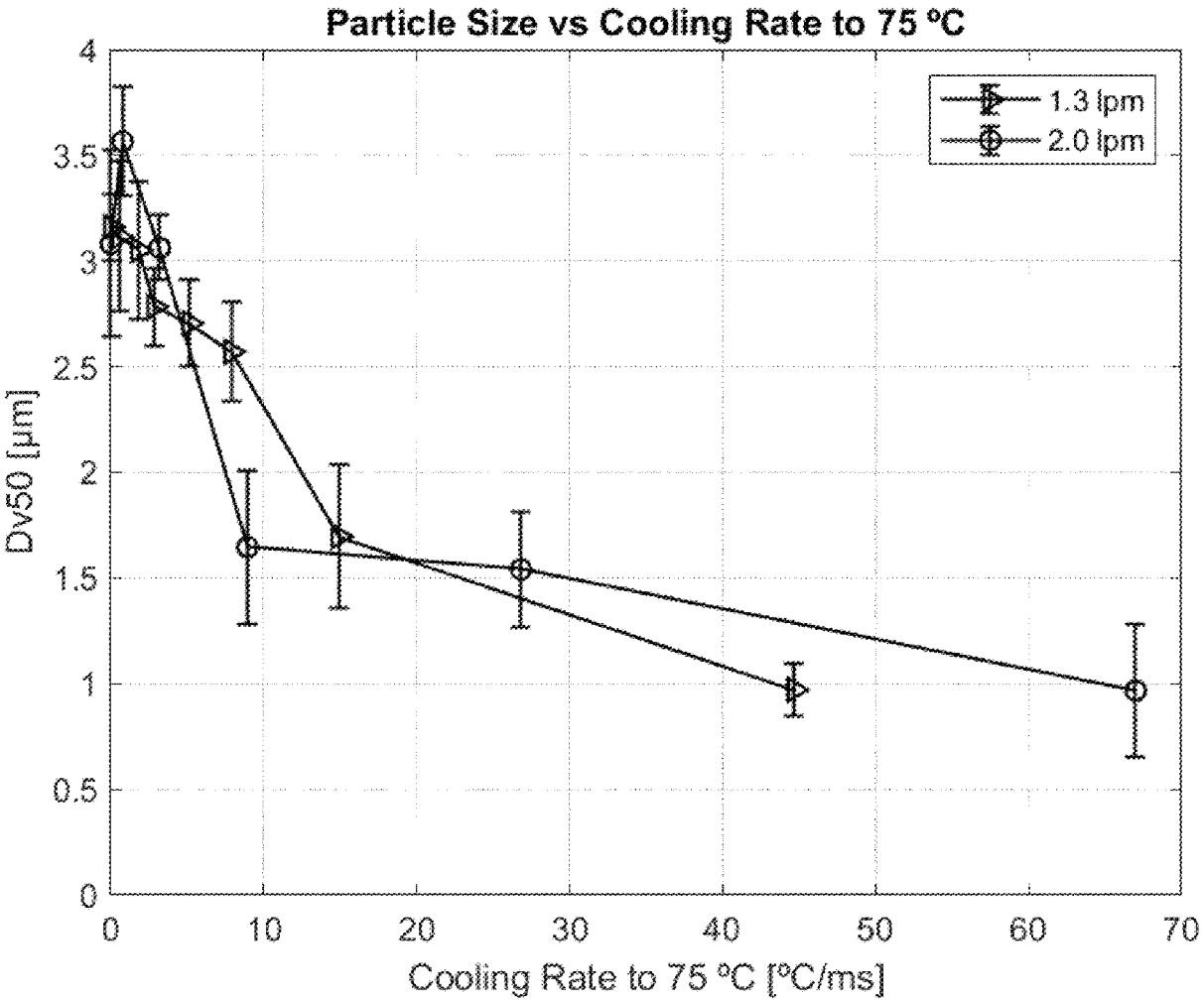
FIG. 16 shows a plot of aerosol particle size (Dv50) experimental results against vapor cooling rate to 75° C.

In the sixth example, the vapor cooling rates for each tube size and flow rate combination were obtained via multiphysics simulation. In FIG. 15 and FIG. 16, the particle size measurement results were plotted against vapor cooling rate to 50° C. and 75° C., respectively.

The data in these graphs indicates that in order to obtain an aerosol with Dv50 larger than 1 μm, the apparatus should be operable to require more than 16 ms for the vapor to cool to 50° C., or an equivalent (simplified to an assumed linear) cooling rate being slower than 10° C./ms. From an alternative viewpoint, in order to obtain an aerosol with Dv50 larger than 1 μm, the apparatus should be operable to require more than 4.5 ms for the vapor to cool to 75° C., or an equivalent (simplified to an assumed linear) cooling rate slower than 30° C./ms.

Furthermore, in order to obtain an aerosol with Dv50 of 2 μm or larger, the apparatus should be operable to require more than 32 ms for the vapor to cool to 50° C., or an equivalent (simplified to an assumed linear) cooling rate being slower than 5° C./ms. From an alternative viewpoint, in order to obtain an aerosol with Dv50 of 2 μm or larger, the apparatus should be operable to require more than 13 ms for the vapor to cool to 75° C., or an equivalent (simplified to an assumed linear) cooling rate slower than 10° C./ms.

Conclusions of Particle Size Experimental Work

In the above example, particle size (Dv50) of aerosols generated in a set of rectangular tubes was studied in order to decouple different factors (flow rate, air velocity, Reynolds number, tube size) affecting aerosol particle size. It is considered that air velocity is an important factor affecting particle size—slower air velocity leads to larger particle size. When air velocity was kept constant, the other factors (flow rate, Reynolds number, tube size) has low influence on particle size.

The role of turbulence was also investigated in the above examples. It is considered that laminar air flow favors generation of large particles, and introducing turbulence deteriorates (reduces) the particle size.

Modelling methods were used in some of the above examples to simulate the average air velocity, the maximum air velocity, and the turbulence intensity in the vicinity of the wick. A COMSOL model with three coupled physics has also been developed to obtain the vapor cooling rate.

All experimental and modelling results of the above examples support a cooling rate theory that slower vapor cooling rate is a significant factor in ensuring larger particle size. Slower air velocity, laminar air flow and higher inlet air temperature lead to larger particle size, because they all allow vapor to cool down at slower rates.

The features disclosed in the foregoing description, or in the following claims, or in the accompanying drawings, or in the above examples, expressed in their specific forms or in terms of a means for performing the disclosed function, or a method or process for obtaining the disclosed results, as appropriate, may, separately, or in any combination of such features, be utilized for realizing the disclosure in diverse forms thereof.

While the disclosure has been described in conjunction with the exemplary embodiments and examples described above, many equivalent modifications and variations will be apparent to those skilled in the art when given this disclosure. Accordingly, the exemplary embodiments and examples of the disclosure set forth above are considered to be illustrative and not limiting. Various changes to the described embodiments may be made without departing from the spirit and scope of the disclosure.

For the avoidance of any doubt, any theoretical explanations provided herein are provided for the purposes of improving the understanding of a reader. The inventors do not wish to be bound by any of these theoretical explanations.

Any section headings used herein are for organizational purposes only and are not to be construed as limiting the subject matter described.

Throughout this specification, including the claims which follow, unless the context requires otherwise, the words "have", "comprise", and "include", and variations such as "having", "comprises", "comprising", and "including" will be understood to imply the inclusion of a stated integer or step or group of integers or steps but not the exclusion of any other integer or step or group of integers or steps.

It must be noted that, as used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by the use of the antecedent "about," it will be understood that the particular value forms another embodiment. The term "about" in relation to a numerical value is optional and means, for example, +/−10%.

The words "preferred" and "preferably" are used herein refer to embodiments of the disclosure that may provide certain benefits under some circumstances. It is to be appreciated, however, that other embodiments may also be preferred under the same or different circumstances. The recitation of one or more preferred embodiments therefore does not mean or imply that other embodiments are not useful, and is not intended to exclude other embodiments from the scope of the disclosure, or from the scope of the claims.

ILLUSTRATIVE EMBODIMENTS

In the following numbered "clauses" are set out statements of broad combinations of novel and inventive features of the present disclosure herein disclosed.

Development B

B1. A smoking substitute apparatus for generating an aerosol, comprising:

a housing;

an air inlet and an outlet formed at the housing;

a passage extending between the air inlet and the outlet, in use an air flow entering into the housing to flow along the passage to the outlet for inhalation by a user drawing on the apparatus;

an aerosol generation chamber containing an aerosol generator being operable to generate an aerosol from an aerosol precursor; the aerosol generation chamber comprises at least one chamber outlet in fluid communication with the passage, the at least one chamber outlet permitting, in use, aerosol generated by the aerosol generator to be entrained into the air flow along the passage; and a bleed aperture opening into the aerosol generation chamber and configured to allow air to enter the aerosol generation chamber in an amount that contributes not more than 35% of the air flow at the outlet for inhalation by a user drawing on the apparatus.

B2. The smoking substitute apparatus of clause B1, wherein the bleed aperture is configured to have a smaller hydraulic diameter to that of the passage.

B3. The smoking substitute apparatus of clause 1 or clause B2, wherein the chamber outlet and the bleed aperture open at opposing ends of the aerosol generation chamber.

B4. The smoking substitute apparatus of any one of the preceding clauses B1 to B3, wherein the bleed aperture is in fluid communication with the passage through an auxiliary passage.

B5. The smoking substitute apparatus of clause B4, wherein the auxiliary passage comprises an auxiliary flow constrictor for limiting the amount of air flow through the auxiliary passage.

B6. The smoking substitute apparatus of clause B5, wherein the auxiliary flow constrictor comprises a narrowed section of the auxiliary passage.

B7. The smoking substitute apparatus of clause B5 or clause B6, wherein the auxiliary flow constrictor comprises an adjustable flow constrictor for controlling the amount of air flow through the auxiliary passage.

B8. The smoking substitute apparatus of any one of the preceding clauses B1 to B7, wherein the bleed aperture comprises a one way valve, said one way valve being configured to allow the air flow to enter the aerosol generation chamber through the bleed aperture and to prevent leakage out of the aerosol generation chamber through the bleed aperture.

B9. The smoking substitute apparatus of any one of the preceding clauses B1 to B8, wherein the bleed aperture is configured to allow air to enter the aerosol generation chamber in an amount that contributes no more than any one of 30%, 25%, 20%, 15%, 10% and 5% of air flow at the outlet for inhalation by a user drawing on the apparatus.

B10. The smoking substitute apparatus of any one of the preceding clauses B1 to B9, wherein the bleed aperture has a hydraulic diameter in the range of any one of 0.01 mm to 10 mm, 0.01 mm to 1 mm, 0.1 mm to 1 mm and 0.3 mm to 0.7 mm.

B11. The smoking substitute apparatus of any one of the preceding clauses B1 to B10, wherein the bleed aperture comprises a plurality of bleed apertures distributed over a base of the aerosol generation chamber.

B12. The smoking substitute apparatus of any one of the preceding clauses B1 to B11, wherein the aerosol precursor comprises a liquid aerosol precursor, and wherein the aerosol generator comprises a heater configured to generate the aerosol by vaporizing the liquid aerosol precursor.

B13. The smoking substitute apparatus of any one of the preceding clauses B1 to B12, wherein the smoking substitute apparatus is configured to generate an aerosol having a droplet size, $d_{50}$, of at least 1 μm.

B14. A smoking substitute system for generating an aerosol, comprising:

the smoking substitute apparatus of any one of the preceding clauses B1 to B13; and a main body configured to engage with the smoking substitute apparatus;

wherein the main body comprises a controller and a power source configured to energize the aerosol generator.

B15. A method of using the smoking substitute apparatus of any one of clauses B1 to B13, comprising:

generating the aerosol with the aerosol generator; and drawing on the apparatus to cause air to enter the aerosol generation chamber in an amount that contributes not more than 35% of the air flow at the outlet.

Development C

C1. A smoking substitute apparatus for generating an aerosol, comprising:

a housing;

an air inlet and an outlet formed at the housing;

a passage extending between the air inlet and the outlet, air flowing in use along the passage for inhalation by a user drawing air through the apparatus; and an aerosol generation chamber containing an aerosol generator being operable to generate an aerosol from an aerosol precursor, the aerosol generation chamber being sealed against air flow except for having at least one chamber outlet in communication with the passage, the at least one chamber outlet permitting, in use, aerosol generated by the aerosol generator to be entrained into an air flow along the passage.

C2. The smoking substitute apparatus of clause C1, wherein, in use, the volumetric flowrate of aerosol in the aerosol generation chamber is arranged to be less than 0.1 liter per minute.

C3. The smoking substitute apparatus of any one of the preceding clauses C1 to C2, wherein the passage is configured to allow an air flow entering the housing through the inlet to bypass the aerosol generation chamber.

C4. The smoking substitute apparatus of any one of the preceding clauses C1 to C3, wherein the passage coaxially extends alongside the aerosol generation chamber.

C5. The smoking substitute apparatus of any one of the preceding clauses C1 to C4, wherein air inlet is formed at a sidewall of the housing.

C6. The smoking substitute apparatus of any one of the preceding clauses C1 to C5, wherein the aerosol generation chamber is configured to discharge aerosol through the at least one chamber outlet by an increased internal pressure during the generation of aerosol.

C7. The smoking substitute apparatus of any one of the preceding clauses C1 to C6, wherein the at least one chamber outlet is closable by a one way valve that allow one way flow passage for aerosol to discharge from the aerosol generation chamber.

C8. The smoking substitute apparatus of any one of the preceding clauses C1 to C7, wherein the aerosol precursor comprises a liquid aerosol precursor, and wherein the aerosol generator comprises a heater configured to generate the aerosol by vaporizing the liquid aerosol precursor.

C9. The smoking substitute apparatus of clause C8, further comprises a tank for storing a reservoir of the liquid aerosol precursor, the tank being spaced from the aerosol generation chamber and is arranged to be in fluid communication with a wick of the heater through a liquid conduit.

C10. The smoking substitute apparatus of clause C8, wherein the liquid conduit has a hydraulic diameter ranging from 0.01 mm to 10 mm for controlling the flow rate of the liquid aerosol precursor from the tank towards the wick.

C11. The smoking substitute apparatus of any one of the preceding clauses C1 to C10, wherein the aerosol generation chamber is configured to have an internal volume ranging between 68 mm3 to 680 mm3 and/or a length ranging between 2 mm to 20 mm.

C12. The smoking substitute apparatus of any one of the preceding clauses C1 to C12, wherein the aerosol generator is spaced from the at least one chamber outlet.

C13. The smoking substitute apparatus of any one of the preceding clauses C1 to C12, wherein the smoking substitute apparatus is configured to generate an aerosol having a droplet size, $d_{50}$, of at least 1 μm.

C14. A smoking substitute system for generating an aerosol, comprising:

the smoking substitute apparatus of any one of clauses C1 to C14; and a main body configured to engage with the smoking substitute apparatus; wherein the main body comprises a controller and a power source configured to energize the aerosol generator.

C15. A method of using the smoking substitute apparatus of any one of clauses C1 to C14, comprising:

generating the aerosol with the aerosol generator; and drawing air through the apparatus to entrain the generated aerosol, through the at least one chamber outlet, into the air flow along the passage.

Development D

D1. A smoking substitute apparatus for generating an aerosol, comprising:

a housing;

an air inlet and an outlet formed at the housing;

a passage extending between the air inlet and the outlet, air flowing in use through the air inlet and along the passage for inhalation by a user drawing on the apparatus; and an aerosol generation chamber containing an aerosol generator operable to generate an aerosol from an aerosol precursor, the aerosol generation chamber comprising at least one chamber outlet in fluid communication with the passage, the at least one chamber outlet permitting, in use, aerosol generated by the aerosol generator to be entrained into an air flow along the passage;

wherein the passage extends alongside the aerosol generation chamber and is configured to allow all of the air flowing through the air inlet to bypass said aerosol generation chamber.

D2. The smoking substitute apparatus of clause D1, wherein the aerosol generation chamber is sealed against air flow except for the at least one chamber outlet.

D3. The smoking substitute apparatus of clause D1 or clause D2, wherein the aerosol generation chamber is configured to allow the aerosol to entrain into the air flow along the passage based on a pressure difference between the aerosol generation chamber and the passage.

D4. The smoking substitute apparatus of any one of the preceding clauses D1 to D3, wherein the air inlet is opened at a first end of the housing and the outlet is opened at a second end of the housing opposite the first end.

D5. The smoking substitute apparatus of clause D4, wherein the chamber outlet opens towards the second end of the housing.

D6. The smoking substitute apparatus of any one of the preceding clauses D1 to D5, wherein the chamber outlet is positioned adjacent to the passage and opens in the direction of air flow.

D7. The smoking substitute apparatus of any one of the preceding clauses D1 to D6, wherein the aerosol generator is located adjacent to the chamber outlet.

D8. The smoking substitute apparatus of any one of clause D1 to clause D7, wherein the aerosol generator is spaced from the chamber outlet.

D9. The smoking substitute apparatus of any one of the preceding clauses D1 to D8, wherein the passage comprises a flow converging portion downstream to the aerosol generation chamber, the flow converging portion is configured to converge the aerosol with the air flow in passage.

D10. The smoking substitute apparatus of any one of the preceding clauses D1 to D9, wherein the passage coaxially extends alongside the aerosol generation chamber.

D11. The smoking substitute apparatus of any one of clauses D1 to D9, wherein the passage comprises one or more passages each extending alongside the aerosol generation chamber.

D12. The smoking substitute apparatus of any one of the preceding clauses D1 to D11, wherein the aerosol precursor comprises a liquid aerosol precursor, and wherein the aerosol generator comprises a heater configured to generate the aerosol by vaporizing the liquid aerosol precursor.

D13. The smoking substitute apparatus of any one of the preceding clauses D1 to D12, wherein the smoking substitute apparatus is configured to generate an aerosol having a droplet size, $d_{50}$, of at least 1 μm.

D14. A smoking substitute system for generating an aerosol, comprising:

the smoking substitute apparatus of any one of clauses D1 to D12; and a main body configured to engage with the smoking substitute apparatus;

wherein the main body comprises a controller and a power source configured to energize the aerosol generator.

D15. A method of using the smoking substitute apparatus of any one of clauses D1 to D14, comprising:

generating the aerosol with the aerosol generator; and drawing on the apparatus to entrain the generated aerosol, through the at least one chamber outlet, into the air flow along the passage.

What is claimed is:

1. A smoking substitute apparatus for generating an aerosol, comprising:

an air inlet and an outlet;

a passage extending between the air inlet and the outlet, air flowing in use along the passage for inhalation by a user drawing on the smoking substitute apparatus; and an aerosol generation chamber containing an aerosol generator being operable to generate an aerosol from an aerosol precursor;

wherein the aerosol generation chamber comprises at least one chamber outlet in fluid communication with the passage at a junction, the at least one chamber outlet permitting, in use, aerosol generated by the aerosol generator to be entrained into an air flow along the passage;

wherein the passage has a constriction at or adjacent the junction, wherein a hydraulic diameter of the passage at or adjacent to said junction is smaller than a portion of the passage immediately upstream of the junction in a direction of the air flow, the constriction being configured to induce, in use, a localized reduced pressure in the air flow at the junction for drawing out the aerosol from the aerosol generation chamber; and wherein the at least one chamber outlet is positioned adjacent to the passage and opens in a direction of the air flow in the passage at the junction.

2. The smoking substitute apparatus of claim 1, wherein the constriction comprises one or more of a venturi tube, an orifice plate, and a narrowed section along the passage.

3. The smoking substitute apparatus of claim 1, wherein the aerosol generation chamber is substantially sealed against air flow except for the at least one chamber outlet.

4. The smoking substitute apparatus of claim 1, wherein the direction of the air flow is a first direction, wherein the junction is configured to be in fluid communication with the at least one chamber outlet through a junction inlet, and wherein said junction inlet opens towards a second direction substantially orthogonal to the first direction of the air flow at the junction.

5. The smoking substitute apparatus of claim 1, wherein the passage is arranged to allow all of the air flow entering the smoking substitute apparatus through the air inlet to bypass the aerosol generation chamber.

6. The smoking substitute apparatus of claim 1, wherein the at least one chamber outlet is closed by a one way valve.

7. The smoking substitute apparatus of claim 1, wherein the aerosol precursor comprises a liquid aerosol precursor, and wherein the aerosol generator comprises a heater configured to generate the aerosol by vaporizing the liquid aerosol precursor.

8. The smoking substitute apparatus of claim 7, further comprising a tank for storing a reservoir of the liquid aerosol precursor, and wherein the tank is spaced from the aerosol generation chamber and is arranged to be in fluid communication with a wick of the heater through a liquid conduit.

9. The smoking substitute apparatus of claim 8, wherein the hydraulic diameter of the passage is a first hydraulic diameter, and wherein the liquid conduit has a second hydraulic diameter ranging from 0.01 mm to 10 mm for controlling a flow rate of the aerosol precursor from the tank towards the wick.

10. The smoking substitute apparatus of claim 1, wherein the aerosol generation chamber is configured to have an internal volume ranging between 68 $mm^3$ to 680 $mm^3$ and/or a length ranging between 2 mm to 20 mm.

11. The smoking substitute apparatus of claim 1, wherein the smoking substitute apparatus is configured to generate the aerosol having a mean droplet size, $d_{50}$, of at least 1 μm.

12. The smoking substitute apparatus of claim 1, wherein the hydraulic diameter of the passage is a first hydraulic diameter, wherein the portion of the passage immediately upstream of the junction in the direction of the air flow is an expanded portion, and wherein the expanded portion has a second hydraulic diameter that is larger than the first hydraulic diameter of the passage immediately upstream of the expanded portion.

13. A smoking substitute system for generating an aerosol, comprising:

i) a smoking substitute apparatus, comprising:

an air inlet and an outlet;

a passage extending between the air inlet and the outlet, air flowing in use along the passage for inhalation by a user drawing on the smoking substitute apparatus; and an aerosol generation chamber containing an aerosol generator being operable to generate an aerosol from an aerosol precursor;

wherein the aerosol generation chamber comprises at least one chamber outlet in fluid communication with the passage at a junction, the at least one chamber outlet permitting, in use, aerosol generated by the aerosol generator to be entrained into an air flow along the passage;

wherein the passage has a constriction at or adjacent the junction, wherein a hydraulic diameter of the passage at or adjacent to said junction is smaller than a portion of the passage immediately upstream of the junction in a direction of the air flow, the constriction being configured to induce, in use, a localized reduced pressure in the air flow at the junction for drawing out the aerosol from the aerosol generation chamber; and wherein the at least one chamber outlet is positioned adjacent to the passage and opens in a direction of the air flow in the passage at the junction; and ii) a main body configured to engage with the smoking substitute apparatus; wherein the main body comprises a controller and a power source configured to energize the aerosol generator.

14. The smoking substitute system of claim 13, wherein the hydraulic diameter of the passage is a first hydraulic diameter, wherein the portion of the passage immediately upstream of the junction in the direction of the air flow is an expanded portion, and wherein the expanded portion has a second hydraulic diameter that is larger than the first hydraulic diameter of the passage immediately upstream of the expanded portion.

15. A method of using a smoking substitute apparatus, the smoking substitute apparatus comprising:

an air inlet and an outlet;

a passage extending between the air inlet and the outlet, air flowing in use along the passage for inhalation by a user drawing on the smoking substitute apparatus; and an aerosol generation chamber containing an aerosol generator being operable to generate an aerosol from an aerosol precursor;

wherein the aerosol generation chamber comprises at least one chamber outlet in fluid communication with the passage at a junction, the at least one chamber outlet permitting, in use, aerosol generated by the aerosol generator to be entrained into an air flow along the passage;

wherein the passage has a constriction at or adjacent the junction, wherein a hydraulic diameter of the passage at or adjacent to said junction is smaller than a portion of the passage immediately upstream of the junction in a direction of the air flow, the constriction being configured to induce, in use, a localized reduced pressure in the air flow at the junction for drawing out the aerosol from the aerosol generation chamber, and wherein the at least one chamber outlet is positioned adjacent to the passage and opens in a direction of the air flow in the passage at the junction;

the method comprising steps:

i) generating the aerosol with the aerosol generator; and ii) drawing on the smoking substitute apparatus to induce a localized pressure drop in the air flow at the junction, so as to draw out the generated aerosol from the aerosol generation chamber.

16. The method of claim 15, wherein the hydraulic diameter of the passage is a first hydraulic diameter, wherein the portion of the passage of the smoking substitute apparatus immediately upstream of the junction in the direction of the air flow is an expanded portion, and wherein the expanded portion has a second hydraulic diameter that is larger than the first hydraulic diameter of the passage immediately upstream of the expanded portion.

* * * * *